US010881974B2

(12) United States Patent
Donohoe

(10) Patent No.: US 10,881,974 B2
(45) Date of Patent: Jan. 5, 2021

(54) BUILDING TOY

(71) Applicant: Mark Donohoe, St. Louis, MO (US)

(72) Inventor: Mark Donohoe, St. Louis, MO (US)

( * ) Notice: Subject to any disclaimer, the term of this patent is extended or adjusted under 35 U.S.C. 154(b) by 0 days.

(21) Appl. No.: 16/254,502

(22) Filed: Jan. 22, 2019

(65) Prior Publication Data

US 2019/0217215 A1 Jul. 18, 2019

Related U.S. Application Data

(63) Continuation-in-part of application No. 15/653,868, filed on Jul. 19, 2017, now Pat. No. 10,183,229, which is a continuation-in-part of application No. 15/144,382, filed on May 2, 2016, now Pat. No. 9,737,825, which is a continuation-in-part of application No. 14/620,964, filed on Feb. 12, 2015, now Pat. No. 9,327,206.

(60) Provisional application No. 61/986,260, filed on Apr. 30, 2014.

(51) Int. Cl.

| | |
|---|---|
| ***A63H 33/08*** | (2006.01) |
| ***A63H 33/04*** | (2006.01) |
| ***A63H 33/10*** | (2006.01) |

(52) U.S. Cl.

CPC ..... *A63H 33/04* (2013.01); *A63H 33/10* (2013.01); *A63H 33/107* (2013.01)

(58) Field of Classification Search

CPC ..... A63H 33/08
USPC ..... 446/105, 106, 108, 110, 111, 124, 125; 52/233

See application file for complete search history.

(56) References Cited

U.S. PATENT DOCUMENTS

| | | | | |
|---|---|---|---|---|
| 1,271,160 | A | 7/1918 | Groves | |
| 1,311,337 | A * | 7/1919 | Fredson | A63H 33/06 446/114 |
| 1,351,086 | A | 8/1920 | Wright | |
| 1,402,438 | A | 1/1922 | Nichols | |
| 2,012,160 | A | 8/1935 | Forbes | |
| 2,059,598 | A | 11/1936 | Paulson | |
| 2,104,742 | A | 1/1938 | Fleischer | |
| 2,110,990 | A | 3/1938 | Forbes | |
| 2,712,199 | A | 7/1955 | Latimer | |
| 2,946,150 | A | 7/1960 | Houk | |
| 3,257,762 | A | 6/1966 | Steiner | |
| 4,270,304 | A | 6/1981 | Sofer | |
| 4,372,076 | A | 2/1983 | Beck | |
| 4,391,067 | A | 7/1983 | Frady et al. | |
| 5,145,440 | A | 9/1992 | Boris et al. | |
| 5,174,078 | A | 12/1992 | West | |

(Continued)

*Primary Examiner* — Kurt Fernstrom
(74) *Attorney, Agent, or Firm* — Lewis Rice LLC

(57) ABSTRACT

A building toy and a method of building with it. The toy is designed to be constructed of a rigid and generally non-deformable material such as, but not limited to, wood and particularly hardwood, and is constructed in the fashion of a log-style building toy. The toy utilizes interconnecting notches in its construction, but provides for a variety of specialized pieces which allow for interconnection of parts where there is one notch but not another, as well as the ability to build roofs, floors, and specialty structures such as fireplaces through the use of specialized components. Further, the use of more strongly connecting components allows for stronger structures to be built. This includes, but is not limited to various types of bridges, including arch, suspension, and cable stay.

10 Claims, 56 Drawing Sheets

(56) References Cited

U.S. PATENT DOCUMENTS

| | | | |
|---|---|---|---|
| 5,281,181 | A | 1/1994 | McCollum |
| 5,354,223 | A | 10/1994 | Wawzonek |
| 5,846,114 | A | 12/1998 | Frandsen, II |
| 6,059,630 | A | 5/2000 | Paxton et al. |
| 6,094,876 | A | 8/2000 | Ogo et al. |
| 6,146,232 | A | 11/2000 | Robbins |
| 6,189,271 | B1 | 2/2001 | Christensen |
| D466,166 | S | 11/2002 | George |
| 6,923,705 | B2 | 8/2005 | DeSalvo et al. |
| 7,044,824 | B2 | 5/2006 | Chavez |
| 8,105,127 | B2 | 1/2012 | Heston |
| 8,695,295 | B2 | 4/2014 | Thornton et al. |

* cited by examiner

BUILDING TOY

CROSS REFERENCE TO RELATED APPLICATION(S)

This application is a Continuation-in-Part (CIP) of U.S. Utility patent application Ser. No. 15/653,868 filed Jul. 19, 2017 and, which is a Continuation-in-Part (CIP) of U.S. Utility patent application Ser. No. 15/144,382 filed May 2, 2016, now U.S. Pat. No. 9,737,825, which is a Continuation-in-Part (CIP) of U.S. Utility patent application Ser. No. 14/620,964 filed Feb. 12, 2015 and now U.S. Pat. No. 9,327,206 which in turn claims benefit of U.S. Provisional Patent Application Ser. No. 61/986,260, filed Apr. 30, 2044. The entire disclosure of all the above applications is herein incorporated by reference.

BACKGROUND

1. Field of the Invention

This disclosure is related to a building toy. Specifically, it is directed to a log-style building toy comprising a plurality of interlocking rigid pieces.

2. Description of the Related Art

Building toys have always been very popular with children. The ability to construct structures and other items which can then be played with can provide for hours of entertainment. Further, building, toys are often considered very educational. As opposed to simpler toys such as dolls, plush toys, or miniature cars where play is limited to using the toy in a fashion that comports with its real world counterpart, building toys can often be constructed into a near limitless array of items.

Today there are a wide variety of building toys on the market. The most well-known, and also most versatile, are brick toys such as the Lego™ Brick. This toy provides a huge array of different pieces and colors and has been used not just as a toy, but as a professional architecture, engineering, and robotics tool. However, it is merely one of many examples of toys which utilize the most modern manufacturing techniques and materials to make a toy with a huge number of uses.

One of the more venerable building toys are log-style building toys the most well-known of which is Lincoln Logs™ which are constructed of wood. While plastic pieces have, on occasion, been provided, Lincoln Logs™ which are designed for the building of toy log cabins and similar westward expansion themed buildings are now, and have for most of their existence, been made of wood. Log-style building toys are well established and in many respects a "classic" toy. Lincoln Logs™ have been inducted into the toy hall of fame and have been on sale for almost a century.

Log-style building toys provide for certain benefits over other types of building toys. Because they are commonly made of wood, they provide for a different, and often desirable, texture, heft, and structure compared to most other building toys which are made from plastic. This can be beneficial to expose children to different experiences and allow them to work with different materials. They also provide for much easier construction of certain types of period structures, and provide for a structure with resultant surface depths and transitions.

At the same time, wood is relatively limited in its connection ability. Most modern building toys which provide for interconnection between parts generally rely on the slight giveability and resilience of plastics to provide for a strong interconnection. Basically, these toys "snap" together by causing the plastic to slightly deform and reform as the pieces connect. This is a feature that wood generally does not have. Because of that, log-style building toys have traditionally had a very strong limitation in the types of things they can construct. Specifically, they can only interconnect by connecting one cut-out to another at right angles forcing them to make square structures. This arrangement is illustrated in U.S. Pat. No. 1,351,086, the entire disclosure of which is herein incorporated by reference, that indicates that structures are assembled by interconnecting corresponding notches of transversely laid logs.

The problem with this arrangement it that it essentially allows only for interconnection at right angles and at corners. While the patent contemplates the use of very short logs to essentially "fill" in notches where there is no structural transverse piece, the construction is very limited. This can be frustrating to children where a set of log-style building toys can really only be used to build a relatively specific building or set of buildings, and those buildings often lack the desired features that a child wants (such as a window in a particular position). Most children expect building toys to have a wide degree of flexibility. Those that lack flexibility are often rapidly discarded.

Log-style building toys also have problems in that the structures they build necessarily have gaps that would not exist in an actual building of log construction and lack certain important components. Roofs are generally simply laid on and often collapse with just minimal play. Many structures formed of these building toys are relatively unstable, and collapse if played with as toy structures. Further, floors and interior details are generally very complicated or impossible to build. Instead, interior details are usually provided more in the form of doll house furniture as preconstructed elements.

While the lack of flexibility can be frustrating for children, it has also resulted in log-style building toys being of little use for adult entertainment. Many older adults, particularly those with degenerative neurological diseases such as Alzheimer's disease, can be entertained, and interacted with, through play because it is such a fundamental human action. Further, many older adults are comforted by textures of toys that are more akin to what they grew up with, not more modern plastics. One would think, therefore, that log-style building toys would be a valuable toy for use with adults. However, the lack of flexibility of existing log-style building toys can often make it too simple of a toy for these types of adults who have no interest in building in accordance with a plan or picture, but wish to express themselves creatively.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein among other things are a building toy and a method of building with it. The toy is designed to be constructed of a rigid and generally non-deformable material such as, but not limited to, wood and particularly hardwood, and is constructed in the fashion of a log style building toy. The toy utilizes interconnecting notches in its construction, hut provides for a variety of specialized pieces which allow for interconnection of parts where there is one notch but not another, as well as the ability to build roofs, floors, and specialty structures such as fireplaces through the use of specialized components. Further, the use of more strongly connecting components allows for stronger structures to be built.

Described herein, among other things, is a log-style building toy comprising: at least two basic logs, each of the basic logs being generally in the form of an elongated parallelepiped with two opposing ends and four sides giving it a width, height, and length; the basic log including at least four notches arranged therein, the four notches being arranged as two pairs of notches with each of the pairs of notches arranged toward the opposing ends, each of the notches in each pair of notches being arranged on opposing sides of the basic log; and at least one special log, the special log being generally in the form of an elongated parallelepiped with two opposing ends and four sides; the basic log including at least two notches arranged therein, the two notches being arranged as a pair with each of the notches in the pair being arranged on opposing sides of the special log; wherein, all of the notches in both the basic logs and the special log are configured to extend a depth of one quarter of the height of the basic log into the log into which they are formed; wherein, the special log has a height which is generally three-quarters (¾) the height of the basic log; and wherein the notches on different logs are designed to interlock with each other when the notches are aligned and the logs with the aligned notches are placed generally perpendicular to each other.

In an embodiment of the building toy, the building toy is constructed from hardwood.

In an embodiment of the building toy, the two basic logs are of different length.

In an embodiment, the building toy further comprises at least one additional basic log with a length different from the at least two basic logs.

In an embodiment, the building toy further comprises at least two gables and a plurality of roof slats having two opposing ends and four sides, each of the roof slats including a flange on one of the sides.

In an embodiment of the building toy, the flanges are positioned to extend from a major surface of the roof slat creating a co-planar surface with the major surface.

In an embodiment, the building toy further comprises a gable support which slides into grooves on a first surface of each of the gables to inhibit two opposing gables from moving toward each other.

In an embodiment, the building toy further comprises at least four roof rafters and two band boards, where the roof rafters can be positioned as two opposing pairs on the band boards to form roof gables.

In an embodiment of the building toy, each of the band boards is of the same size and shape as the at least two basic logs, but includes only two notches on a single side thereof.

In an embodiment of the building toy, the band board includes an elongated channel running the length of a side opposing the single side with the notches therein.

In an embodiment of the building toy, the channel creates two opposing rails to either of which the roof rafters can attach via a groove in the roof rafters.

In an embodiment of the building toy, the channel extends to a second side of the band board to create a single rail to which the roof rafters can attach via a groove in the roof rafters.

In an embodiment, the building toy further comprises a floor support log generally in the limn of an elongated parallelepiped with two opposing ends and four sides giving it a width, height, and length: the floor support log including at least four notches arranged therein, the four notches being arranged as two pairs of notches with each of the pairs of notches arranged toward the opposing ends, each of the notches in each pair of notches being arranged on opposing sides of the floor support log; and the floor support log including an elongated channel between both the ends arranged in a side which does not include any notches.

In an embodiment, the building toy further comprises: a chimney transition piece; and a chimney block connectable to the chimney transition piece.

In an embodiment of the building toy, both the chimney transition piece and the chimney block include holes.

In an embodiment, the building toy further comprises a dowel sized and shaped to fit into the holes, the dowel serving to connect the chimney block to the chimney transition piece.

In an embodiment, the building toy further comprises a bay window log, the bay window log having a large notch therein which is the length of two notches.

There is also described herein a tog style building toy comprising: at least two basic logs, each of the basic logs being generally in the form of an elongated parallelepiped with two opposing ends and four sides giving it a width, height, and length; the basic log including at least four notches arranged therein, the four notches being arranged as two pairs of notches with each of the pairs of notches arranged toward the opposing ends, each of the notches in each pair of notches being arranged on opposing sides of the basic log; and at least four roof rafters and two band boards, where the roof rafters can be positioned as two opposing pairs on the band boards to form roof gables; wherein, all of the notches in the basic logs are configured to extend a depth of one quarter of the height of the basic log into the basic log into which they are formed; wherein the notches are designed to interlock with each other when the notches are aligned and the logs with the aligned notches are placed generally perpendicular to each other; and wherein each of the two opposing pairs of root rafters includes a slot towards a peak when firmed into the roof gables, the slot accommodating a basic log at the pair of notches.

In an embodiment of the building toy, at least one of the at least four roof rafters is a dormer rafter having an elongated slot therein, the elongated slot being sized and shaped to mate with a dormer log having a tongue on one end thereof.

In an embodiment of the building toy, at least one of the at least four, roof rafters is a hip rafter, the hip rafter intersecting at least one of the band boards at a non-perpendicular angle.

There is also described herein a log-style building toy comprising: at least two basic logs, each of the basic logs being generally in the form of an elongated parallelepiped with two opposing ends and four sides giving it a width, height, and length; the basic log including at least four notches arranged therein, the four notches being arranged as two pairs of notches with each of the pairs of notches arranged toward the opposing ends, each of the notches in each pair of notches being arranged on opposing sides of the basic log and defining a center portion of each of the basic logs between the two pairs of notches and two end portions, each of the end portions being on the opposing side of one of the two pairs of notches, the end portion having an end length defined by the extension from the associated pair of notches; and the center portion having a center length defined by the distance between the two pairs of notches, wherein the center length of the basic log is greater than twice the end length of the basic log; and a dual connector log, the dual connector log being generally in the form of an elongated parallelepiped with two opposing ends and four sides giving it a width, height, and length; the dual connector log including at least four notches arranged therein, the four notches being arranged as two pairs of notches with each of the pairs of notches arranged toward the opposing ends, each of the notches in each pair of notches being arranged on opposing sides of the basic log and defining a center portion of each of the basic logs between the two pairs of notches and two end portions, each of the end portions being on the opposing side of one of the two pairs of notches, the end portion having a distance it extends from the associated pair of notches and the center portion having a center length defined by the distance between the two pairs of notches, wherein the center length of the dual connector log is generally equal to twice the end length of the basic log and the end length of the dual connector log is generally equal to the end length of the basic logs; wherein, all of the notches in the basic logs and the dual connector logs are configured to extend a depth of generally one quarter of the height of the basic log into the log in which they are formed; and wherein the notches are designed to interlock with each other when the notches are aligned and the logs with the aligned notches are placed generally perpendicular to each other.

In an embodiment, the building toy further comprises an arch log having an arcuate center portion and a first connecting end including a notch therein, wherein the notch is configured to extend a depth of generally one quarter of the height of the basic log into the arch log.

In an embodiment of the building toy, the arch log has a second connecting end on an opposing end of the are center portion, the second connecting end including at least one notch therein, wherein the notch is configured to extend a depth of generally one quarter of the height of the basic log into the arch log.

In an embodiment of the building toy, the least one notch in the second connecting end comprises two notches.

In an embodiment of the building toy, the second connecting end further includes a notch having a depth generally equal to the width of the basic log and a width generally equal to one quarter of the height of the basic log.

In an embodiment, the building toy further comprises an arch log having an arcuate center portion and a first connecting end including a notch therein, wherein the notch is configured to extend a depth of one half of the height of the basic log into the arch log.

There is also described herein a log-style building toy comprising: at least two basic logs, each of the basic logs being generally in the form of an elongated parallelepiped with two opposing ends and four sides giving it a width, height, and length; the basic log including at least four notches arranged therein, the four notches being arranged as two pairs of notches with each of the pairs of notches arranged toward the opposing ends, each of the notches in each pair of notches being arranged on opposing sides of the basic log and defining a center portion of each of the basic logs between the two pairs of notches and two end portions, each of the end portions being on the opposing side of one of the two pairs of notches, the end portion having an end length defined by the extension from the associated pair of notches; and the center portion having a center length defined by the distance between the two pairs of notches, wherein the center length of the basic log is greater than twice the end length of the basic log; a dual connector log, the dual connector log being generally in the form of an elongated parallelepiped with two opposing ends and four sides giving it a width, height, and length; the dual connector log including at least four notches arranged therein, the four notches being arranged as two pairs of notches with each of the pairs of notches arranged toward the opposing ends, each of the notches in each pair of notches being arranged on opposing sides of the basic log and defining a center portion of each of the basic logs between the two pairs of notches and two end portions, each of the end portions being on the opposing side of one of the two pairs of notches, the end portion having a distance it extends from the associated pair of notches and the center portion having a center length defined by the distance between the two pairs of notches, wherein the center length of the dual connector log is generally equal to twice the end length of the basic to and the end length of the dual connector log is generally equal to the end length of the basic logs; a tower connector, the tower connector being roughly in the form of an trapezoidal prism with the bottom corners removed, with a top surface parallel to a bottom surface, a left surface parallel to a right surface, and a front surface and rear surface pitched at an accurate angle relative to the vertical, giving the tower connector a width, height, and variable length, the length of the tower connector at its bottom surface equal to twice the length of a special log (or twice the width of a pillar log) and the length of the tower connector at its top surface being equal to the length of a special log the tower connector including at least three notches, the three notches being arranged as two notches in the bottom surface of the tower connector, each notch on opposing halves of the bottom surface and equidistant from the center of the bottom surface, and a third notch placed in the center of the top surface; an arch log, the arch log comprising an arcuate center portion, a first connecting end and a second connecting end, the first connecting end and the second connecting end on opposing ends of the arcuate center portion, each of the first connecting end and the second connecting end including a notch therein; and a tower header, the tower header being the same length and width as a basic log, including at least tour notches arranged therein, the four notches being arranged as two pairs of notches with each of the airs of notches arranged toward the opposing ends, each of the notches in each pair of notches being arranged on opposing sides of the tower header and defining a center portion of the tower header between the two pairs of notches and two end portions, each of the end portions being on the opposing side of one of the two pairs of notches, the end portion having the same end length as a basic log; and the center portion having a center length as a basic log; the center portion of the tower header including one or more holes; wherein, all of the notches in the basic logs, the dual connector logs, the tower connector, the arch log, and the tower header are configured to extend a depth of generally one quarter of the height of the basic log into the log in which they are formed; and wherein the notches are designed to interlock with each other when the notches are aligned and the logs with the aligned notches are placed generally perpendicular to each other.

In an embodiment of the building toy, the arch log includes one or more holes in the arcuate center portion.

In an embodiment of the building toy, the arch log includes one or more holes in the first connecting end.

In an embodiment of the building toy, the arch log includes one or more holes in the second connecting end.

In an embodiment, the building toy further comprises: a plurality of beam clips, each beam clip designed to fit over the ends of basic togs or other logs of similar dimensions to facilitate the construction of suspension bridges, wherein said beam clip includes an opening of a given width.

In an embodiment, the building toy further comprises: a plurality of bridge clips, each bridge clip designed to facilitate the construction of suspension bridges, wherein said bridge clip includes an opening of a given width.

In an embodiment of the building toy, small diameter rope, at a thickness less than the narrowest dimension of the hole or holes in each tower header, may be passed through the hole or holes in each tower header to create cable-stay type bridges.

In an embodiment of the building toy, small diameter rope, at a thickness less than the narrowest dimension of the hole or holes in the arch log, may be passed through the hole or holes in each arch log to create arch-type suspension bridges.

In an embodiment of the building toy, small diameter rope, at a thickness less than the narrowest dimension of the opening of each beam clip and each bridge clip, may be used to create suspension bridges.

In an embodiment, the building toy further comprises: a plurality of expanding arch brackets, each expanding arch bracket designed to allow for an arch to be enlarged arches for bridges or other structures.

In an embodiment, the building to further comprises: a rotatable octagon, said rotatable octagon being generally in the form of an octahedral prism, the rotatable octagon having a bottom surface and a top surface, providing a maximum height, each of the eight sides having a side length, with the distance between sides opposing sides defined by geometry; wherein four notches are placed in the top surface of the rotatable octagon, the four notches being arranged as two pairs of notches, such that the first pair of notches is oriented so that the axial direction of the length (the longest dimension) of each notch is parallel to one set of opposing faces of the rotatable octagon, and the second pair of notches is likewise oriented so that the axial direction of the length (the longest dimension) of each notch is parallel to a different set of opposing faces perpendicular to the first pair of notches (forming a shape roughly similar to a "Tic-Tac-Toe" shape), each notch of the pair of notches separated by a distance equal to twice the width of the end portion of a basic log, each notch having a width of a basic log, and each notch having a depth of one-third to one-quarter of the height of a basic log; wherein the two pairs of notches create four raised side surfaces and a raised central surface.

In an embodiment of the building toy, the raised central surface of the rotatable octagon includes a hole that passes through the entire thickness of the rotatable octagon.

In an embodiment, the building toy further comprises: a dowel, sized and shaped to fit into the hole within the raised central surface of the rotatable octagon, the dowel serving to allow for structures to rotate.

In an embodiment, the building toy further comprises: a vertical hinge.

In an embodiment, the building toy further comprises: a horizontal hinge.

In an embodiment of the building toy, both the vertical hinge and the horizontal hinge include holes.

In an embodiment, the building toy further comprises: a dowel sized and shaped to fit into the holes, the dowel serving to connect either the vertical hinge or the horizontal hinge with the remainder of the building toy.

In an embodiment, the building toy further comprises: a drawbridge system.

BRIEF DESCRIPTION OF THE DRAWINGS

FIG. 1A shows a basic log, FIG. 1B shows a half log, and FIG. 1C shows a special log.

FIG. 23A shows a band board pin connector log. FIG. 23B shows a band board closed corner log, and FIG. 23C shows a hole connector log for use with the logs of FIGS. 23A and 23B.

FIG. 32A shows an inside view, FIG. 32B shows an outside view, FIG. 32C shows a bottom view, and FIG. 32D shows a top view.

DESCRIPTION OF THE PREFERRED EMBODIMENT(S)

Described herein a building toy which is intended or the construction of dwelling structures of the types commonly used by humans. The structure is designed to simulate the construction of log homes or similar structures which are constructed from long single pieces of wood as opposed to more modern constructions with wooden frames and slat siding and drywall covering. However, the resulting structure will generally have the appearance not of a true log home (which utilizes generally cylindrical logs in its construction) but of the more rectangular siding structure common in wood or vinyl sided structures. However, the exact appearance is by no means required.

Figure 1A:
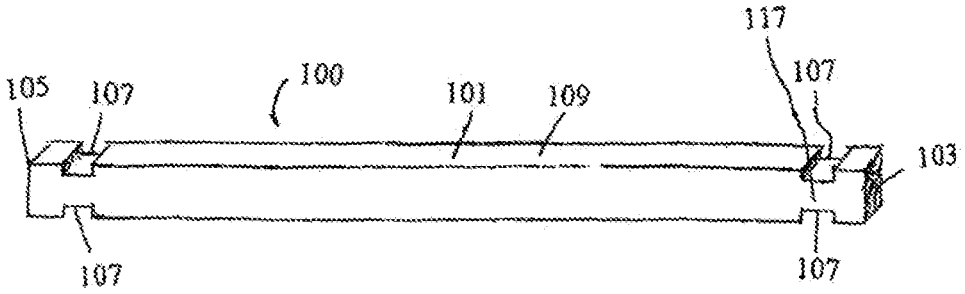
FIGS. 1A-1C show three basic log components of an embodiment of the building toy. Specifically.

The building toy is composed primarily of elongated parallelepipeds often with rounded corners to provide for better feel. However, generally cylindrical parts can be used in another embodiment. An embodiment of a general structure of the core building component of such a toy is shown in FIG. 1A. Many of the pieces of the toy will generally be referred to herein as "logs" due to their general shape and intended build methodology. Each log will generally be constructed of a relatively rigid and non-deformable material such as but not limited to wood (particularly hardwood), metal, rigid hard plastic, or stone. Non-deformable materials are preferred because the building toy is designed to utilize interlocking notches as the primary component of interconnection. Thus, the toy is not designed to have components deform in order to allow interconnection. Use of a rigid material is preferred not only because deformability is not necessary, but because such materials can provide the logs with greater heft and often a more interesting tactile experience.

FIG. 1A shows a basic log (100). Is comprised of an elongated body (101) of generally parallelepiped shape with four sides and two opposing ends (103) and (105). The shape will generally be defined by the elongate length, as well as a middle dimension height and smallest dimension width, however the relative sizes of the last two dimensions may be reversed in some embodiments. There will generally positioned toward each of the ends (103) and (105) a notch (107). In a basic log (100) there are two notches (107) positioned on opposing sides of the basic log (100) toward both ends (103) and (105). The notches will generally be on the two sides defining the dimension of height. A basic log (100) may also additionally or alternatively include any number of notches (107) within the center portion (109) between the notches (107) shown in FIG. 1A but that is not required as discussed later. Generally basic logs (100) will be provided in a variety of different lengths of the main body. These will often be multiples of lengths of other components so basic logs of 1, 2, 3, 4, 5, or more times the length of any other basic log (100) could be used.

The basic log (100) will also generally be provided in a "spacer" format which is designed to be shorter. A spacer format basic log (100) will generally only have a single notch (107) and the distance between the center of the notch (107) and the end (105) will be equal to the distance from the center of the notch (107) to the end (103). Generally, a notch (107) in the basic log (100) will extend about one-quarter (¼) of the height of the center portion (109) of the basic log (100). Thus, the height of the portion (117) of the basic log (100) between any two opposing notches (107) will generally be about one-half (½) the width of the center portion (109) of the basic log (100). Each notch (107) will generally have a length equal to the width of the log so that a log placed transverse to another with their notches align can be interlocked. The basic log (100) is the core building component of the toy.

Figure 1B:
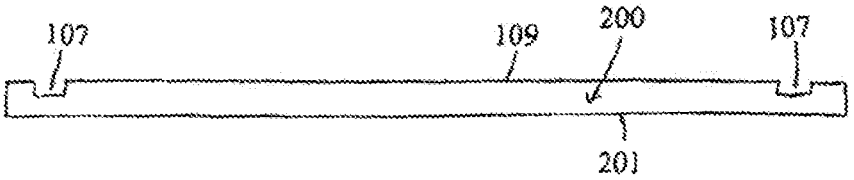

FIG. 1B provides an embodiment of a half log (200). The half log (200) is effectively the same arrangement as a basic log (100) which has been split in half along its length. It will generally only include notches (107) along a single side as shown in FIG. 1B. The half log (200) will generally be used to allow for a flat surface (201) to be provided so as to allow a construction of the toy to rest cleanly on a support structure, or to create a flat surface for other objects to rest upon the toy.

Figure 1C:
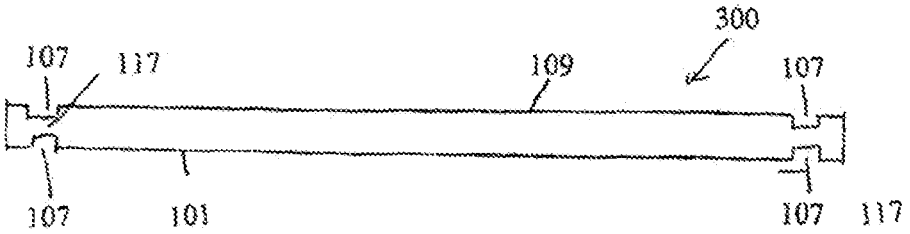

FIG. 1C provides for a special log (300). The special log (300) is designed to act as a part connector. In particular, it is designed to interconnect a notch (107) of any one log to the center portion (109) of another log. The special log (300) will generally be of the same design as the basic log (100), however its dimensions are different. The special log (300) will have a main body (101) height which is only three quarters (¾) the height of a basic log (100), however, its width is the same as a basic log (100). As with all logs, its length is variable.

Figure 3:
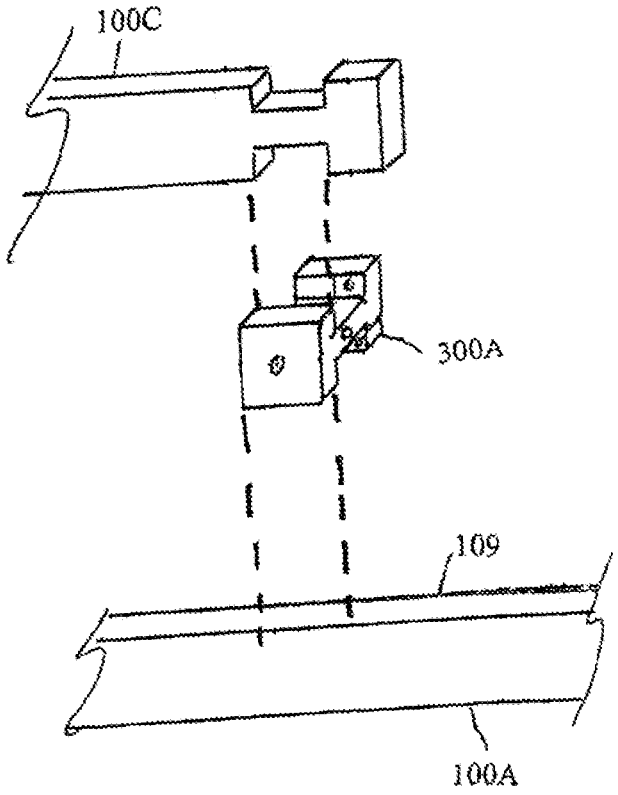
FIG. 3 shows how a specialty connector can be used to connect two logs together where there is only one notch present.

The notches (107) in the special log (300) are cut to the same dimensions as those of the basic log (100). Specifically, they are cut one quarter (¼) the height of the basic log (100) deep. This means the connector portion (117) is precisely one-quarter (¼) the height of the basic log (100) or one half (½) the height of the connector portion (117) of a basic log. While FIG. 1C shows a special log in the same arrangement as that of FIG. 1A, most of the special log (300) components of a toy set will generally be provided in the arrangement of a spacer log with only a single set of opposing notches (107). One such special log (300A) is shown in FIG. 3.

Figure 2:
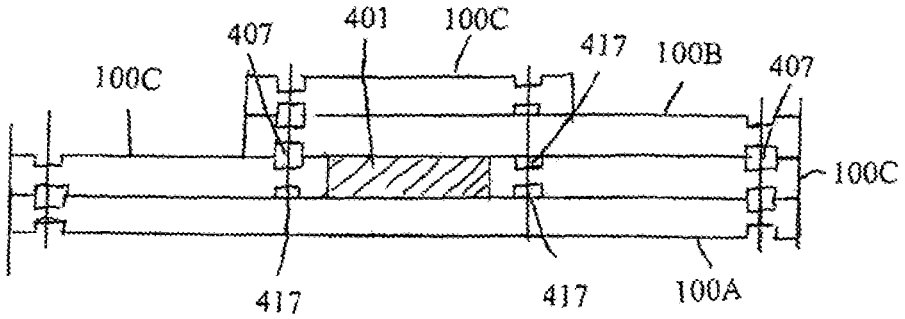
FIG. 2 shows an embodiment of the relative lengths of logs and how their notches will interlay when placed into a wall arrangement.

FIG. 2 shows how the various logs can be used to form a wall. As opposed to prior art building toys which required that logs always meet at notches (107), the present toy has no such requirement. In the arrangement of FIG. 2, three different lengths of basic log (100A), (100B) and (100C) which have no internal notches (107) in the center portions (109) have been arranged in the form of a wall which includes a void (401) which could be used as a window or similar architectural element. As can be seen from the FIG, at some points (407) two notches (107) are aligned while at other points (417) a notch (017) is against the central portion (109) of another log.

In the double notch points (407), a basic log (100) of desired size may be used as is common in prior art designs by simply aligning its notches (107) with the double notch point (407) while transverse to the page of FIG. 2. However, placement of a basic log (100) in a single notch point (417) would produce an unstable attachment. However, the portion (117) of a special log (300) is correctly sized to fit here allowing a connection to be made as shown in FIG. 3. Due to the length of the notch (107) corresponding to the width of the log, the log (100A) can be placed within the notch (107) at its center section (109).

It should be noted that in positions where there is a double notch point (407) above or below a single notch point (417) (as is shown at the left internal notch stack in FIG. 2), because the special log (300) has only the total height of a basic log (100), the ends will touch forming a clean connection. The same is also true of two half notches above each other (as is shown in the right internal notch stack in FIG. 2) where the two special logs (300) will also touch creating a clean structure.

It should be apparent from the above that the inclusion of the special log (300) provides for vastly improved flexibility in construction as it eliminates the need for logs to always meet at notches. Thus, it is possible to make basic logs (100) of essentially any length, even if they are not multiples of each other. This allows for there to be a near limitless ability to create voids (401) of different shapes and sizes. As voids (401) are commonly used to represent windows and doors, these can now be positioned virtually anywhere in the walls, and need not be square as use of different lengths of basic lags (100) can create other shapes such as polygons which can appear rounded in certain situations.

While the above provides for vastly more flexibility to the basic log construction and many more options for use of the toy, with that flexibility it can also be desirable to have additional components which allow for the flexibility to carry into additional common components of man-made structures and dwellings.

Figure 4:
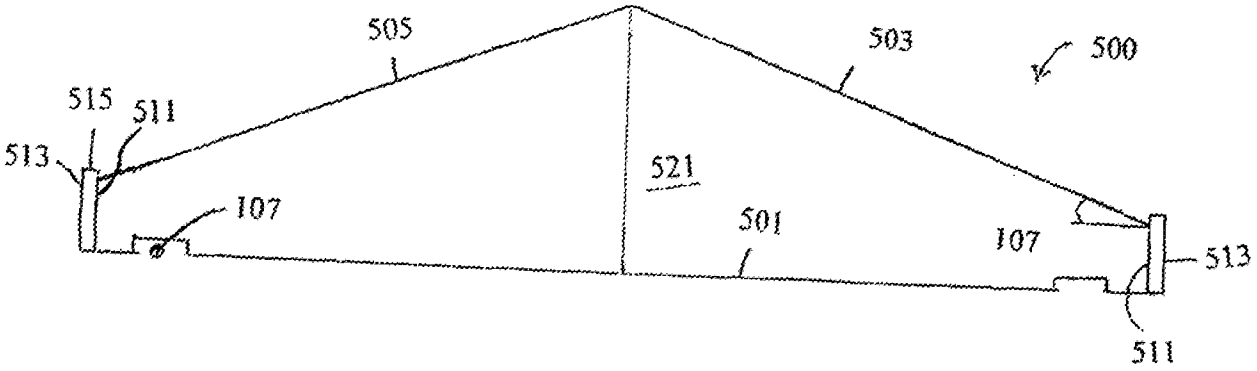
FIG. 4 shows an outside plan view of an embodiment of a fixed length roof gable.
Figure 6:
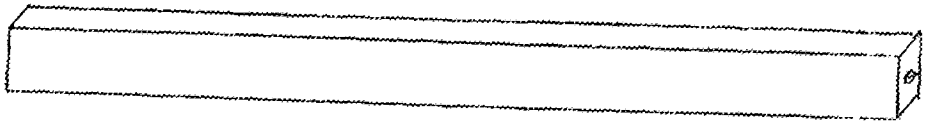
FIG. 6 shows an embodiment of a gable support.
Figure 5:
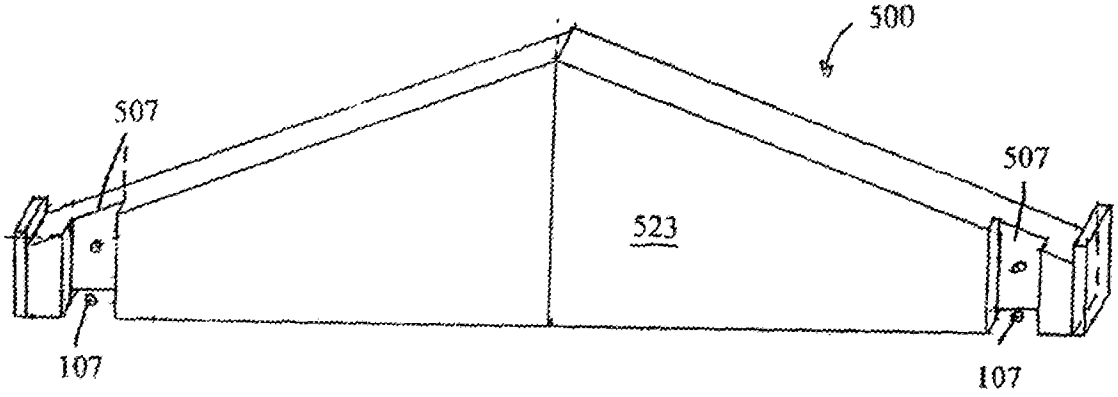
FIG. 5 shows an inside plan view of the gable of FIG. 4.

FIGS. 4 through 7 provide for various views of a fixed length and angle gable (500) for the formation of roofs for the toy structures. The gable (500) generally comprises a roughly triangular structure with blunted corners having a base (501) and two tops (503) and (505). While the gable (500) of the FIGS an isosceles triangle, this is by no means required and other shapes can be used. Isosceles triangles, however, are commonly associated with the shapes of roofs making their design particularly appealing. Each gable will generally include two end notches (107) of the same depth as all the other previously discussed pieces on its bottom surface (501). However, as shown in FIG. 5, the gable (500) will also generally include a groove (507) aligned at 90 degrees to the notch (107). This groove (507) is generally of similar depth to the notch (107) and intersects it. The groove (507) serves as a point in which to slide a gable support (600).

Figure 7:
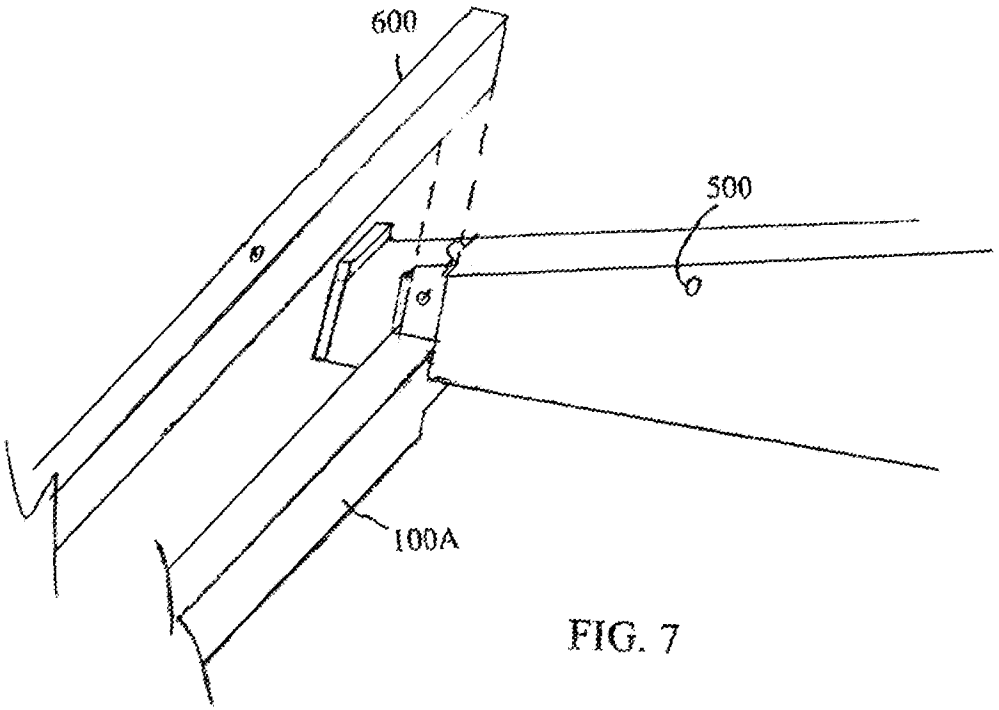
FIG. 7 shows the interconnection of a gable to a gable support to create a roof support.

The gable support (600) is, shown in FIG. 5 and generally the same height and width dimensions as a basic log (100) from the set, but includes no notches, and has a length that is around the length of the basic log between the edges of the end notches (107) plus twice the depth of the groove (507). However, the length of the gable support (600) is highly variable and generally can be anything so long as the support interconnects to support the gables (500) such as is shown in FIG. 7. The gable support (600) is generally used to provide an internal surface which makes a wall smooth and continuous under the rafters.

FIG. 7 shows how one of the gables (500) would be connected to form a roof although two gables (500) opposingly positioned would generally be used. The gable (500) will generally be placed with the notch (107) of the gable (500) perpendicularly aligned with a notch (107) of generally a basic log (100A), although any log with a notch can be used. Once the notches (107) are positioned, the gable support (600) is dropped into the groove. It, therefore, supplies a surface resembling the rest of the wall, but it also serves to support the gable (500) upright. It should be apparent that with the notches (107) aligned between the gable (500) and basic log (100A), the outside surface (521) of the gable (500) is pushed against the inside of the basic log's (100A) notch (107). Further, the gable support (600) is against the inside surface of the groove (507).

If two gables (500) are now positioned opposing each other with their inside surfaces (523) facing and at a distance proportional to the selected gable support (600), the gables (500) effectively interlock with each other with the gable supports (600) on both sides, and the insides of the notches (107) of the basic log (100A) to form a fairly rigid structure to support the roof.

Figure 8:
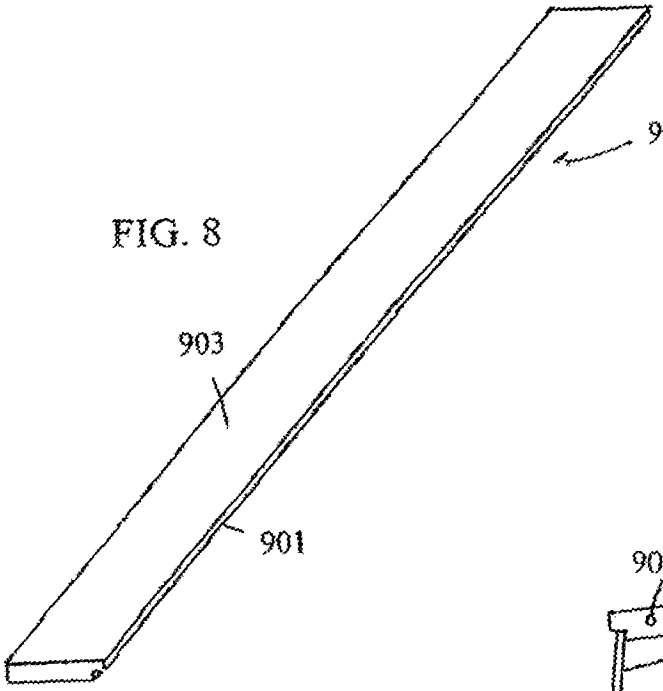
FIG. 8 shows an embodiment of a roof slat.
Figure 9:
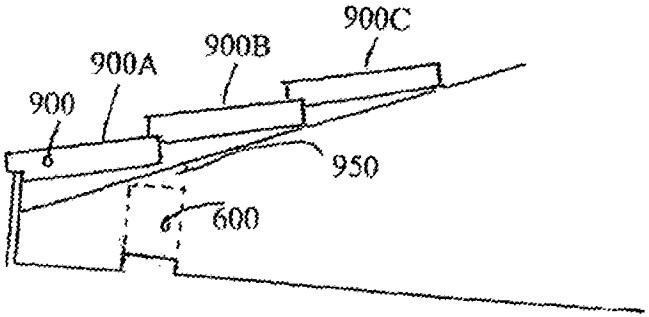
FIG. 9 shows an embodiment of roof slats arranged on the support of FIG. 8 or 14.

FIGS. 8 and 9 illustrate how a roof can be formed using two opposing gables (500). A plurality of roof slats (900) are generally provided with the toy. The roof slats (900) may be of any length, but as with all pieces will generally be of relatively common size based on relative proportions compared to the basic logs (100). Each roof slat (900) comprises a parallelepiped generally with one significantly smaller dimension. In an alternative embodiment, the roof slat (900) may be of a trapezoidal or parallelogram main shape to allow for the slat to have angled ends. This provides for an alternative appearance, but can also allow slats to interact with each other at an angle as will be preferable in a hip roof, two connected roofs, or a dormer as contemplated later. On one of the elongated narrow sides of the slat (900) there is a flange (901) which extends outwardly form the main body (903) of the slat. The flange will generally be about half the width (smallest dimension) of the roof slat and will be arranged to extend from one of the major surfaces to provide a co-planar surface with it.

As is visible in FIGS. 4 and 5, each of the gables (500) does not comprise a true triangle, but instead has the corners where each tops (503) and (505) intersect the base (501) cut off to form an end (511). At each end there is a support piece (513) which is generally aligned with the surfaces of the base (501) and each side (521) and (523). The support piece (513) is, however, generally is slightly taller than the end (511) resulting in their being a small extension (515) above the top (503) and (505).

To form a roof, the roof slats (900) are positioned on the top sides (503) and (505) of the gables as shown in FIG. 9. As can be seen from FIG. 9, each roof slat (900) is arranged so as to extend between the two gables (500). The lowest roof slat (900A) has its flange (901) resting on the top corner of the support piece (513) and therefore slightly raised above the top side (503) or (505) by a portion of the extension, Each consecutive roof slat (900B) and (900C) is positioned on the prior roof slat (900A) and (900B) respectively so that its flange (901) over hangs the back corner of the prior roof slat (900A) or (900B). This partial overlay provides for a more natural looking roof design, and also inhibits the roof slats (900) from sliding down the top surfaces (503) and (505).

It should also be apparent from FIG. 9 how the gable support (600) effectively blocks line of sight under the roof slats (900). With appropriate sizing, the gable support (600) will extend to a point either touching or just below the upward edge of the forward most roof slat (900A), and that point is generally vertically higher than the downward edge of the same slat. Thus, the gap (950), to the extent one exists, is generally hidden from sight by roof slat (900A).

While the gable (500) provides for a solid appearing roof with no obvious gaps and a sturdy construction method, the gable (500) is limited in that it has a large number of fixed dimensions. As the building toy is designed to have a large amount of variability in structure design, it is desirable in an embodiment to have a roof gabling system with increased flexibility compared to that shown in FIGS. 4-7. An embodiment of such a design is provided in FIGS. 10-13.

Figure 10:
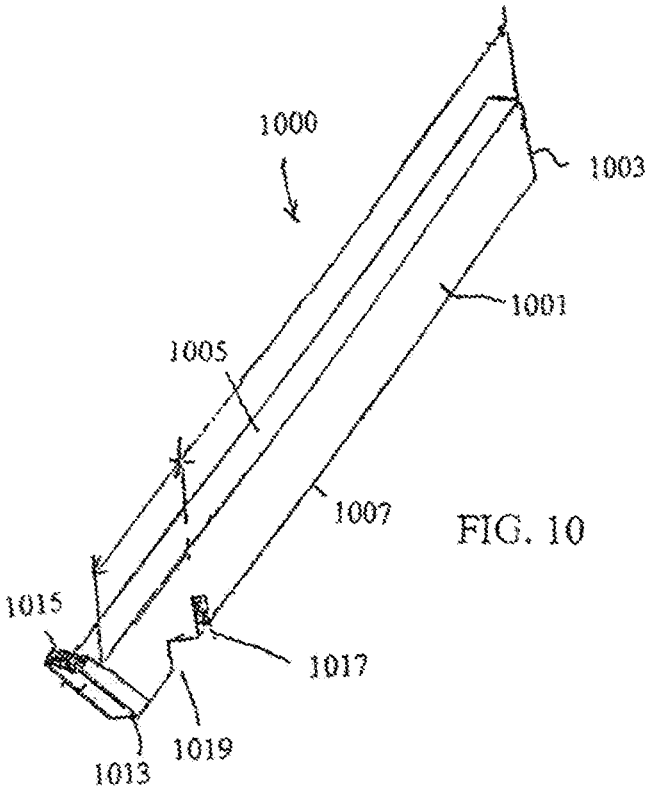
FIG. 10 shows an embodiment of a roof rafter.

FIG. 10 provides for an embodiment of a rafter (1000). The rafter (1000) comprises a generally parallelepiped main body (1001) where the first end (1003) is cut at an angle from the top to the bottom (e.g. the angle is relative to the height). At the second end (1005) there is included a support piece (1013) of design generally similar to support piece (51) of FIG. 4 and which provides an extension (1015) above the top surface (1005) of the rafter. Note that while rafter (1000) does not show a slot (2901) as shown in the rafter (2900) of FIG. 29A, it could include such a structure in an alternative embodiment.

Figure 11:
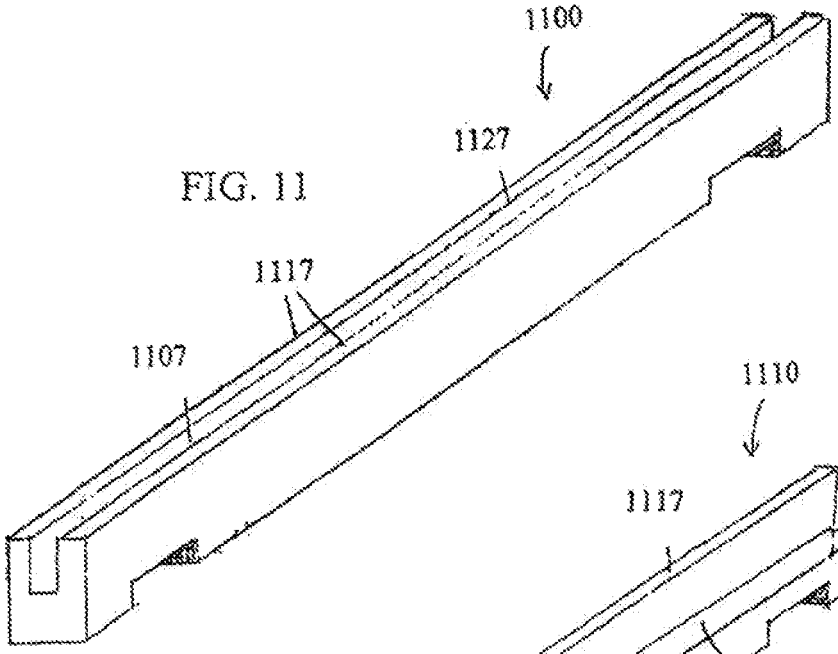
FIG. 11 shows an embodiment of a rafter support or band board.
Figure 12:
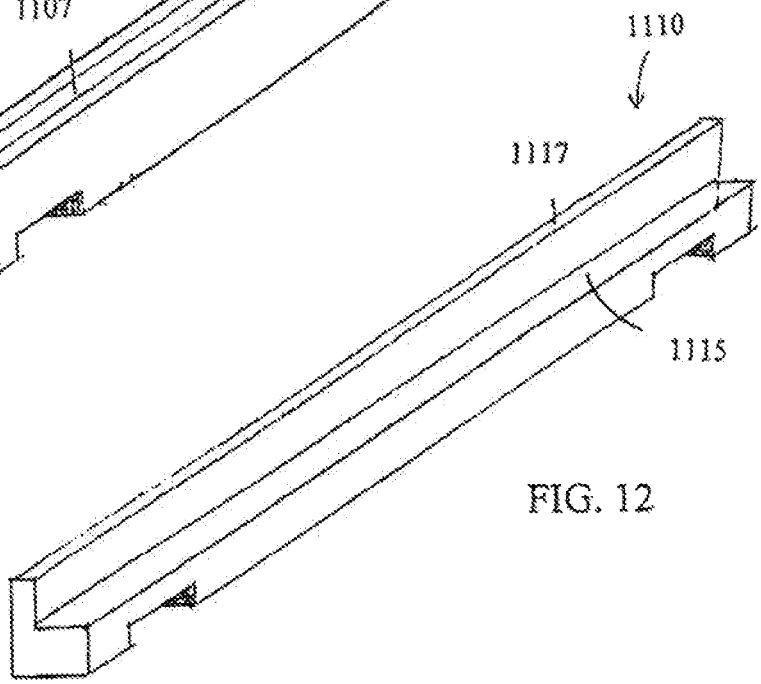
FIG. 12 shows an embodiment of a rafter support which can also support an "attic" floor.

On the bottom surface (1007) of the rafter (1000) them is provided a groove (1017) and a cutout (1019). The groove (1017) is designed to interface with one of the rails (1117) of a roof band board (1100) or (1110) as shown in FIGS. 11 and 12 and will generally be cut into the rafter (1000) at an angle corresponding to the angle the first end (1003) is cut to. As such, the groove (1017) is generally sized and shaped to hold a rail (1117) therein. The cut out (1019) is an optional component that is designed to allow for the rafter (1000) to clear the end (105) or (103) of a basic log (100) to which the band board (1100) or (1110) is attached if the rafter is placed directly above the notch (107) of the band board (1100) or (1110). This is illustrated in FIG. 13

As indicated above, FIGS. 11 and 12 provide for embodiments of band boards (1100) and (1110). The band board (1100) of FIG. 11 is considered a delimit design and is intended for the purpose of attaching a roof only. The band board (1100) is generally the same dimensions as a basic log (100) but includes notches (1017) on only one side (the bottom) thereof. The side opposing the notches (107) has a channel (1107) running therethrough, the entire length of the band board (1100) which creates two flanges or rails (1117) on the opposing sides thereof. Generally the channel (1107) and the rails (1117) are all of the same width (one third (⅓) that of the band board (1100)) and the channel has a depth of one half (½) the height of the band board (1100), but that is by no means required.

The band board (1110) of FIG. 12 is a slight modification of FIG. 11. The band board (1110) is designed to be used where there is to be construction of an attic floor or where an easier to interact with rail (1117) is preferred. The band board (1110) of FIG. 12 is generally identical to the band board (1100) of FIG. 11, however one of the rails (1117) is removed so that the base of the channel (1107) smoothly transitions to the side of the band hoard (1110) in a floor support surface (1115). This give the band board (1110) a generally "L"-shaped cross sectional structure.

Figure 13:
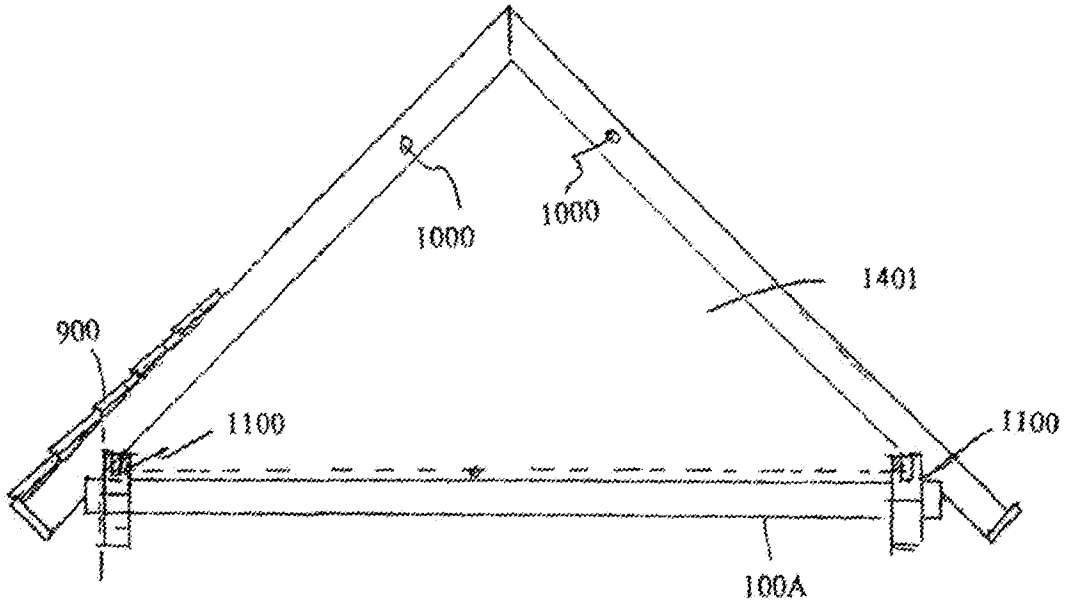
FIG. 13 shows a roof support assembled from the rafters of FIG. 10 and the rafter supports of FIG. 12 or 13.

FIG. 13 shows how to form a roof using the rafters and hand hoards of FIGS. 10-12. In FIG. 13, the hand boards (1100) or (1110) are positioned transverse the highest basic logs (100) in the structure on two opposing sides. Four rafters (1000) are then used with two opposed length-wise at each side of the structure. The grooves (1017) are posited to hold the outermost rails (1117) of the two band boards (1100) or (1110). The angle ends (1003) of the two opposing rafters (1000) meet to form the roofline. Roof slats (900) are then positioned on the two sets of opposing rafter (1000) pairs in the same manner as when using gables (500).

If band boards (1110) are being used and a floor is desired, floor pieces may be positioned to rest on the floor support star faces (1115) on the opposing sides. In an embodiment, the floor pieces may be large thin components. In another embodiment, floors are made by interlocking the flanges of two roof slats (900) with each other with a first slat (900) one way over and the other reverse. This forms a flat slab of generally double height. These "double-high" roof slat arrangements can then be arranged side by side to form a smooth floor. It should be noted that this arrangement of roof slats (900) can also be used to form flat roofs whether angled on a gable (500) or rafters (900) or simply across the top of a basic log (100) structure.

One advantage of using the roof band board (1100) in the roof support is that since its width is the same as a basic board, the upper surface (1127) formed of the tops of the two rails can be used to support two special logs (300) and a basic log (100) thereon at any position. This allows for the building of wall structure through the roof such as to build an interconnected tower, a specialized dormer window structure, a chimney, or a smokestack, in such a construction, additional sets of rafters (1000) may be used to make sure that all roof slats (900) are correctly supported on, at least, both their ends.

While not indicated in FIG. 13, the rafters (100) of FIG. 11 do produce an open sided roof. In some embodiments, this can be useful to allow access to the attic floor or interior of the structure for play. In an alternative embodiment, the rafters (1000) may be modified to be in the shape of right triangles to fill in the gap (1401) or a fill piece may be provided which may interact with the rafters (1000) to till the gap (1401). Alternatively a basic log (100) may be positioned on the uppermost surfaces of each of the upper most basic logs (100) of the structure (those which the band boards (1100) or (1110) are transverse to and internotched with) with special logs (300). Basic logs (100) of different lengths can then be used to till the hole (1401) including making structures such as gable windows. If dormer rafters (3000) are used instead of rafters (1000) and the dormer rafters (3000) are slotted on both sides (e.g. top and bottom), dormer logs (3300) and/or dormer starters (3200) can also be used to fill the hole (1401).

Figure 23A:
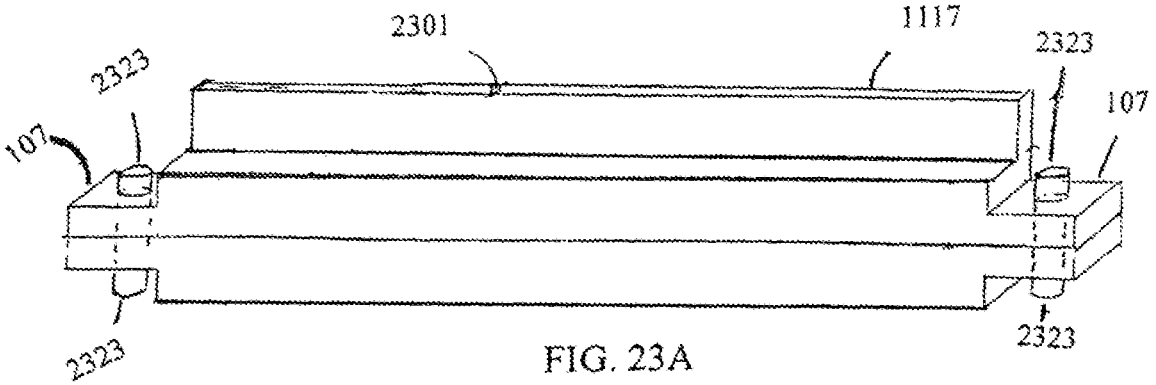
FIGS. 23A, 23B, and 23C show embodiments of rafter supports or band board logs which utilize a closed corner.
Figure 23B:
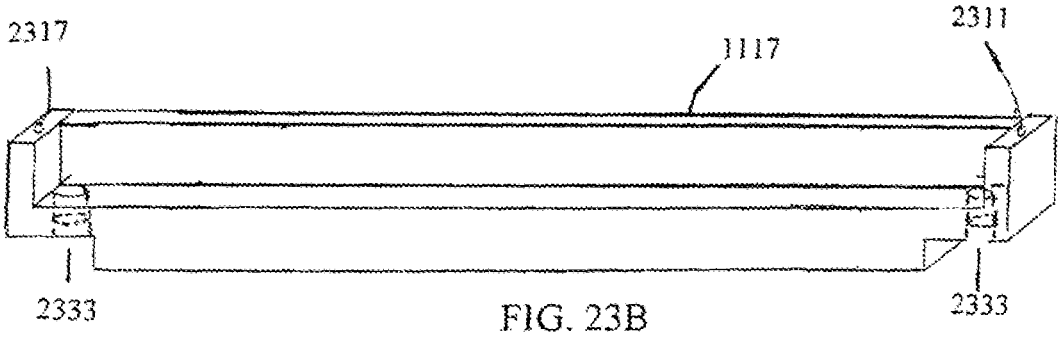
Figure 23C:
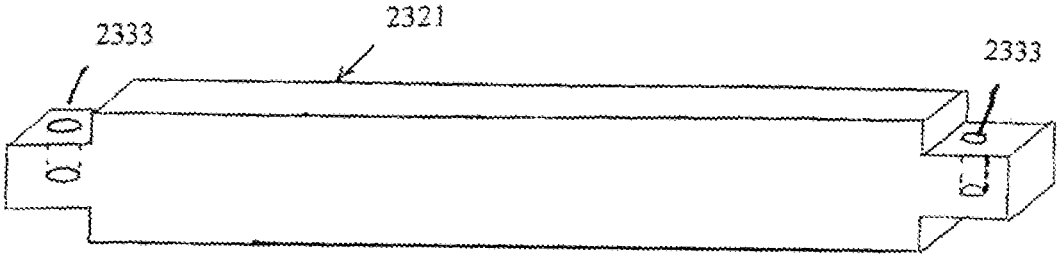
Figure 24:
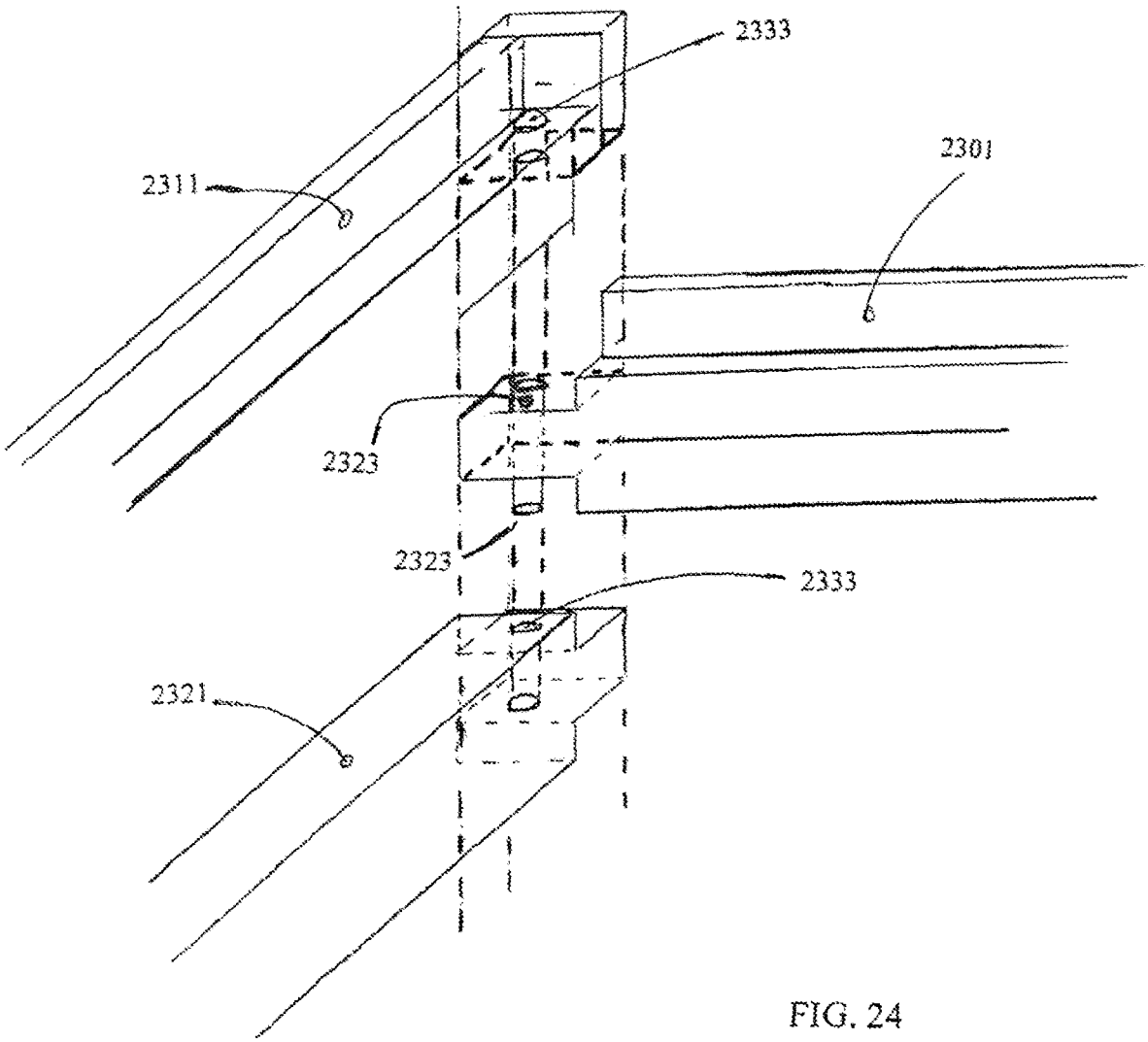
FIG. 24 shows an embodiment of how to form a closed corner with a closed rail from the band hoard logs shown in FIGS. 23A-23C.

FIGS. 23A, 23B, and 23C show rafter support and band board (2301), (2311), and (2321) pieces which utilize a closed corner. As opposed to the band board (1100) and (1110) of FIGS. 11 and 12, which are designed to have the rails (1117) simply run along two opposing parallel sides of the structure and form a two sided roof as contemplated in FIG. 13, the band boards (2301), (2311), and (2321) provide a corner where the rail (1117) extends around the corner so as to be on all four sides of the structure. The embodiments of FIGS. 23A-23C, are connected as shown in FIG. 24. As can be seen in FIG. 24, the band board (2301), (2311), and (2321) are connected by having a pin (2323) and hole (2333) arrangement where the pin (2323) extends either upward or downward from within the trough (107) and connects with an opposing hole (2333) in a trough (107) in a mating piece. In the band boards (2301), (2311) and (2321), there are no ends (105) or (103) extending beyond the trough (107), thus the log does not extend beyond the corner. While in alternative embodiments, ends (105) and (103) may be provided to give the resultant structure a different look, it is generally preferred that they are not present as it provides a closed corner where components can freely be positioned at and around the corner portion 2317) or the rail (1117). The use of a closed corner as contemplated with these components allows for the extending ends (105) and (103) to be eliminated and for the formation of a generally flat corner. This can allow for other components to be positioned adjacent the two adjacent wall surfaces to make building outward from the wall surface easier. The use of a closed corner is, thus, contemplated below for use with porches, L-shaped and similarly angled buildings, and for certain kinds of hip roofs.

As can be best seen in FIG. 24, the band board (2321) will generally be placed on top of the structure connecting to basic logs (100) or any other type of log in the standard fashion. Band board (2301) will then generally be connected to the band board (2321) at the interfacing notches (107) placing the downward facing pin (2323) of band board (2301) into the hole (2333) in band board (2321). This connection is generally at a 90-degree angle, Band board (2311) is then generally connected above the other two components with the hole (2333) in the band hoard (2311) going over the upward facing pin (2323) of the band board (2301). The band board (2311) is generally parallel to the band board (2321) and thus perpendicular to the band hoard (2301). As should be apparent from FIGS. 23A, 23B, 23C, and 24, this creates a rail from rail components (1117) and (2317) that generally goes all the way around the corner and there are no extending ends (103) and (105) forming a closed corner.

The closed corner is valuable if the structure of the roof is desired to extend over the corner. This can be true if the roof is designed to extend between two structures, on an L-shaped structure, or if a hip roof is being used where the roof will extend around the corner in a smooth fashion. In order to create the closed corner, the components utilize a pin and hole construction as the slots are open on one side and while a pin (2323) and hole (2333) structure is not strictly necessary, it can provide improved strength. The pin (2323) and hole (2333) structure of the band boards (2301), (2311), and (2321) are echoed in the pin logs (3600) and hole logs (3800) contemplated in FIG. 36. These structure are all designed to construct a closed corner with no extending ends, while still maintaining structural strength by providing an additional form of interconnection instead of just friction from interacting troughs (107). It should be recognized that a log with a hole structure and no end can also be freely positioned into any pair of adjacent troughs (107) to allow for a horizontal extension from any surface. The hole is simple covered by the adjacent troughs (107) of the assembled structural surface.

Figure 25:
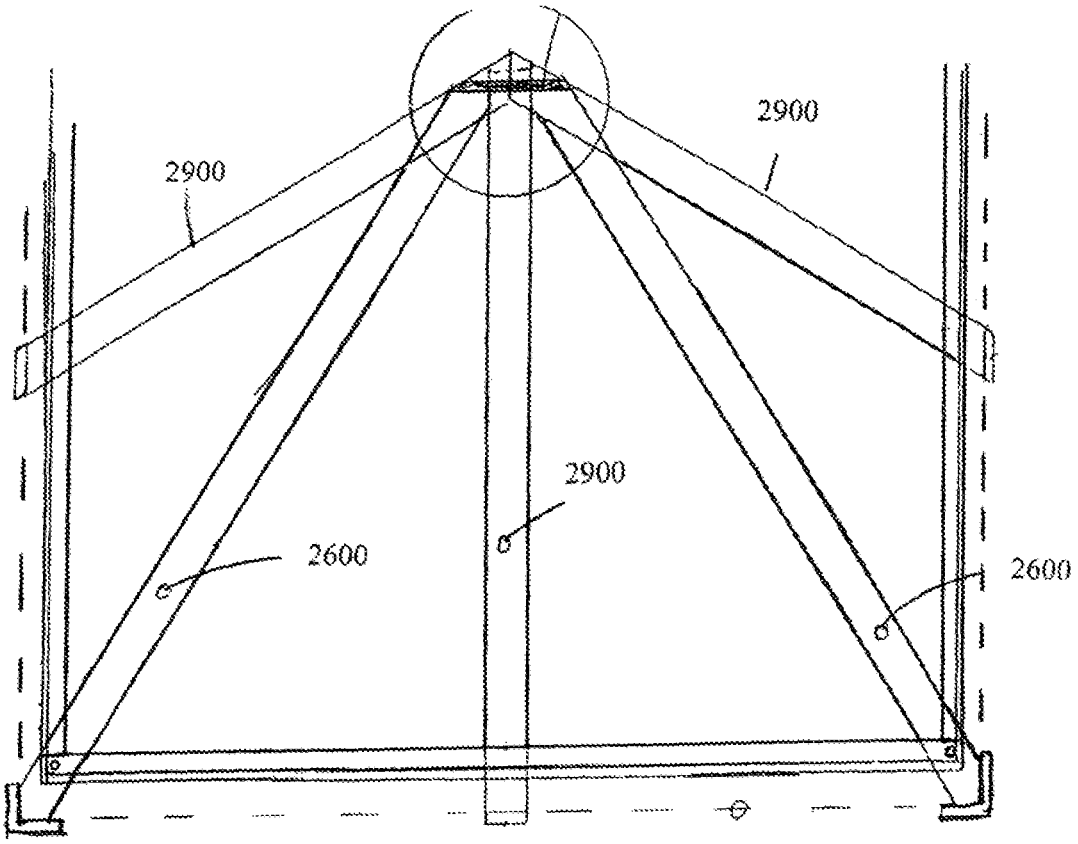
FIG. 25 shows a general overview of an embodiment of a hip roof structure.

FIG. 25 shows how a hip roof can be formed utilizing the closed corner of FIG. 24 to support the hip roof. The hip roof allows for a smooth corner and bending of a roof around the top of the structure. The hip roof structure utilizes hip rafters (2600) and interlocking rafters (2900). In forming the hip roof, the main roof will generally be formed as contemplated in FIG. 13 and will utilize the standard roof milers (1000) in the middle of the band boards (not shown in FIG. 25). The last pair of rafters as shown in FIG. 25 will generally be interlocking rafters (2900). Alternatively, all the rafters used in the roof may be interlocking rafters (2900) and standard rafters (1000) need not be used. Note that the hip rafters (2600) used in a hip roof may be of slightly different dimensions to each other (e.g. the central rafter may be shorter) to provide for certain aesthetics in the hip roof, but this is not strictly required.

Figure 26:
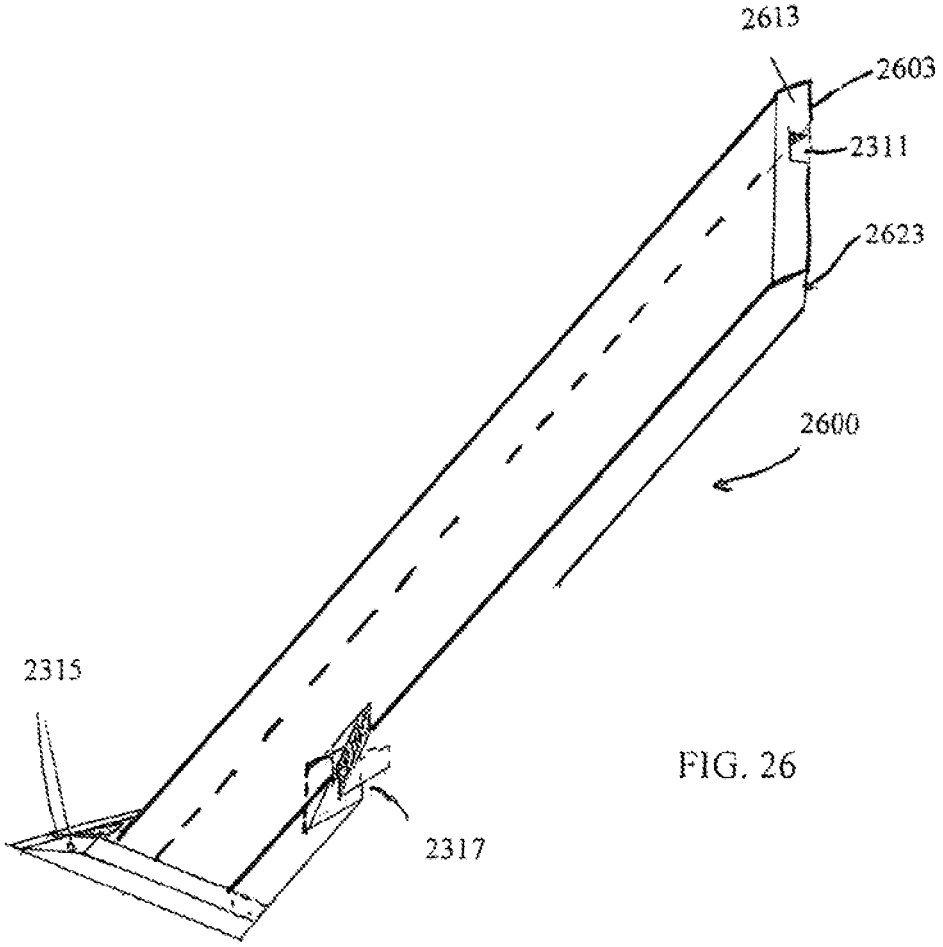
FIG. 26 shows an embodiment of a hip rafter log.

FIG. 26 shows a hip rafter piece (2600) which is designed to provide for the corner of a hip roof. The hip rafter piece (2600) includes a slot (2311) which is designed to allow for connection with a connector (2921) within the interlocking rafters (2900) as shown in FIG. 29. The hip rafter (2600) is generally of similar design to the standard rafter (1000). However, the hip rafter (2600) is designed to connect to a rail corner and at an angle to other rafters as shown in FIG. 25. Thus, the first end (2603) is cut with two angled faces (2613) and (2623) so that it can sit at an angle with the sides of other rafters (1000) in either position as shown in FIG. 25. Similarly, the extension (2315) also provides two angled faces to provide for a corner of roof slats (900) to be positioned. The cutout (2317) is also provided with an internal angle to allow it to position on the corner of the rail (1117) and (2317).

Figure 27:
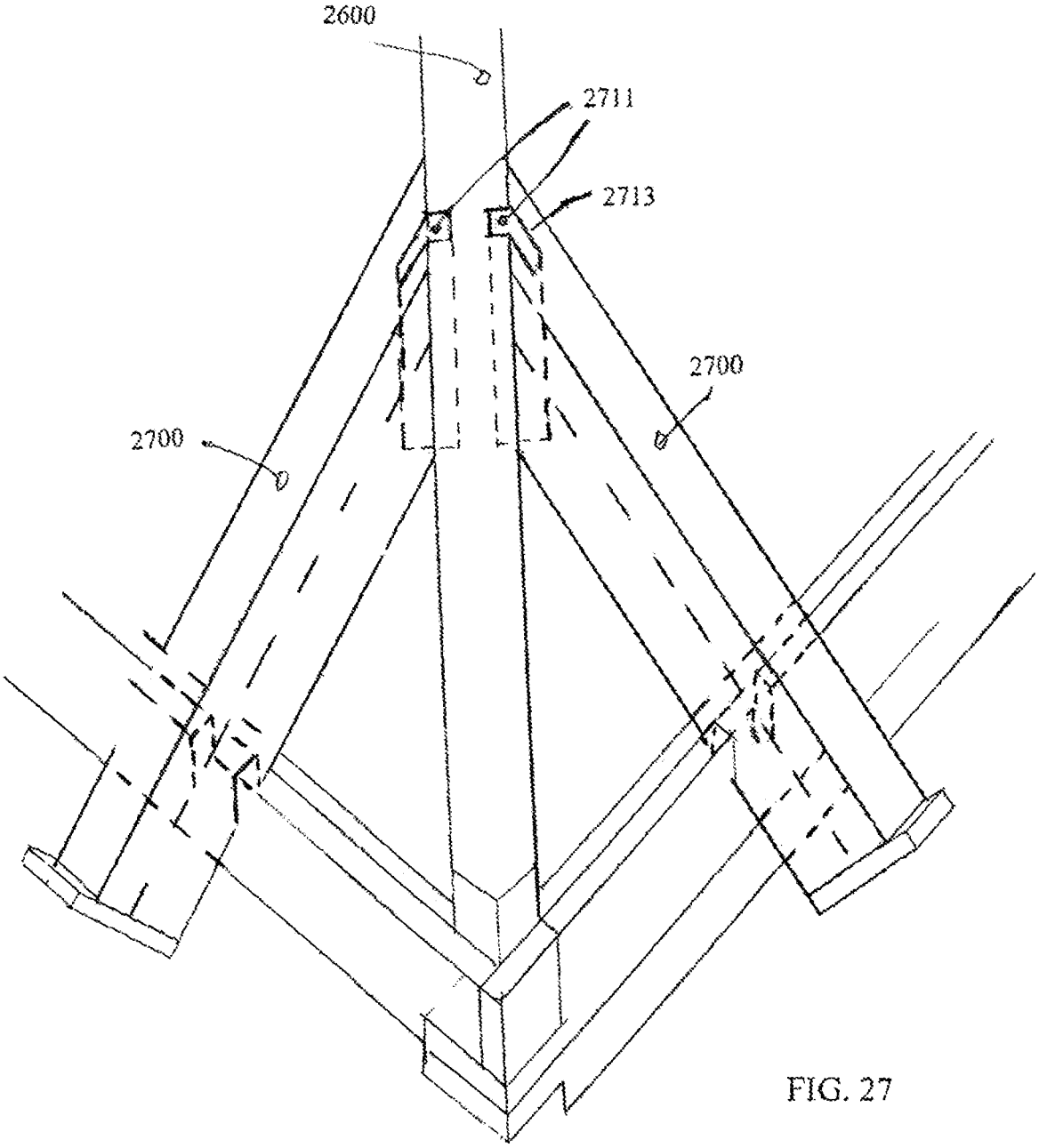
FIG. 27 shows an embodiment of a hip rafter log with splines.

It should be noted that in an alternative embodiment of the hip rafter (2600), extension (2315) is actually partially or totally removed (having either one of the two faces of FIG. 26 or neither instead of both) to allow for the roof to extend over the hip rafter (2600). This, for example, will allow for a roof to be created for a structure with an "L" shape where the hip roof forms a corner of the building (the outer corner of the L) on one side, but needs to extend beyond the corner (and over the leg of the L) on the other. This structure of hip rafter (2600) is shown in FIG. 27. The hip rafter (2600) in FIG. 27 has no extensions (2315).

To provide for improved strength of a hip rafter (2600), the hip rafter (2600) may be provided with supporting splines (2700). This is shown in FIG. 27 which provides the hip rafter (2600) with two splines (2700). The splines (2700) are effectively small rafters that connects to the sides of the hip rafter (2600) at a midpoint along its body. The connection will commonly use some form of tongue (2701) in groove (2711) connection to best distribute the force of the rafters (2600) and (2700) against each other. Splines (2700) can be particularly desirable if a roof is to extend beyond the structure the hip rafter (2600) is part of as they can provide for additional support for the slats (900).

Figure 29A:
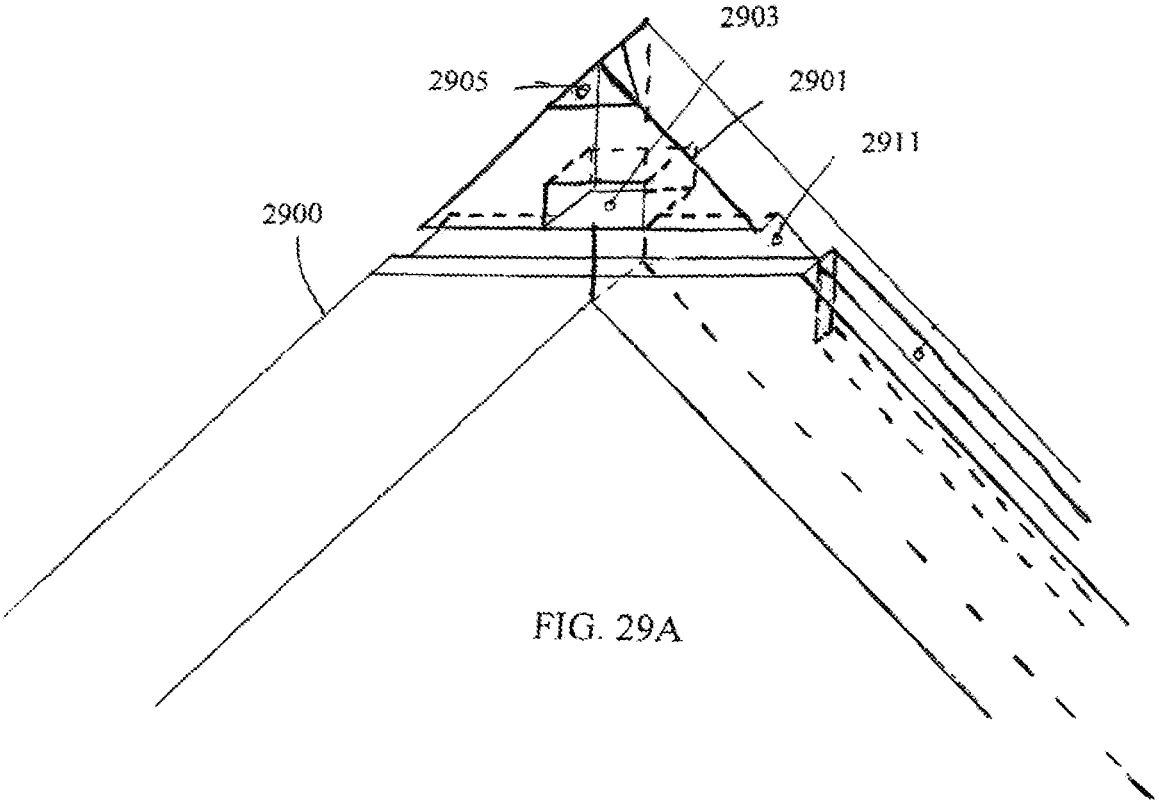
FIG. 29A shows an embodiment of a hip gable formed from two interlocking rafters and FIG. 29B shows a board for allowing the interlocking rafters to connect to hip rafters to form a hip roof.

FIG. 29A shows an interlocking rafter (2900) which can be used to replace the basic rafter (1000) when a hip roof is desired, or even more generally. The interlocking ratter (2900) provides for additional functionality as it provides for an end slot (2901) which together with an opposing rafter (2900) will provide an opening (2903) through the rafter structure. This opening is preferably sized and shaped so as to allow for a board to be positioned therein. While this board may be a specialty component the opening (2903) is actually preferably sized and shaped to that a half log (200) or even a specialty log (300) may be positioned in the opening. Generally, with the opening (2903) interacting with the troughs (107) of the half log (200) or special log (300), but this is not required. The half log (200) or special log (300) in this use, will provide for substantially increased strength to the roof and eliminate the need for a specialty piece.

Figure 29B:
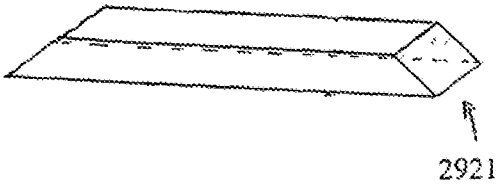

The interlocking rafter (2900) also includes a second slot (2911). The second slot is designed to house a hip beam (2921) as shown in FIG. 29B to provide still additional strength to the rafter structure and which can be used to connect to the slot (2311) in a hip rafter (2600) to support the hip rafters (2600) and the interlocking rafter (2900) between the hip rafters (2600) to the other interlocking rafters (2900). The rafter (2900) may also include a pitch cut (2905) to allow for better integration of the top of the rafters with each other in a hip roof. While the second slot (2911) in FIG. 29A is shown below the end slot (2901) it would be recognized that they can be positioned in alternative vertical arrangement or can overlap.

Figure 39:
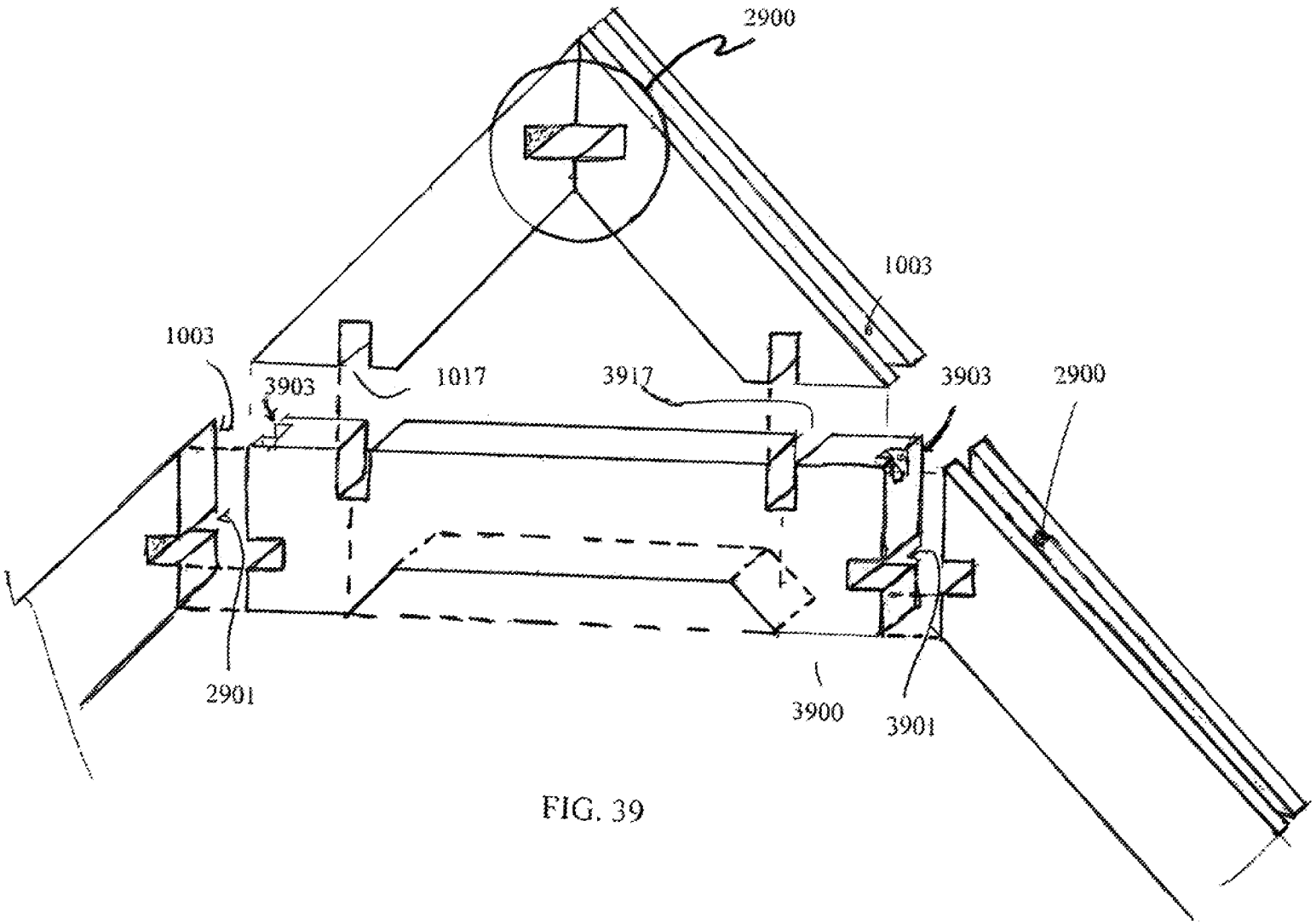
FIG. 39 shows an embodiment of a variable size roof truss log.

Use of the interlocking rafter (2900) as shown in FIG. 29A in conjunction with a truss (3900) allows for the roof to be extended to allow the roof to cover a longer distance. It should be apparent that the rafters (1000) and (2900) can only provide a roof to a structure of a certain width. As shown in FIG. 39, this width can be extended using a truss (3900). As shown in FIG. 39, the truss (3900) includes two opposing slots (3901) and (3917). The truss (3900) is placed between two rafters (2900) that are too short to reach and touch at their end faces (1003) as shown in FIG. 29A. In this case each end face (1003) is placed against a face of the truss (3903) and the slut (2901) is aligned with the slot (3901). These slots are connected together using a board or preferably a half log (200) as contemplated above. A second set of rafters (2900) is then placed on top of the truss with the slot (1017) which is designed to align with the rail (1117), now aligning with the slot (3917). A board or half log (200) is then placed in the slots (1017) and (3917) to support the second layer of rafters (2900).

As can be seen in FIG. 39, this allows for much wider buildings to be made and particularly allows for buildings that are wider than the longest basic log (100) as roofs of variable width can now be created. Further, as the truss (3900) of the FIG. 39 can be made of different lengths, and multiple trusses (3900) can be interconnected together by placing two faces (3903) adjacent and placing a board of half log in now opposing slots (3901), the size of roofs is now near limitless.

Figure 30:
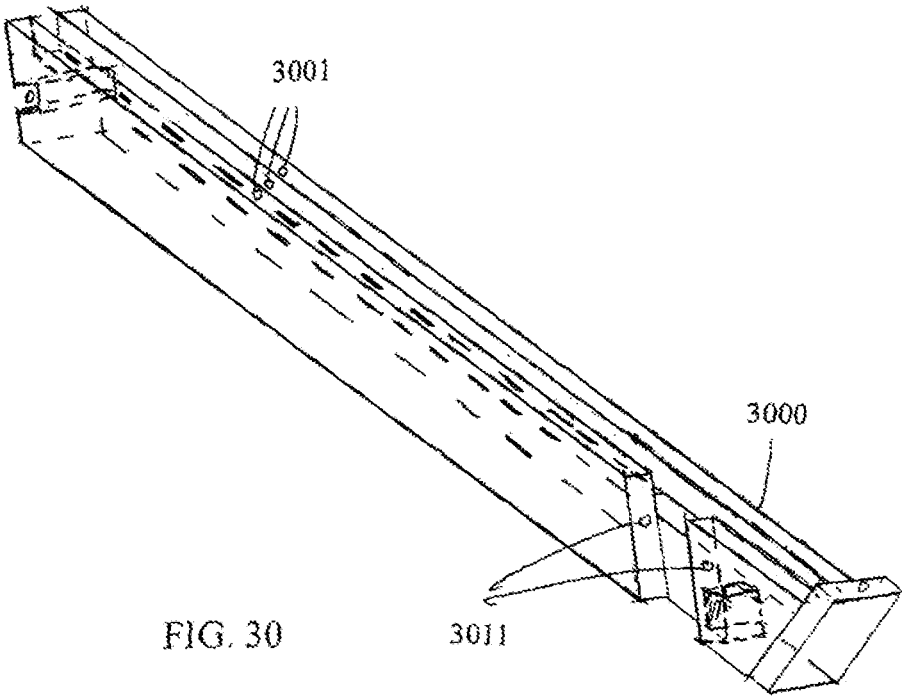
FIG. 30 shows an embodiment of a dormer rafter log with dormer groove.
Figure 31:
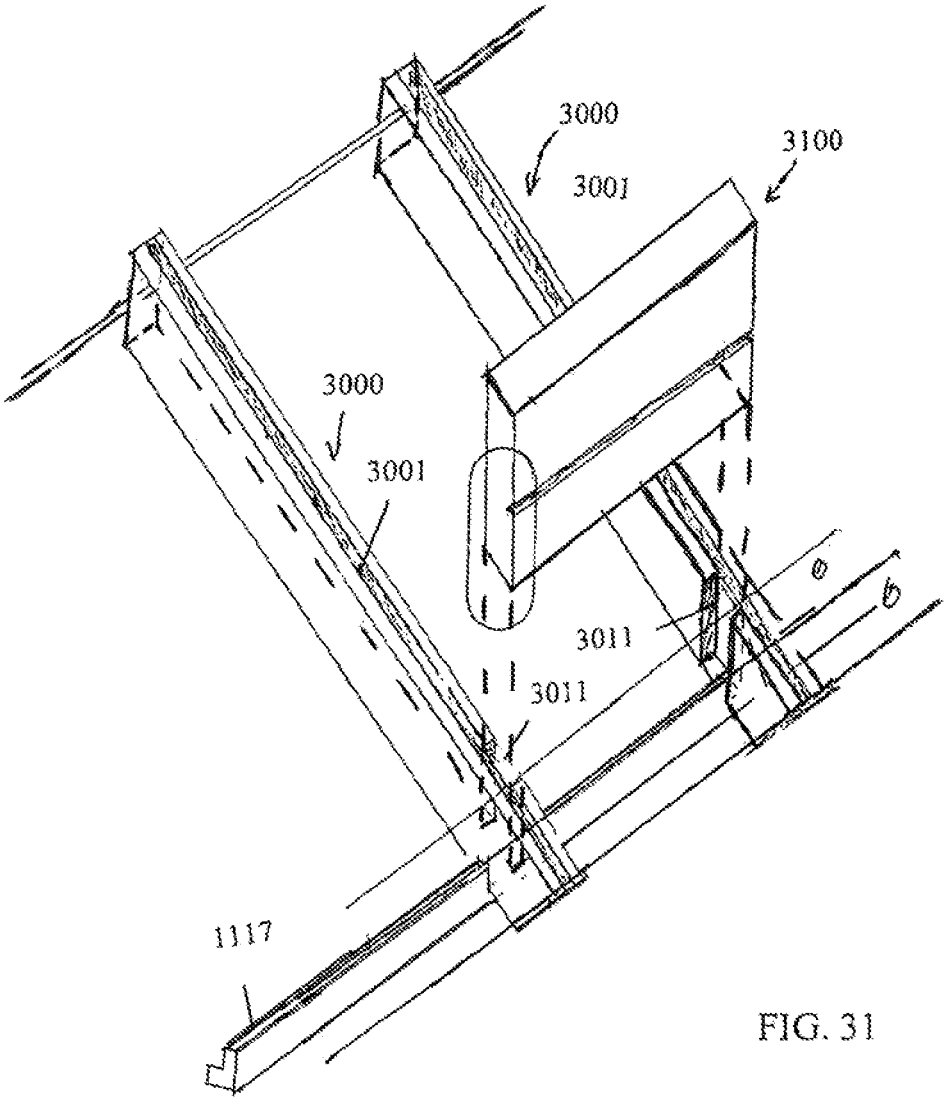
FIG. 31 shows an embodiment of two dormer rafters and a dormer faceplate being positioned to begin a dormer structure in a roof.

One thing to note from FIGS. 29A and 39 is that the rafters (2900) shown in these also include a dormer slot (3001). The dormer slot (3001) is designed for attachment of a dormer roof as discussed primarily in conjunction with FIGS. 31-34. This is not strictly required but provides for still additional functionality. A roof rafter called a dormer rafter (3000) which is effectively the rafter (1000) of FIG. 10 with a dormer slot (3001) and dormer faceplate slot (3011) placed therein is shown in FIG. 30. These two structures allow for connection of the various dormer components as discussed in conjunction with FIG. 31 through 34. However, the other roof rafters, such as rafter (2900) can include dormer slots to provide for additional functionality with fewer pieces.

Figures 28A, 28B, 28C:
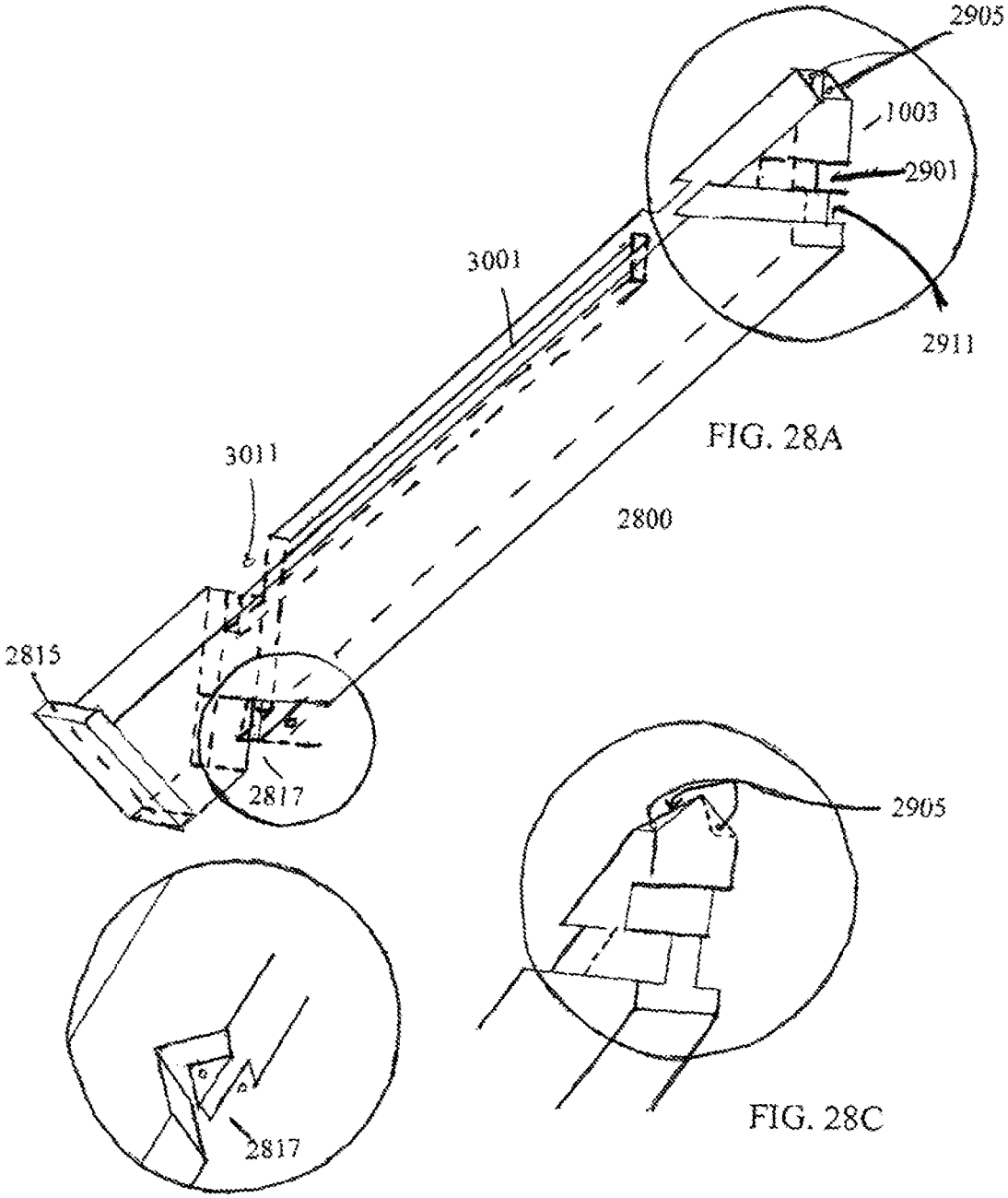
FIGS. 28A, 28B, and 28C show various images of an embodiment of a universal rafter log with components to make it a rafter, hip rafter, and dormer rafter.

The reduction in the necessary number of roof pieces is taken to an extreme in the embodiment of FIGS. 28A, 28B, and 28C. The rafter (2800) is designed to be a universal rafter and, thus, may include any or all the components of any or all the basic rafter (1000), interlocking rafter (2900), dormer rafter (3000), and or hip rafter (2600). The universal rafter (2800) in FIGS. 28A-28C includes a dormer slot (3001) as well as a dormer faceplate slot (3011). The universal rafter (2800) will commonly come in two different "sides" with the dormer faceplate slot (3011) arranged either as shown in FIG. 28A or on the opposing face forming a universal rafter which is a mirror image of FIG. 28A. It is possible for a universal rafter (2800) to include dormer faceplate slots (3011) on both sides, but this can present a point of concerning weakness due to a large amount of slots interacting right where the dormer faceplate slots (3011) are.

The universal rafter (2800) also includes pitch cuts (2905) to allow it to be used as an interlocking rafter (2900). It further includes slots (2901) and (2911) as shown in detail in FIG. 28C for connection as a gable or truss as shown in FIGS. 29 and 39. The slot (2817), as best shown in FIG. 28B, will generally also allow for connection to the rail (1117) or truss slot (3917). It should be recognized that the universal rafter (2800) as depicted in FIG. 28, is not intended to act as a hip rafter (2600) as the slot (2817) and the face (1003) are not cut at angles and the extension (2815) has a single flat face. However, in an alternative embodiment, these structures may be angled and provided as shown in FIG. 26 to provide for an alternative embodiment of the universal rafter (2800).

Figure 43:
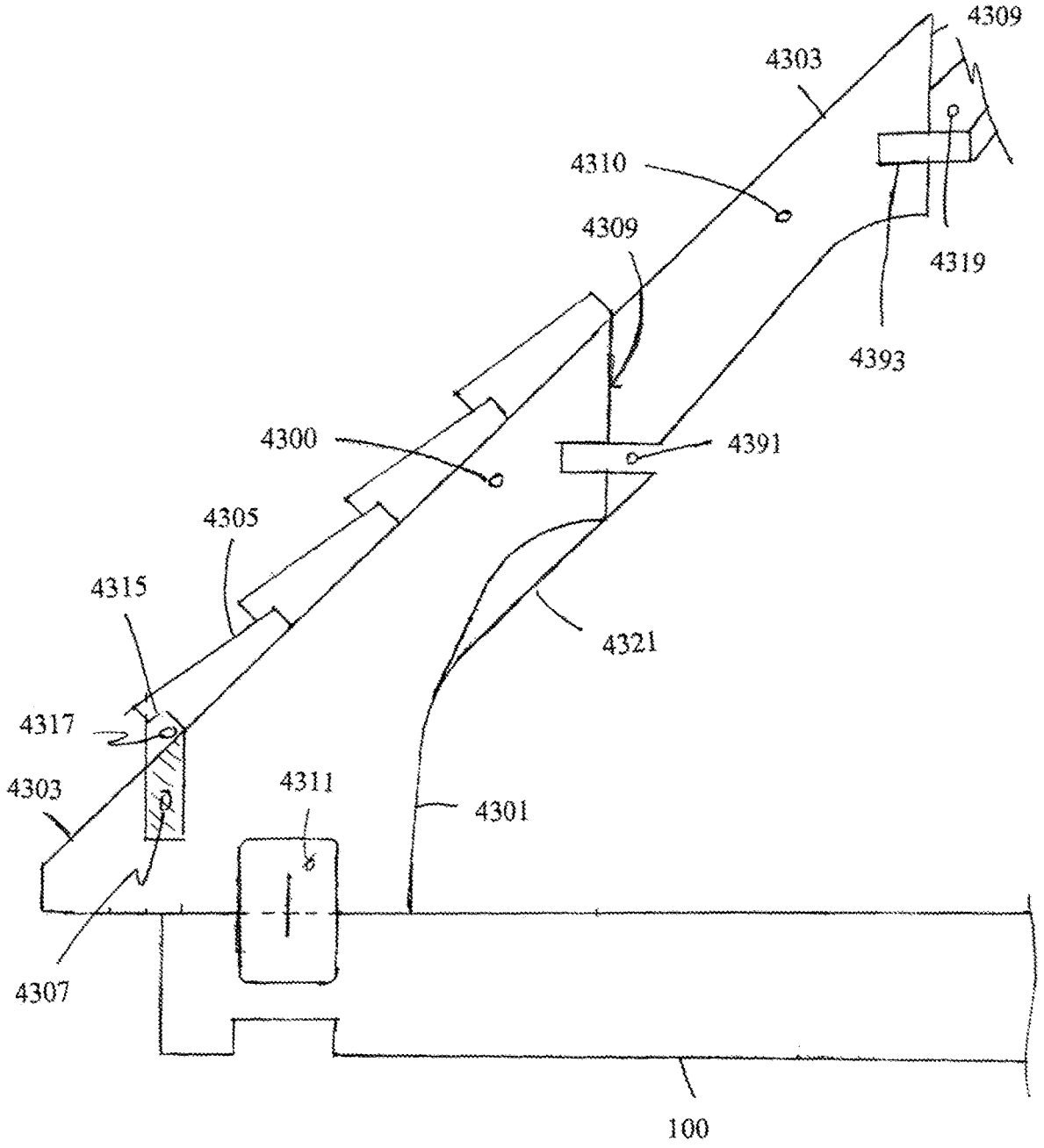
FIG. 43 shows an embodiment of two different sizes of rafter logs which utilize an alternative structure.

FIG. 43 provides for two additional designs of roof rafter (4300) and (4310). The rafters (4300) and (4310) are very similar but are of different lengths to accommodate roofs on buildings of different width. Longer or shorter rafters may also be provided that follow the same general design and principles as those of (4300) and (4310) in other embodiments. The basics of the rafter design is best illustrated by initially looking at rafter (4300). Rafter (4300) is generally in the shape of a right triangle with a half arch, semi-parabolic, quarter-ellipse, quarter-circular, or other curve (4301) cut from the legs to remove the right angled corner. The hypotenuse edge (4303) of the rafter (4300) is flat and will be used to support the roof slats (4305). To assist in the support of slats (4305), the rafter (4300) includes a fascia board notch (4307) which, in a preferred embodiment, is of similar width to the height of the connector portion (117) of a half log (300) so that the connector portion (117) could slide into the notch (4307). To put this another way, it can have a width generally equal to one-quarter the height of a basic log (100).

While a special log (300) can be used in the fascia board notch (4307), it is preferred that a fascia board (4317) be supplied. This will generally be primarily parallelepiped with a cross section as shown in FIG. 43 and an extended length which will run perpendicular to the page of FIG. 43 seal can be based on expected sizes of walls of buildings (similar to basic log (100) lengths). The roof slat (4305) in an embodiment can be the same shape as the fascia board (4317) so that they are interchangeable. However, as shown in FIG. 43 it is preferred that the roof slat (4305) have, in cross section, a generally truncated triangular shape with a section (4315) removed. It is then elongated to lengths similar to the fascia hoard (4317) and usually related to basic log (100) lengths. This shape provides some interconnectivity of the roof slats (4305) shown in FIG. 43.

The internal face (4309) of the rafter (4300) includes a support notch (4391). This is similar to the notch (2901) in other embodiments of rafter (having a depth equal to the width of a basic log (100) and a width generally equal to one-quarter the height of a basic log (100)) and allows for the rafter (4300) to be interconnected to a facing rafter (4300) using a special log (300) (at the notches (117)), a fascia board (4317), or a connector board (4319). The connector board (4319) will be generally rectilinear or racetrack in cross section with a width equal to generally twice the width of a basic log (100), a height generally equal to one-quarter the height of a basic log (100), and a variety of different lengths. This allows the connector board (4319) to be placed in the support notches (4391) of two opposing rafters (4300) with their faces (4309) being generally adjacent.

The longer rafter (4310) also includes a similar support notch (4393) in its internal face (4309), However, it can include a second notch (4391) which is aligned in height and positioned at equal height in the curve (4311) to the notch (4391) in the rafter (4300). Inclusion of notches in multiple rafters (4300) and/or (4310) allows for them to be arranged side-to-side as well as opposing each other. Such arrangement can allow for the interconnection of rafters (4300) and/or (4310) along the same side by a connector board (4319) with its length running between the rafters (4300) and (4310). This allows for increased stability and can also provide a place to attach dormer components such as those shown in FIG. 22 or can provide for alternative roof shapes. As should be apparent, longer rafter logs than those shown in FIG. 43 can have additional notches in their curved sections corresponding to both notches (4391) and (4393) and any additional notches added in any other rafter logs. It should also be recognized that rafters (2900) or (3900) could also include such side-to-side positioned slots (4391) in addition to end slot (2901).

Each of the rafters (4300) and (4310) includes a rafter notch (4311). The rafter notch (4311) may be sized and shaped to be positioned on a notch (107) or notch of similar size (have a depth of generally one-quarter the height of a basic log (100)), or may be sized and shaped to go over the center portion (109) of another log (have a depth of generally one-half the height of a basic log (100)). In an embodiment, rafters (4300) and (4310) are included in a set with both sized rafter notches (4311) so that they can be positioned at the edge of a building, or at any point internal to a log or building wall.

Figure 44:
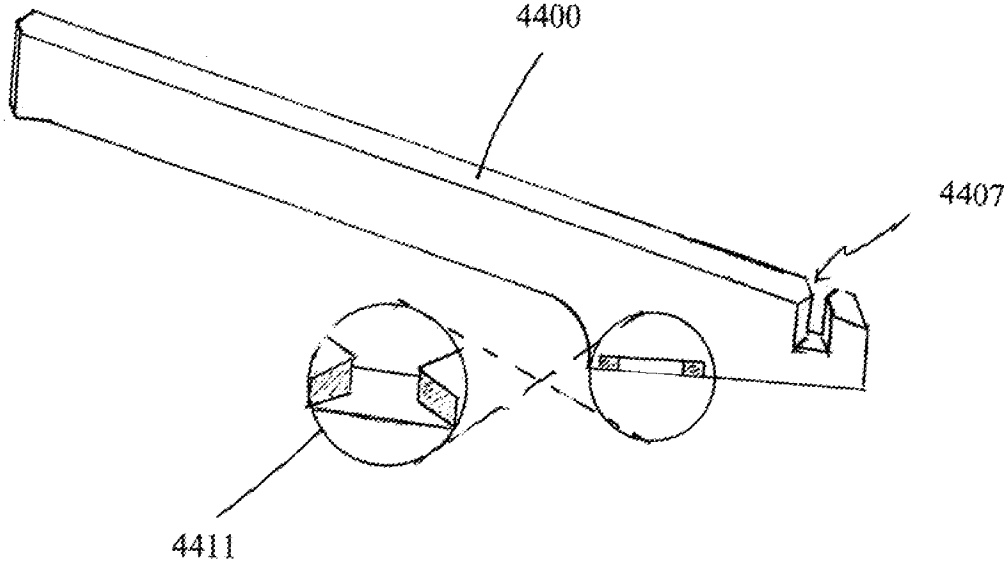
FIG. 44 shows another embodiment of a hip rafter log to be used on a corner.
Figure 45:
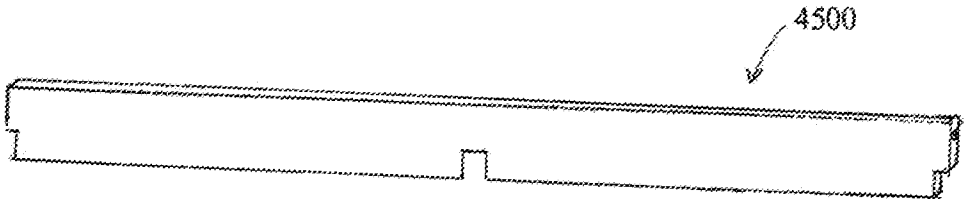
FIG. 45 shows an embodiment of a hip roof fascia board for use with the hip rafter log of FIG. 45.
Figure 50:
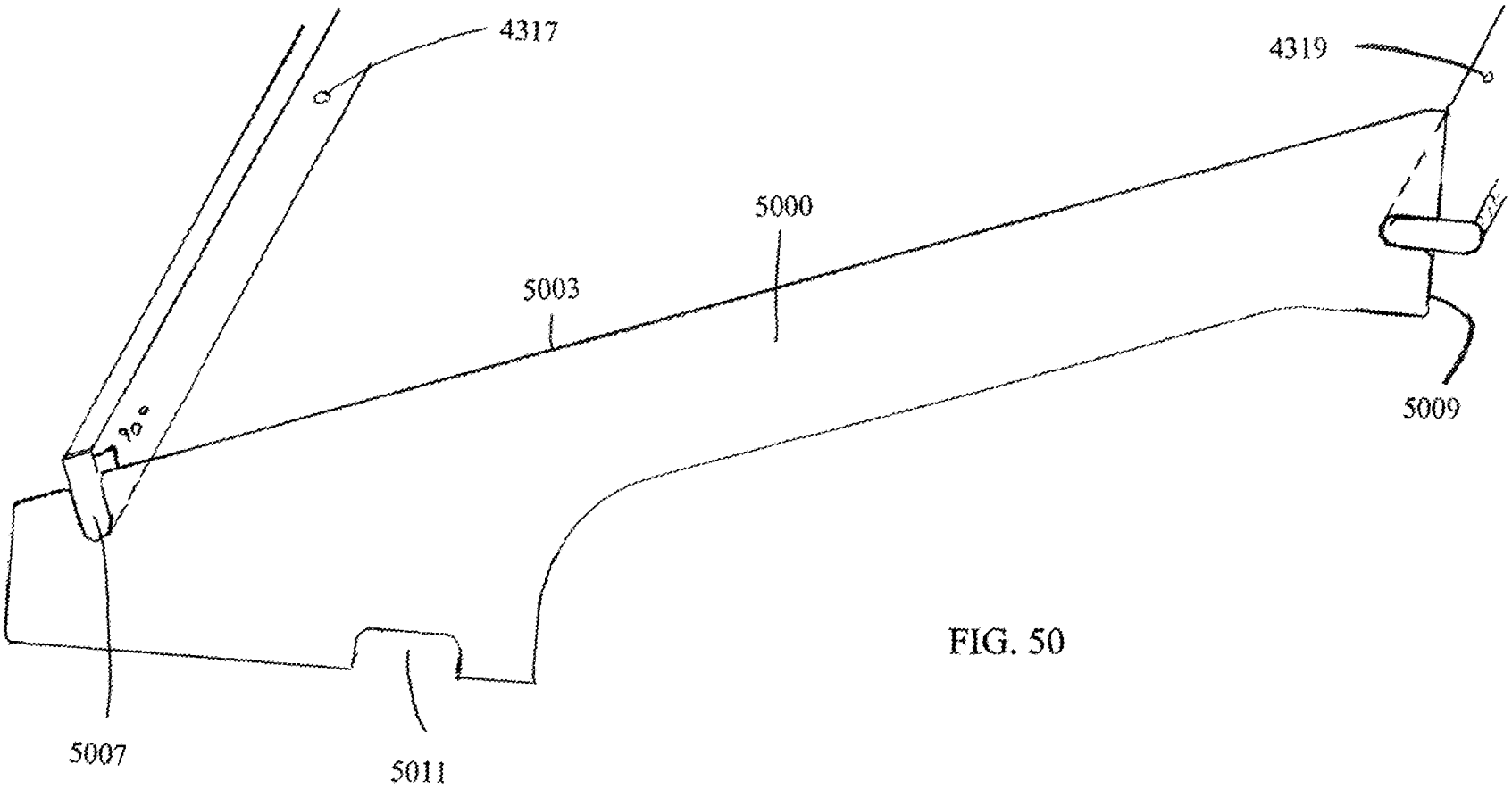
FIG. 50 shows another embodiment of a hip rafter log that is designed to use on an edge as opposed to a corner.

FIG. 44 shows a still further embodiment of a rafter log (4400). This rafter (4400) is designed to provide a hip roof or patio as an alternative to rafter (2600) as shown in FIG. 27. The rafter (4400) also includes a rafter slot (4407) for holding one end of a fascia board (4500) such as that shown in FIG. 45. The rafter notch (4411) is also designed to connect over a corner of a structure as contemplated in the discussion of rafter (2600) in FIGS. 25 and 26. The rafter log (4400) is of generally similar shape to the rafter (4300), but may be at a different slope to provide a different appearance. FIG. 50 shows a similar rafter log (5000) to rafter log (4400) which also shares the lower pitch of rafter log (4400). It may be used to provide support for a patio or as part of a lower pitched hip roof. It will generally include a fascia board notch (5007) for interfacing with a fascia hoard (4317). It will also include a rafter notch (5011) which may be sized and shaped to be positioned on a notch (107) or notch of similar size (have a depth of generally one-quarter the height of a basic log (100)), or may be sized and shaped to go over the center portion (109) of another log (have a depth of generally one-half the height of a basic log (100)) as is the case with the other rafter logs.

Figure 46:
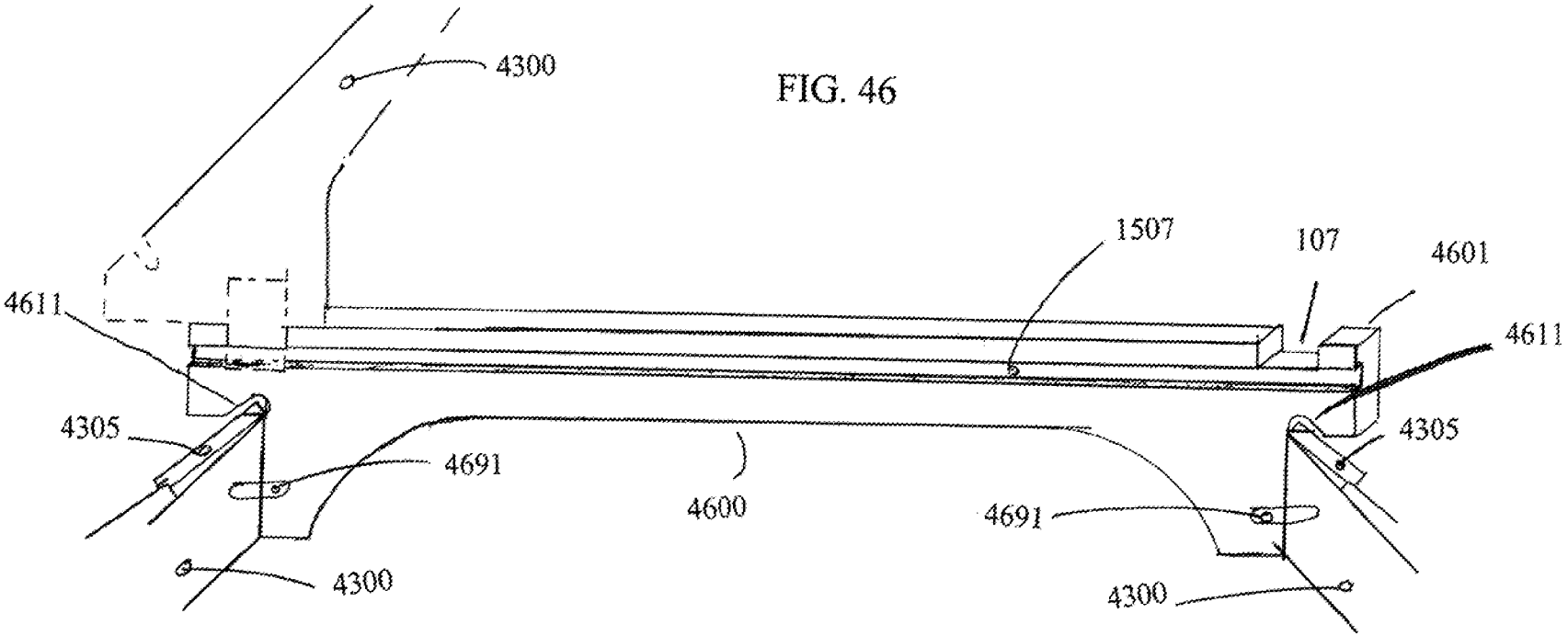
FIG. 46 shows an embodiment of a floor gable log.

FIG. 46 shows an embodiment of a floor gable log (4600) which is similar to the roof truss log (3900) of FIG. 39. However, while the roof truss log (3900) provides an upper surface with two slots (3917) to allow for additional roof rafters (2900) to be positioned thereon, the floor gable log (4600) includes a top log portion (4601) on top of the connector portion (4603) so that they are formed as one piece. The connector portion (4603) includes the slots (4691) for interconnection via a connector hoard (4319) (or related component as contemplated elsewhere) to rafter (4300) or (4310).

The top log portion (4601) has generally similar elements to the floor support log (1500) discussed below in conjunction with FIG. 14 and may include a floor channel (1507). To provide for aesthetically improved connection with the rafter (4300) and the slats (4305), the floor gable log (4600) may include a cutout (4611) allowing the top log portion (4601) to go over and cover the end of the rafter (4300) and any associated slat (4305). The top log portion (4601) will generally allow interconnection to any log in the standard fashion such as, but not limited to, the rafter (4300) shown. This allows for additional walls and structure to be built up on the floor gable log (4600).

While the above has discussed a variety of roof structures and one of ordinary skill in the art would understand that the various rafters and rafter structures provided can be used to build a large variety of roofs, another unique "roof" structure which can be built using the building toy as described herein is a dormer. A dormer is a common architectural structure where a window is positioned within an attic or upper room and therefor extends beyond the traditional roof and has a root itself generally perpendicular to the roof from which it extends. As discussed previously, a dormer rafter (3000), such as that shown in FIG. 30, will generally include two slots, a dormer slot (3001) which is used to connect a dormer starter (3200) and dormer logs (3300), and the dormer faceplate slot (3011) which is used to connect to the dormer faceplate (3100).

The dormer faceplate (3100) is designed to resemble a small stack of logs and serves as the starting point of the dormer structure on the front. The initial sides of the dormer are provided by a dormer wall starter (3200) as shown in FIGS. 32A through 32D. The concept between the two starter components (3200) and (3100) is that these when interacting with the rafter (3000) will provide a structure the top of which is generally parallelepiped and a substantially horizontal plane. From that structure, basic logs (100) can be used in connection with dormer wall logs (3300) to expand the dormer structure upward. This can be used to form a traditional roofed dormer, but can also be used to form structures such as integrated towers.

Figure 32A:
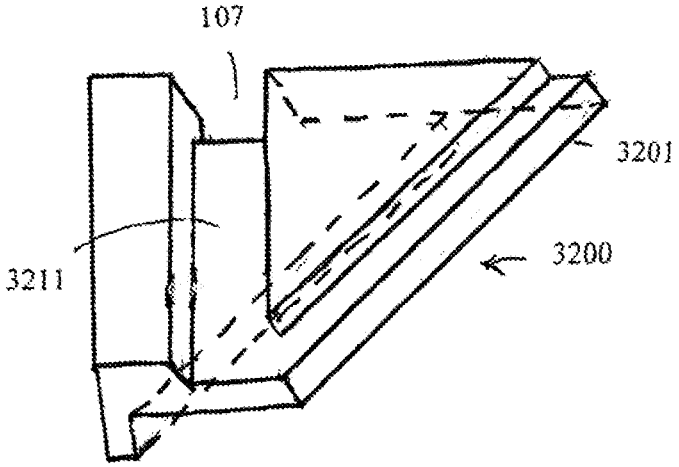
FIGS. 32A, 32B, 32C, and 32D show various views of an embodiment of a dormer wall starter piece.
Figure 32B:
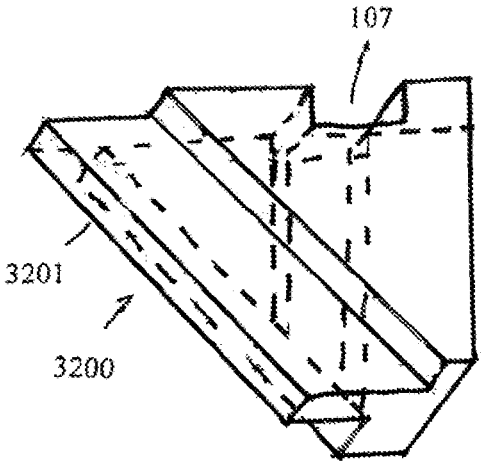
Figure 32C:
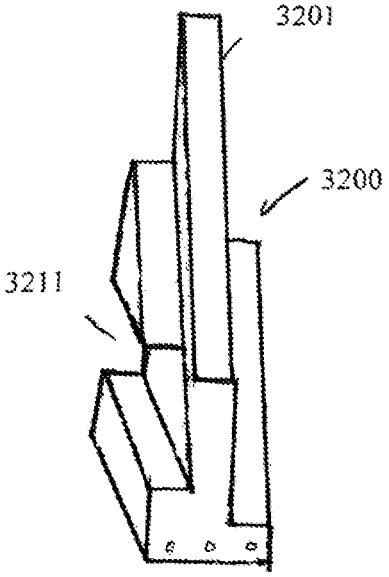
Figure 32D:
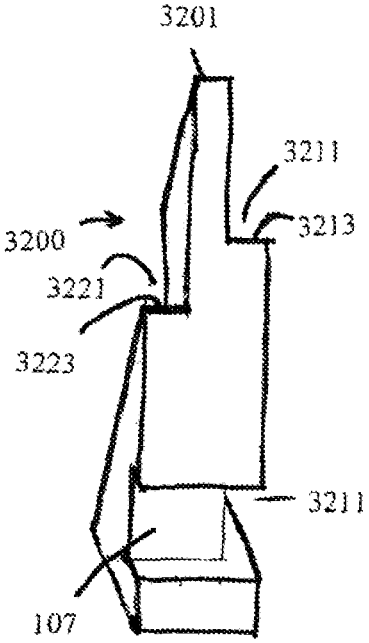

The dormer wall starter (3200) is primarily shown in the various views of FIGS. 32A-32D generally is in the form of a right triangle and includes a tongue (3201). The tongue (3201) will interface with the dormer groove (3001) to hold the dormer wall starter (3200) in place in position generally co-planar with the dormer rafter (3000). The dormer wall starter (3200) also includes a slot (3211) which will be aligned with slot (3011) to interlace with the dormer faceplate (3100). As can be best seen in FIGS. 32B and 32D, the tongue (3201) is not of even depth on both sides in all embodiments. The dormer starter (3200) will, in some embodiments, have a shallow side (3211) and a deep side (3221). The shallow side (3211) will generally be positioned internal to the dormer (behind the dormer faceplate (3100)) and thus will be on the same side of the dormer starter (3200) as the slot (3211). The shallow side (3211) will generally be sized and shaped so that when the tongue (3201) is placed in the dormer slot (3001), the shallow side (3211) contacts the rafter (300) both with the tongue (3201) in the slot (3001) and the face (3213) against the structure of the rafter (3000). The tongue (3201) of FIG. 32D is somewhat elongated to show this element more clearly.

The deeper side (3221) is designed to face outward of the dormer structure (away from the faceplate (3100) and is thus on the opposing side of the slot (3211). The deeper side (3221) is designed to provide a gap between the face (3223) from the structure of the rafter (3000). This gap will generally be or sufficient size to allow for a roof slats (900) to fit into the gap when the roof slats (900) are arranged as shown in FIG. 9. This provides for a cleaner connection and integration of the dormer structure with the main roof. As should be apparent from the above discussion, while FIGS. 32A through 32D provide for an embodiment of a dormer starter (3200), this only shows the starter (3200) for one side of the dormer structure. Generally, there will be a piece of mirror image (specifically based on the images of FIGS. 32C and 32D) which will be used to start the other side of the dormer. Alternatively, the dormer starter (3200) could have symmetric slots (3211) on both sides, then no mirror image piece would be needed from that point of view, although mirrors of the slot (3011) would still be present.

Figure 33:
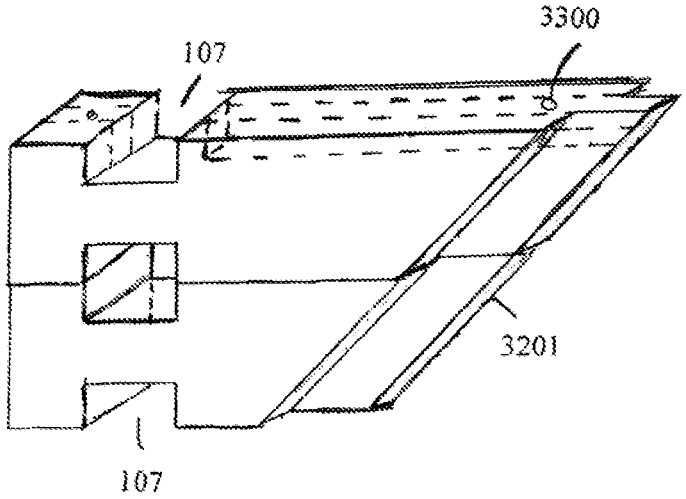
FIG. 33 shows an embodiment of two dormer wall toes on top of each other as they will be positioned in constructing the side of an embodiment of a dormer.

Placement of the dormer faceplate (3100) and the dormer starters (3200) onto the dormer rafters (3000) will generally provide for art upper surface of the dormer structure which is generally horizontally planar and will resemble the arraignment of a stack of basic logs (100). Specifically, the dormer starters (3200) each include a trough (107) and the dormer faceplate (3100) will be sized in the vertical dimension (D) in FIG. 31 so that the interaction between them is designed to have a basic log laid between the troughs (107) in the standard fashion discussed previously. To make the dormer structure taller, dormer logs (3300) as shown in FIG. 33 are used. The dormer logs (3300) will generally be of a variety of lengths corresponding to the angle of the roof dormer (3000) form the horizontal. FIG. 33 shows two dormer logs arranged above each other. As can be seen, each dormer log (3300) includes a trough (117) of the standard design and also includes a tongue (3201) of the same structure as the dormer starter (3200). These dormer logs (3300) thus are used to form the side walls of the dormer structure. Basic logs (100) and other logs may be used to construct the front face (and to include other structures such as openings for windows) in the face in the fashion of constructing any other structure.

Figure 34:
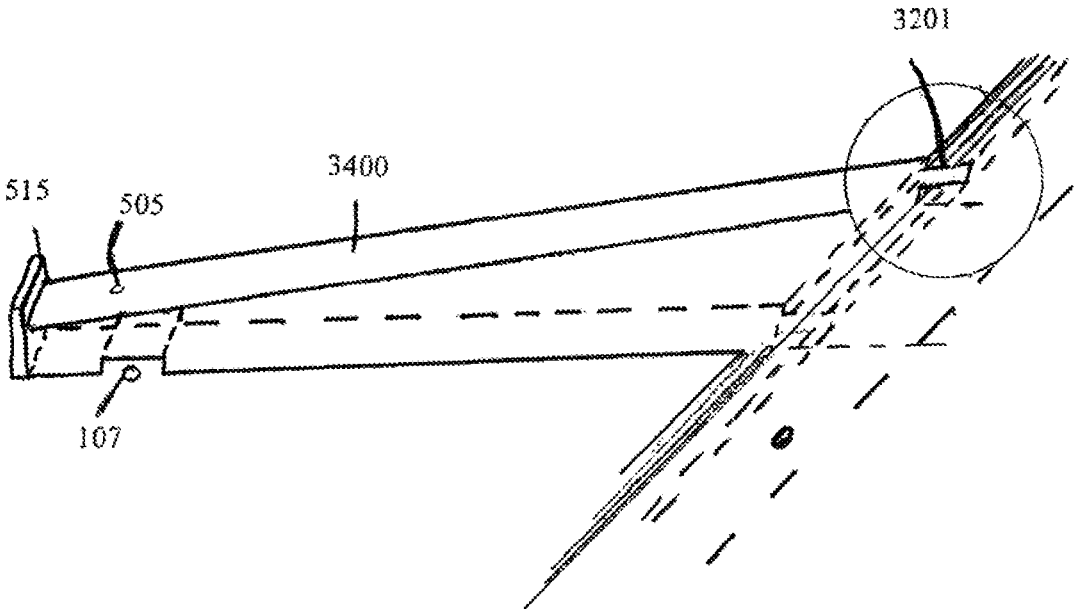
FIG. 34 shows an embodiment of a dormer roof gable log connected to the dormer groove of a dormer rafter log such as that of FIG. 30.

To provide a roof for the dormer, a standard rafter (1000) or (2900) structure of appropriate size may be used. Alternatively, a dormer roof support (3400) as shown in FIG. 34 may be provided to allow the dormer roof to slant the same general direction as the main roof but at a different angle. The dormer roof (3400) will generally be similar to about half a gable (500) as shown in FIG. 4, but will include a tongue structure (3201) as shown in FIGS. 32 and 33. The top (505) is again constructed to hold roof slats (900) and the extension (515) may be provided to keep them in place. A trough (107) on the underside allows for the dormer roof (3400) to interact with the basic logs (100) and dormer logs (3300) in the traditional fashion.

Figure 51:
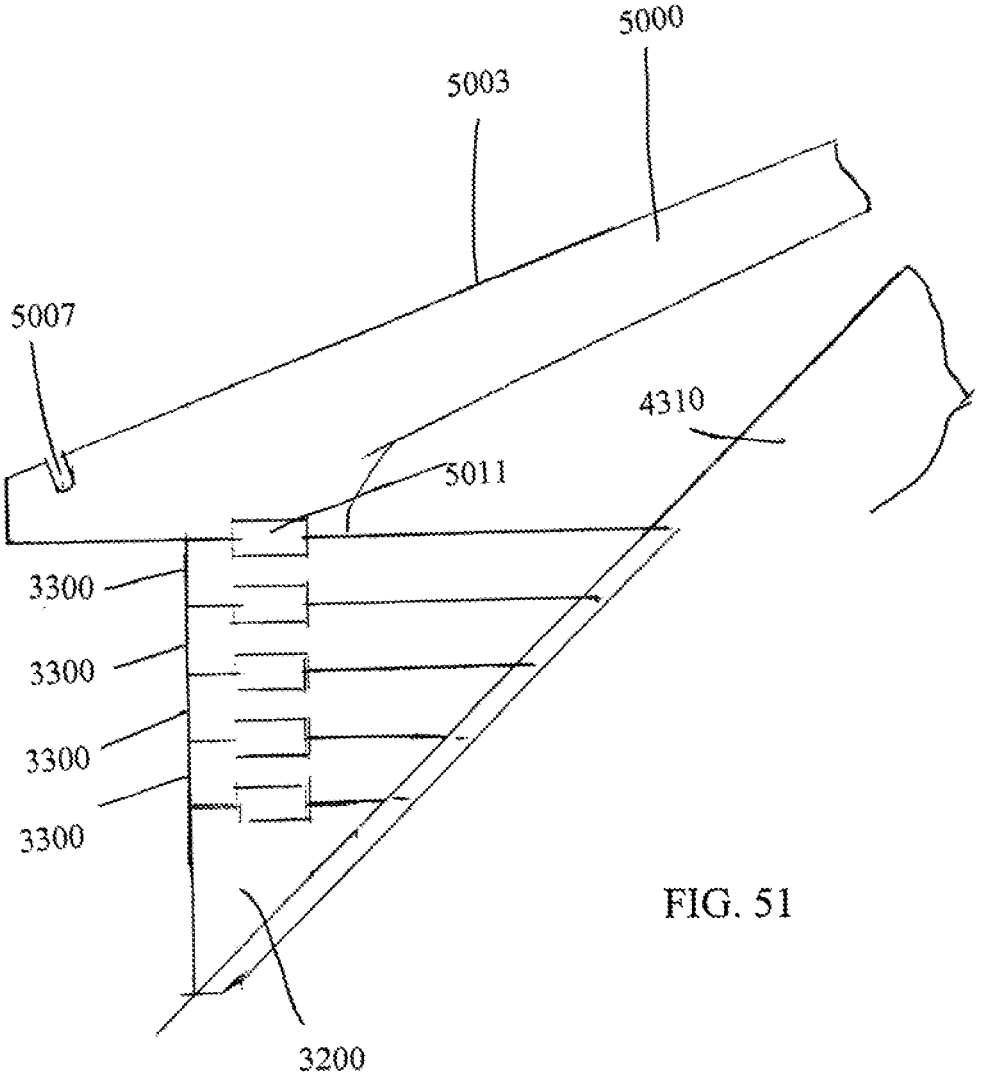
FIG. 51 shows how the hip rafter log of FIG. 50 can be used to form a roof for a dormer.
Figure 52:
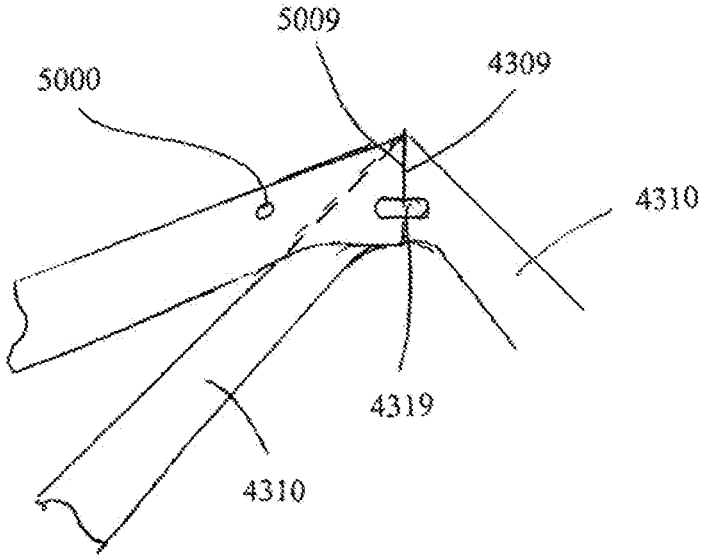
FIG. 52 shows the interconnection of the hip rafter log of FIG. 50 with two roof rafters of FIG. 43.

In a still further embodiment, the dormer may utilize the hip roof rafter (5000) of FIG. 50. This arrangement is shown in FIGS. 51 and 52. As can be seen in FIG. 51, the dormer structure is built as normal using the dormer starter (3200) and dormer logs (3300). In this case, the dormer starter (3200) is specifically sized based on the pitch of the hypotenuse side (5003) of the hip rafter (5000) so the dormer uses four dormer logs (3300). The rafter notch (5011) would also be sized in this use to connect at another notch as shown in FIG. 51. As can be seen in FIG. 52, the top of the hip rafter log (5000) is adjacent the rafter (4310) on which the dormer is built. The hip rafter log (5000) therefore connects to the same connector board (4319) as the other rafters (4310) forming the roof. Note that the faces (5009) and (4309) of the opposing rafters are not touching face-to-face, the face (5009) is closer to the viewer than the faces (4309) of the two rafters (4310) which are touching face-to-face and are generally immediately behind the rafter (5000) in FIG. 52.

It should be apparent from the above that a very large variety of roofs can be built form the pieces shown in the present FIGS. In particular, roofs can be built including standard two sided sloped triangular roofs, hip roofs, partial hip roofs such as those that exist on an L-shaped building, and dormers in roofs and dormer roofs of a variety of shapes may be constructed. Further, through the use of truss (3900), the roofs can be of virtually any size. One thine all the above roofs have in common, however, is that they are generally on top of the building structure. The roofing components of FIGS. 35-38 are designed to allow roofs to extend from the side of a structure as is the case for awnings and porches for example. In these kinds of roofs, which are called extension roofs herein, the key element is that the roof will generally abut a wall made of basic logs (100) as opposed to being on top of the structure.

Figure 35:
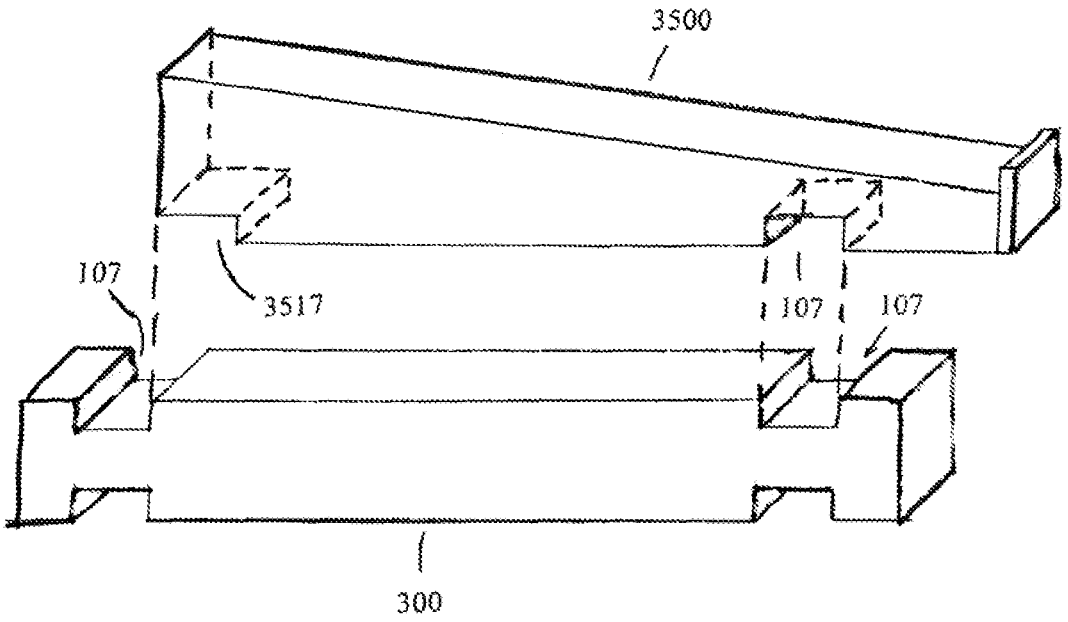
FIG. 35 shows an embodiment of an extension roof gable log in relation to a basic log such as that of FIG. 1A.

FIG. 35 shows an extension gable (3500) used in an extension roof. The extension gable (3500) is shown in size comparison against a special log (300) to indicate how, when the troughs (107) of the extension gable (3500) and special log (300) are aligned the extension gable (3500) only extends to the edge of the other trough (107) of the special log (300). Gable (3500) may include a special trough (3517) allowing it to go over an end (103) and (105) of a special log (300) but this is not required. However, the shape and size of the extension gable (3500) slows it to sit flush against a wall that the special log (300) is extending from. A special log (300) will generally be used to attach the extension to the exterior wall of the main structure.

Figure 36:
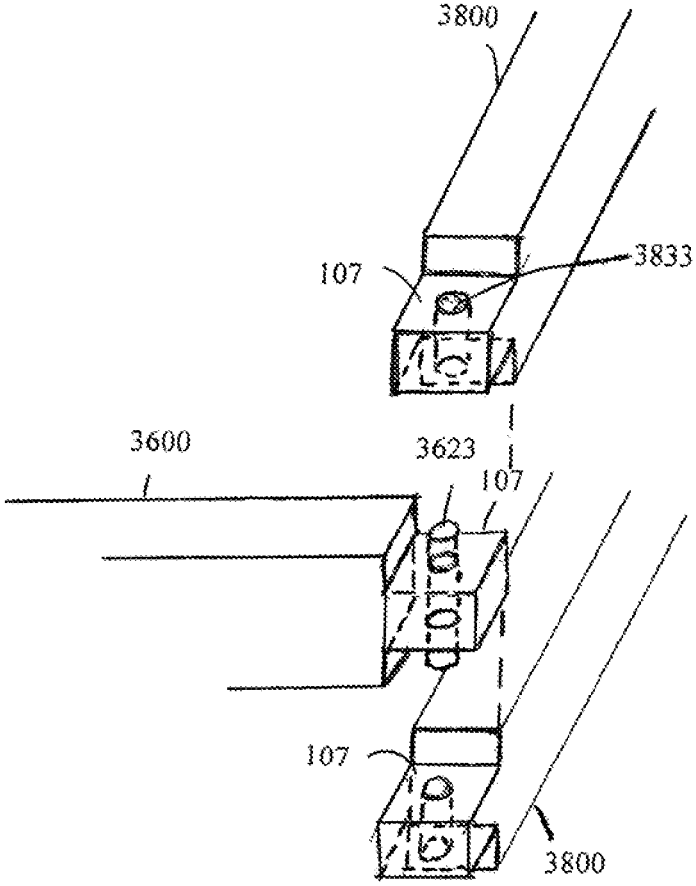
FIG. 36 shows an embodiment of forming an open corner using a pin log and hole log.
Figure 38:
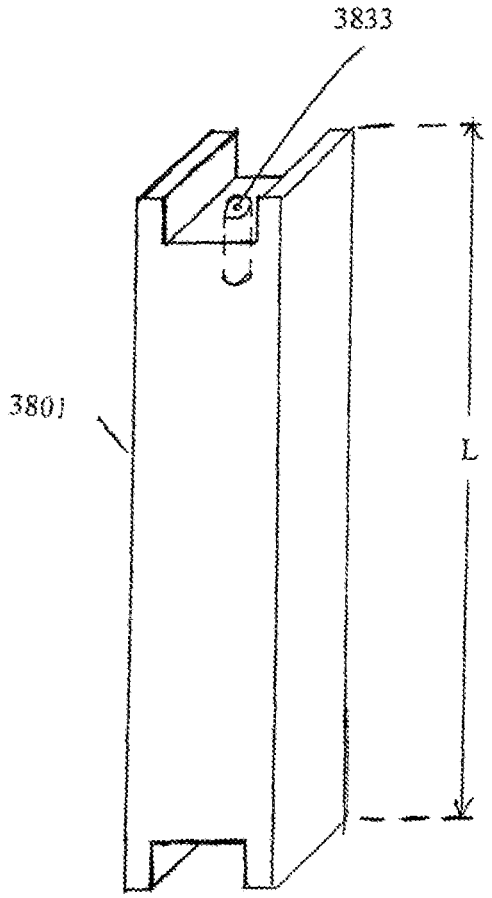
FIG. 38 shows an embodiment of a pillar for vertical support of an open corner such as that of FIG. 36.

To build an open patio, porch, or similar structure, with a roof but minimal walls, the building logs of FIGS. 36 and 38 are used. These logs come as pin logs (3600) and hole logs (3800) which include a pin (3623) and a hole (3833) respectively. The pin log (3600) and hole log (3800) are effectively basic logs (100) an for special logs (300) which have no ends (103) or (105) beyond the trough (107). They, thus, use the pin and hole structure discussed previously in conjunction with FIG. 24 to more securely attach the adjoining logs at the troughs (107). In this arrangement, the logs (3600) and (3800) are very similar to the band boards (2301), (2311) and (2121) but do not include the rail (1117). To build an extension roof, a hole log (3800) will generally be positioned to extend outward from the wall of the structure interacting the troughs (107) from two vertically arranged logs of the structure at a certain height where the roof is generally intended to be. Pin (3600) and hole (3800) logs may then be used to construct the support beams and basic pattern of the extension roof. This will often correspond to the positioning of half logs (200) which extend from the base of the structure or may correspond with various floor support logs positioned at or near the base of the structure to provide for a floor to the patio or porch.

To provide for strength, at various points along the logs (3600) and (3800) pillars (3801) or various lengths (L) may be provided. These will generally include a hole (3833) in a trough (107) which can interact with a pin (3623) so as to interconnect with the trough (107) of a pin log (3600) as necessary. The pillars (3801) will thus provide for vertical sup ort of the pin (3600) and hole (3800) logs which are usually spaced above any other surface and therefore may act as lever arms if not well supported. The combination of the pillars (3801), pin logs (3600) and hole logs (3800) will generally produce a structure with a parallelepiped structure, but minimal walls. This is akin to a porch. It should also be recognized that the pin logs (3600) and hole logs (3800) can also be used within a structure to provide for a closed corner wherever that may be desired. For this reason, FIG. 36 does not show the other ends of the pin (3600) and hole (3800) logs as the structure of FIG. 36 would be placed on any of the other logs contemplated herein.

Figure 37:
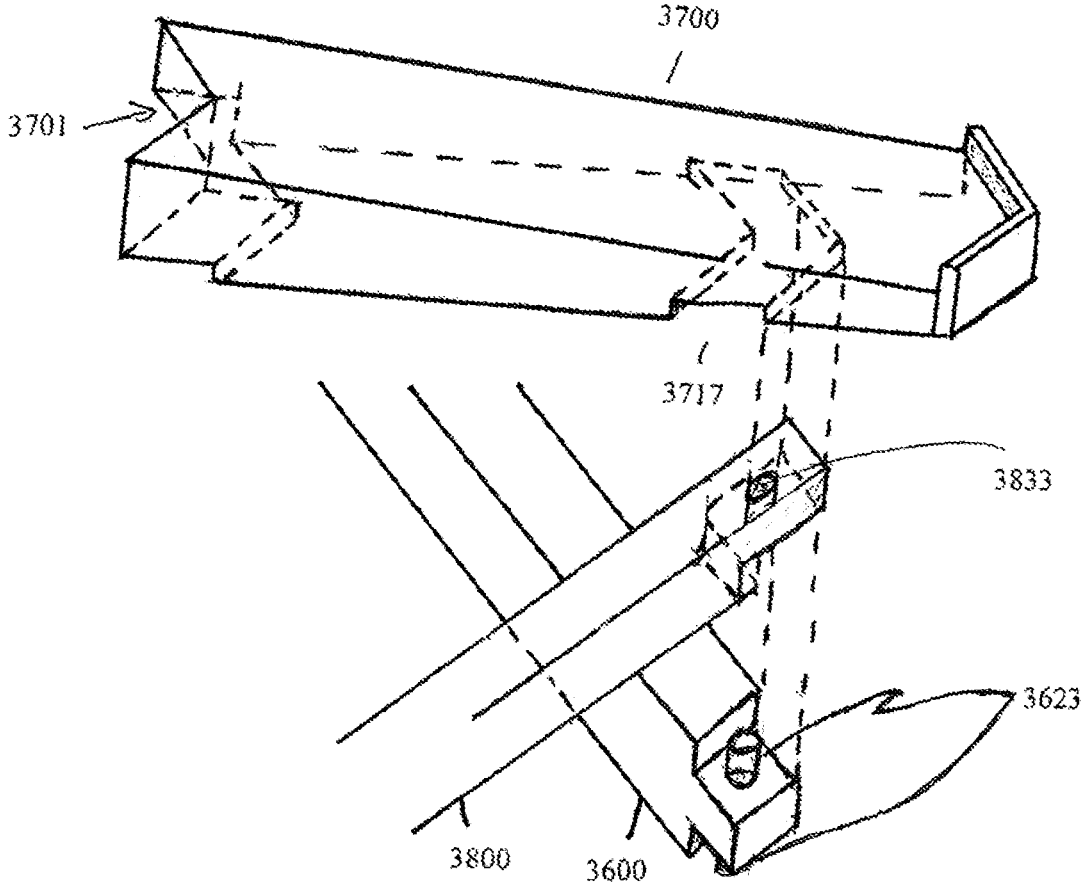
FIG. 37 shows an embodiment of an extension roof corner gable being positioned over an open corner as provided in FIG. 36.

To roof in the porch, the extension gables (3500) will generally positioned along any logs that extend outward from the main structure to the pin log (3600) and hole log (3800) construction. Should there be a corner (e.g. where the extension roof will wrap around a corner of the main structure) an extension corner gable (3700) as shown in FIG. 37 will typically be used. The extension corner gable (3700) includes a cutout (3701) which is designed to interface with a corner of the structure. This may be specifically adapted to go over ends (103) and (105) or may be designed to be flush and positioned over a closed corner such as is created by use of pin (3600) and hole logs (3800) or band boards (2301), (2311), (2321), (1100), and (1110). The extension corner gable (3700) will also include a slot (3717) sized and shaped to go over a corner produced by the interaction of a pin log (3600) and hole log (3800) as shown in FIG. 37. With the extension gables (3500) and the extension corner gables (3700) in place, roof slats (900) may be positioned thereon in the same fashion as is contemplated in FIGS. 9 and 13.

Figure 14:
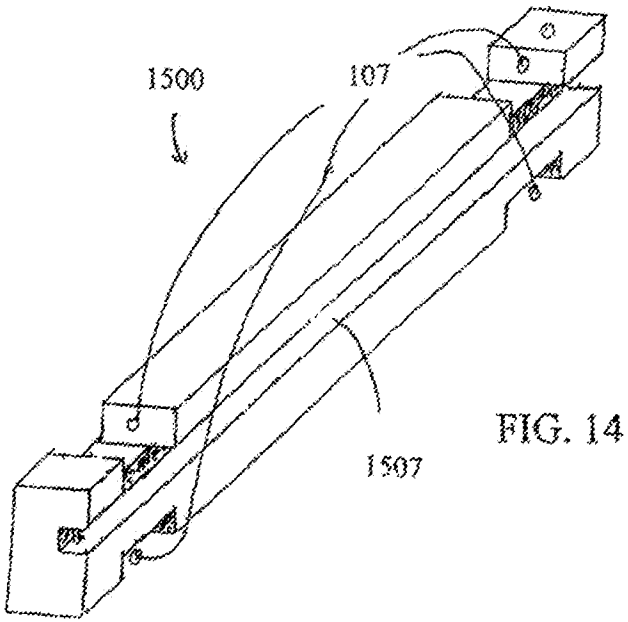
FIG. 14 shows an embodiment of a log for supporting a floor.
Figure 15:
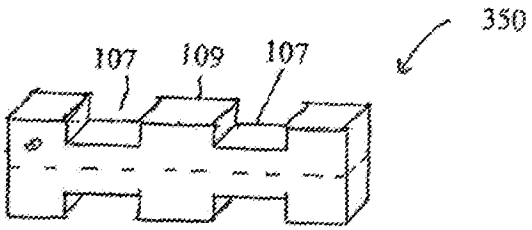
FIG. 15 shows an embodiment of a log for the construction of a chimney or other attached small structure.
Figure 16:
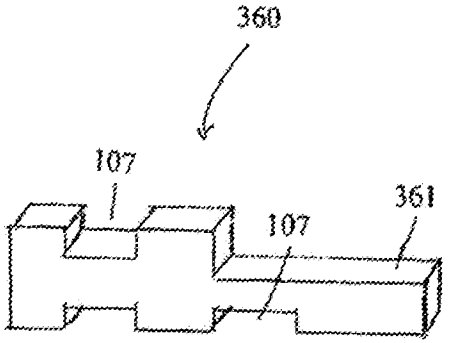
FIG. 16 shows an embodiment of a log for supporting a fireplace mantle.
Figure 17:
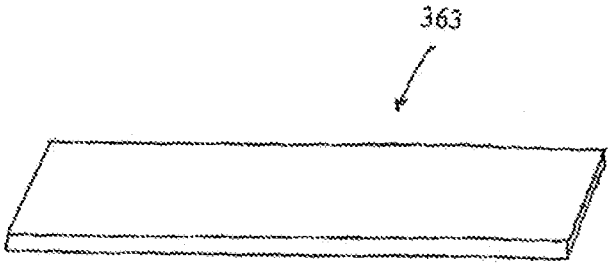
FIG. 17 shows an embodiment of a mantel piece.
Figure 18:
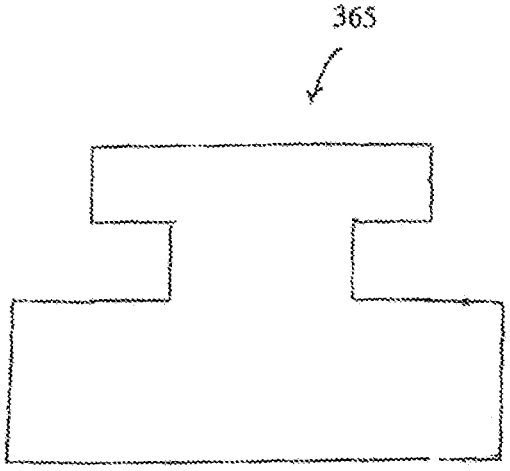
FIG. 18 shows an embodiment of a hearth piece.

FIG. 14 provides for a floor support log (1500). The floor support log (1500) is designed to allow for an internal floor to be provided to a structure. The floor support log (1500) is against generally sized and shaped to the same dimensions as at least one size of basic log (100). It also has notches (107) in the same generally position, and on opposing sides, as the basic log (100). The floor support log (1500), however, includes a channel (1507) on one of the non-notched sides (into its width). This channel (1507) is configured to hold floor panels of the type contemplated above, or the interlocked roof slats (900) as contemplated above to firm a floor.

As the floor support log (1500) is essentially interchangeable with a basic log (100), it allows for a floor to be placed anywhere in a structure by simply providing two floor support logs (1500) at opposing positions with their channels (1507) both facing inward. It should also be apparent that while the channel (1507) is intended to support a floor internal to a structure, reversing the floor support log (1500) to place the channel (1507) external to the structure, allows a user to build an awning, deck, bridge, or similar structure.

Figure 40A:
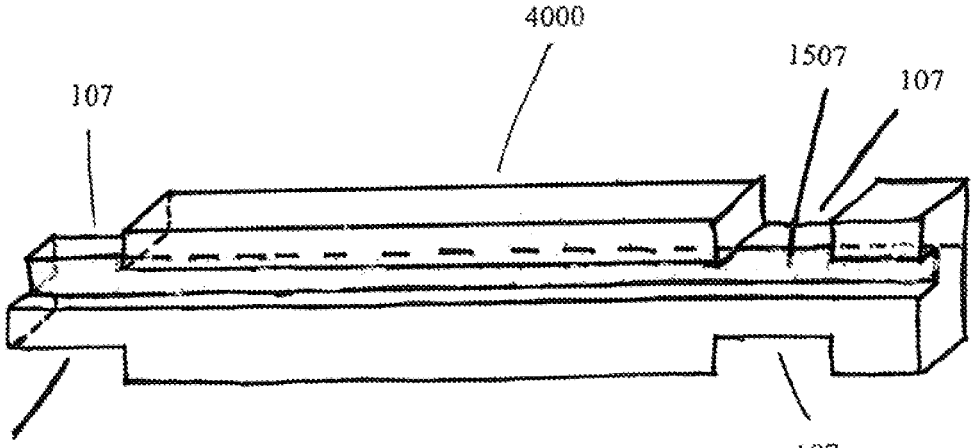
FIGS. 40A and 40B show alternative embodiments of floor support logs.
Figure 40B:
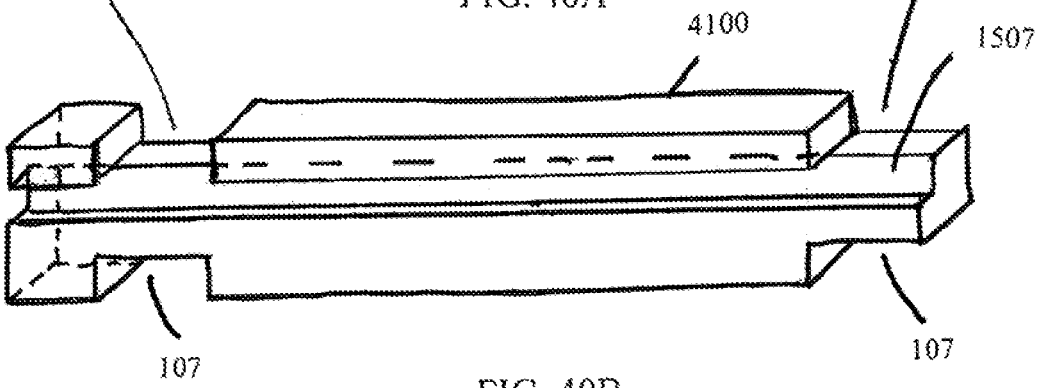

FIGS. 40A and 40B provide for alternative floor support logs (4000) and (4100). These logs eliminate one end (either (103) or (105) to allow for a closed corner to be made at a floor level. The floor support logs (4000) and (4100) can be used to create a closed corner, and/or to form a flat face form an internal position. However, they are not shown with a pin and hole construction. This is to illustrate that the pin and hole arrangement is not necessary in all closed corner parts. However, in an alternative embodiment, the floor support logs (4000) and (4100) may include pins and holes.

Figure 41A:
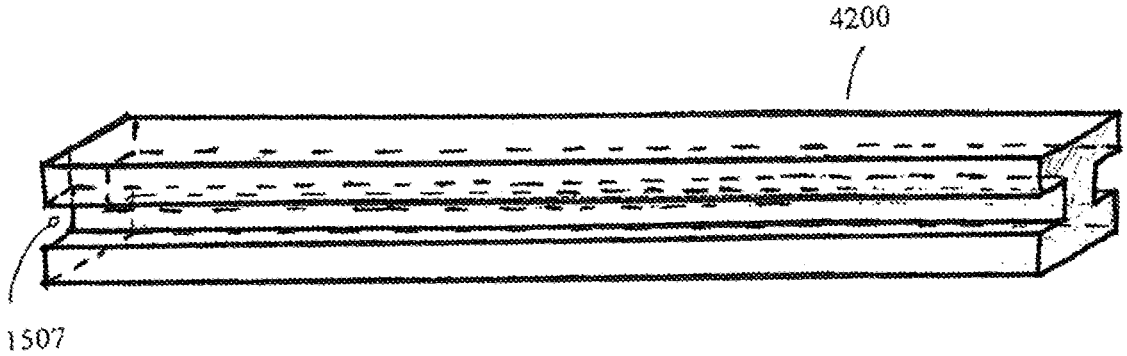
FIGS. 41A and 41B show alternative embodiments of floor support logs generally used internal to a structure.
Figure 41B:
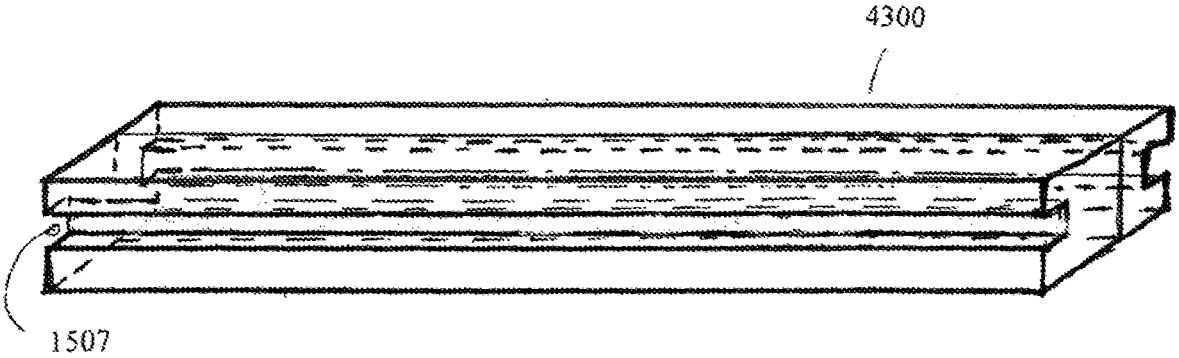

The floor support logs (4000) and (4100) can allow for the creation of attic floors as well as porch floors or floors where a closed corner is otherwise desired. Further, when the logs (4000) and (4100) are combined with the floor connector logs (4200) and (4300) of FIGS. 41A and 41B, the ability to create floors which are larger than any provided logs becomes available. Providing floor panels of various sized in conjunction with the logs of FIGS. 40A, 40B, 41A and 41B allows for a large number of floor designs to be constructed. Specifically, the logs (4000) and (4100) of FIGS. 40A and 40B along with the basic floor support log (1500) of FIG. 14 allows for a floor channel (1507) to be placed in essentially any wall structure. The logs (4200) and (4300) of FIGS. 41A and 41B provide for interconnection of floor panels internal to the structure where there is no interconnection with the walls of the structure. Thus, floors can be built which can accommodate structures which are much larger in one or both horizontal dimensions than the largest basic log (101) provided.

FIGS. 15-18 provide for specialized parts that allow for the formation of a chimney structure. A chimney is effectively simply a very small extension from a wall. The chimney connector (350) is basically a specialized bask log (100) which includes two very closely positioned notch (107) pairs. The center portion (109) is generally sized so that is the same size as the end portions on each end after the notches (107) (this is generally the length (E) discussed later in conjunction with FIG. 47). The chimney connector (350) therefore allows for small extension in a wall by placing two chimney connectors (350) at end notches (107) of two basic logs (100) each one third the length of the basic log forming the opposing wall (assuming a center chimney).

The top of the chimney on the interior is created with a mantel piece (360) which simply provides a mantel shelf (361) in place of one of the notches and cutting through one end. The mantle shelf (361) supports a specialized flat component which is the mantle (363). While it may not be needed in all structures, a chimney built on an upper floor can generate an undesirable hole in the floor. For this reason a specialized hearth (365) piece may be provided which fills the hole and provides the appearance of a hearth in the fireplace.

Figure 19:
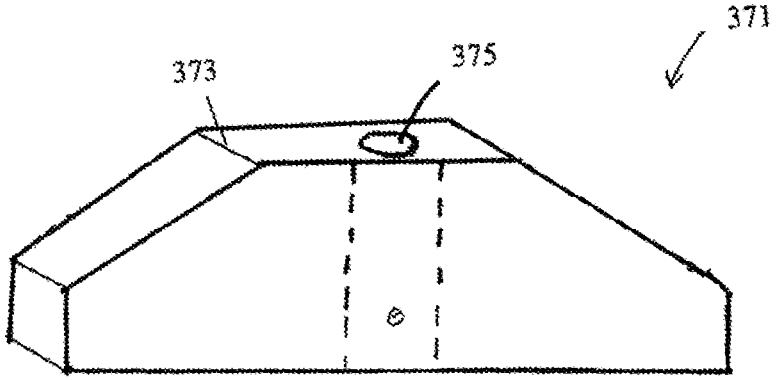
FIG. 19 shows an embodiment of a piece for transitioning a fireplace construction into a chimney.
Figure 20:
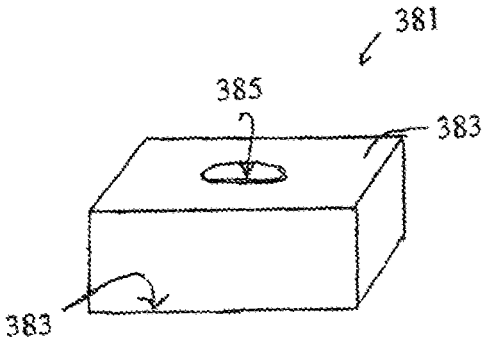
FIG. 20 shows an embodiment of a piece for forming a chimney.

FIGS. 19 and 20 provide for an embodiment of exterior chimney components. These would generally be placed external to the structure or the top of a chimney built using the chimney connector (350). However, in an alternative embodiment, they may be used to form an interior chimney as well (if the fireplace is internal). FIG. 19 provides for the chimney transition piece (371) which transitions form the fireplace to the flue. The transition (371) is generally roughly trapezoidal in shape with removed corners. In an embodiment, the angles of the angles sides are intended to correspond to the angles of a gable (500) to allow the transition to align with, or be part of, a roof. The top (373) of the transition (371) will generally include a center hole (375), which often does not penetrate all the way through the bottom surface, for supporting a cylindrical dowel rod or similar component to give the chimney increased strength.

Figure 21:
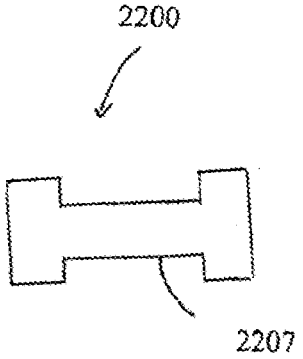
FIG. 21 shows an embodiment of a piece for making a bay window.

Chimney block (381) are shown FIG. 21 and will generally also include a hole (385) however this hole (385) will generally run all the way through the chimney block (381) from both opposing sides. To construct the chimney, any number of chimney blocks (381) will be threaded onto a dowel rod placed in the hole (375) in the transition and moved down to rest on the top surface (373) of the transition (371). Generally, the chimney blocks will have major faces (383) with similar area to that of the top surface (373) so as to mesh smoothly in forming the chimney. A portion of the dowel rod may be left above the last threaded chimney block (381) to show a flue extension or stack, if desired.

Figure 22:
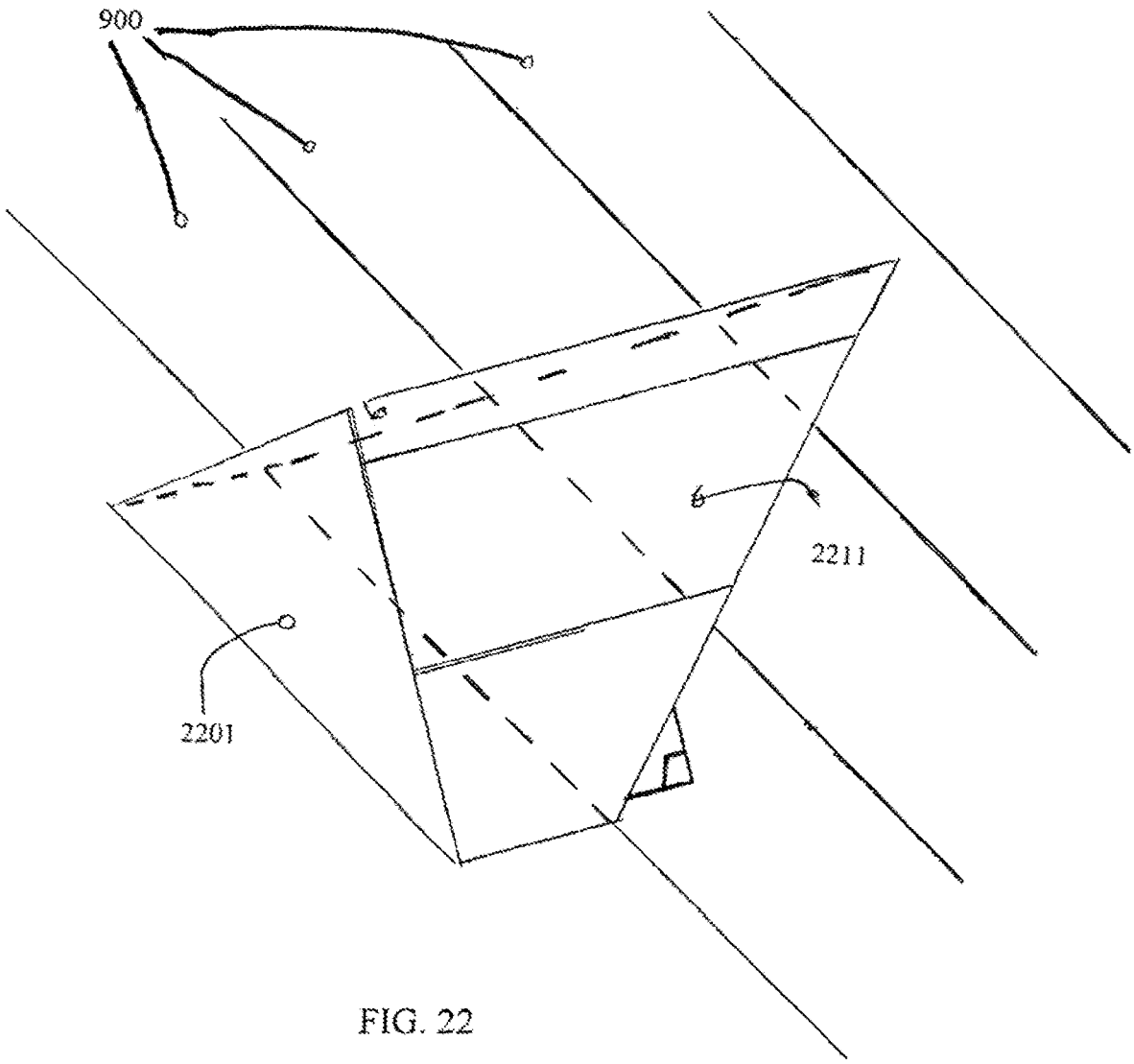
FIG. 22 shows an embodiment of a cricket piece for integrating a chimney to a roof.
Figure 42:
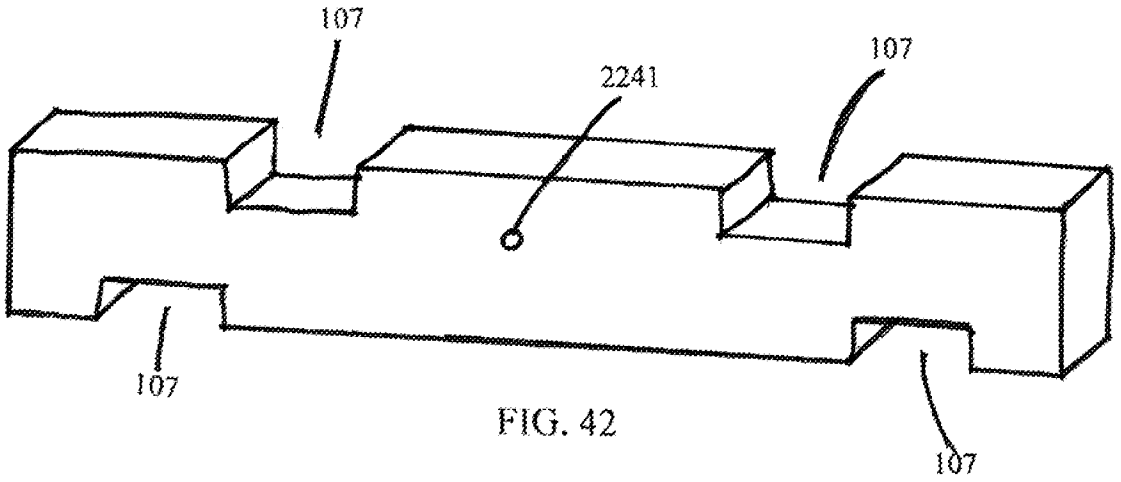
FIG. 42 shows an embodiment of an offset log which can be used to align a chimney with a dormer or otherwise to offset a structure.

FIG. 22 shows a cricket block (2211) for integrating a chimney to a roof. In this case, the chimney blocks (381) can be integrated with the roof of the structure by simply placing the cricket block (2211) onto the roof slat (900) with the face (2201) against the chimney blocks (381). FIG. 42 provides for a chimney transition piece (2241) which can be used to assist in tying a fireplace at a lower floor into a dormer constructed using a dormer rafter (3000) as contemplated in FIG. 31. The chimney transition log (2241) includes four troughs (107) of the standard size and is generally proportioned as a basic log (100). However, the troughs (107) on the bottom are spaced at a greater distance than the troughs (107) on the top of the log. This allows for the fireplace (which is offset outside the wall of the structure) to effectively be shifted back into line with other components. The cricket block (2211) may be used to close the hole on the roof side. As should be apparent, the chimney transition log (2241) can also be used for other adjustments of positions as the troughs (107) on the top will generally correspond to the length of one size of basic log, while the troughs (107) on the bottom will generally correspond to another. The chimney transition log (2241) of various sizes could also be used to make stepped pyramidal structures and other similar designs.

FIG. 21 provides for one additional log which is a bay window log (2200). The bay window log (2200) allows for basic logs (100) to be placed side-to-side at their non-notched sides (double width). To accomplish this, the bay window log (2200) includes a long notch (220). This long notch (2207) has the same length as two notches (107) and therefor allows for two basic logs (100), or any other logs, to be positioned side-by-side horizontally.

Figure 47:
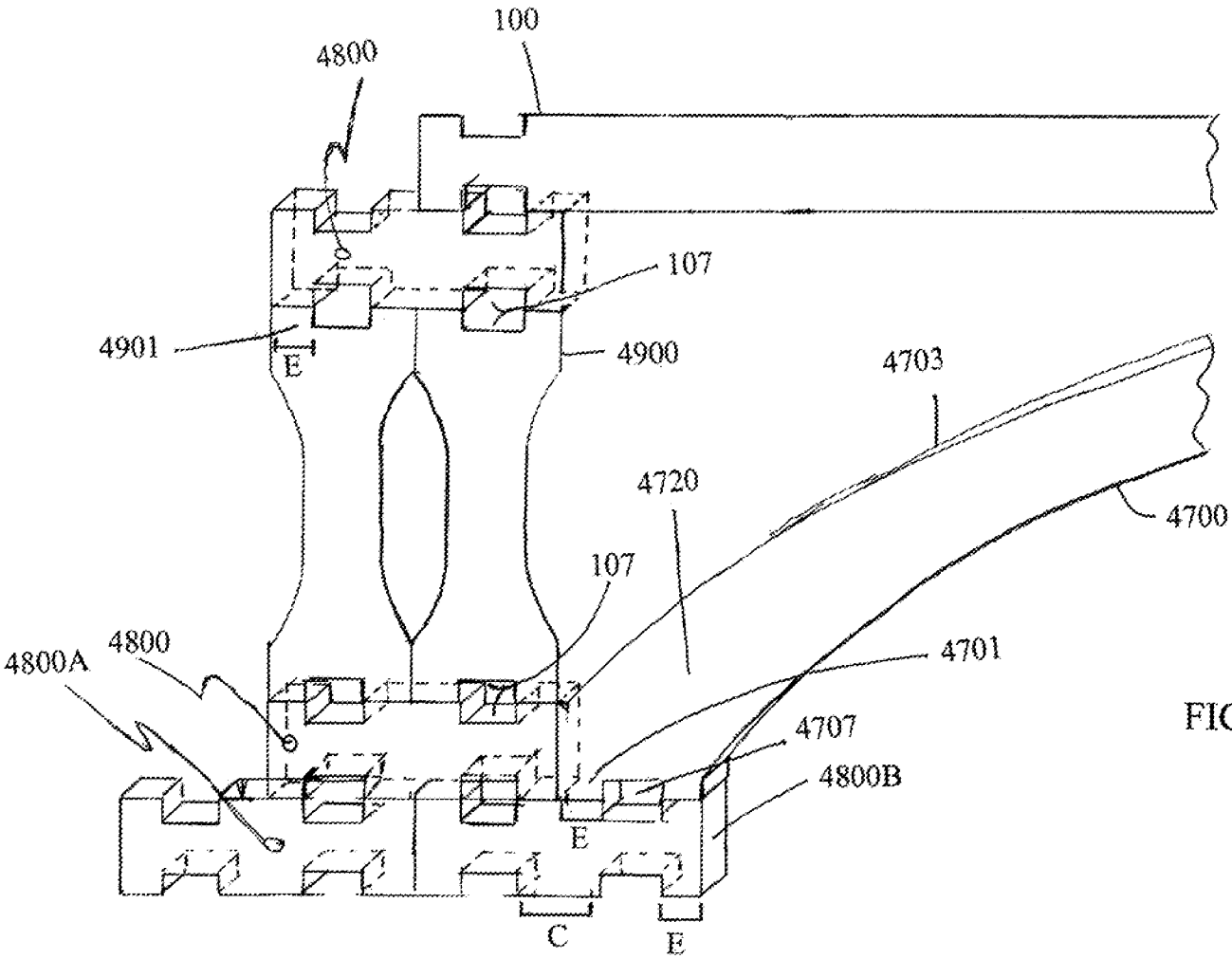
FIG. 47 shows an embodiment of a dual connector log, pillar log, and a first end of an arch log showing the base of a suspension bridge structure.
Figure 48:
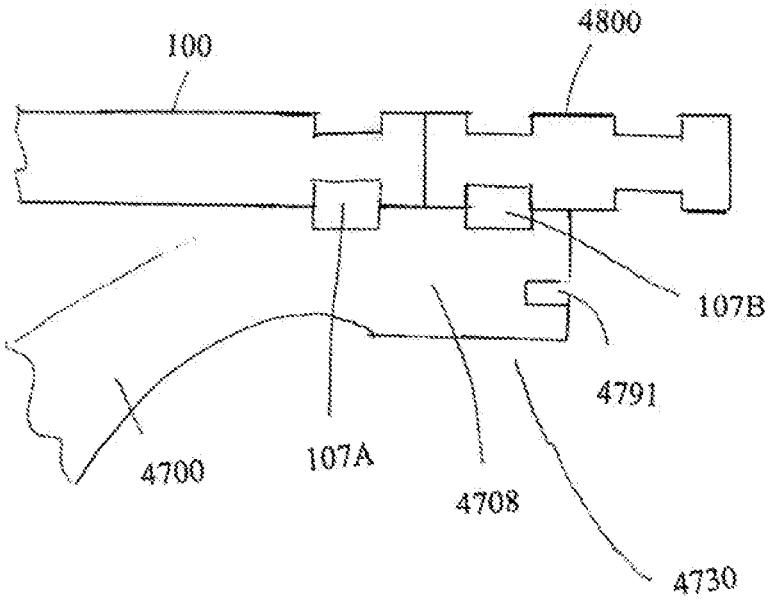
FIG. 48 shows a first embodiment of the second end of the arch log of FIG. 47.
Figure 49:
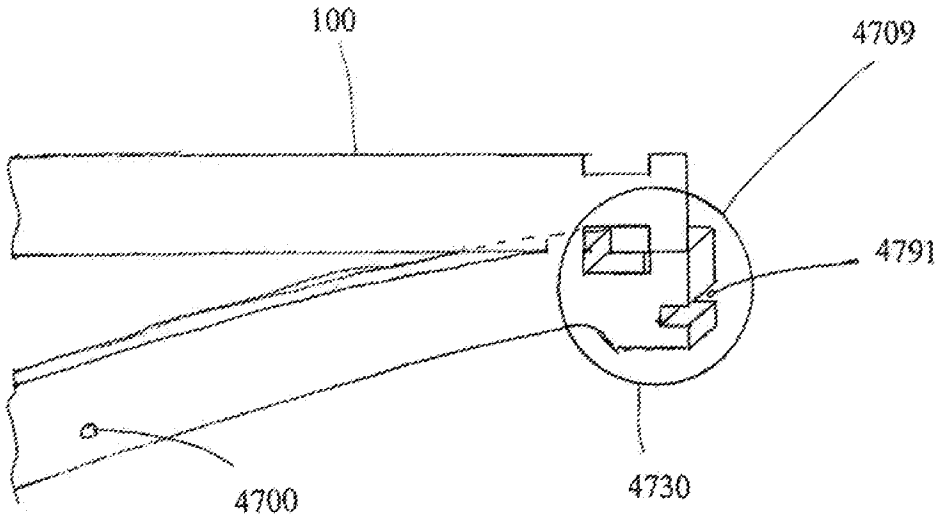
FIG. 49 shows, a second embodiment of the second end of the arch log of FIG. 47.

FIGS. 47, 48, and 49 provide for a variety of additional logs which can provide for still further functionality. Particularly, FIG. 47 shows an arch log (4700), a dual connector log (4800), and a pillar log (4900). These logs have been arranged to build the base of a portion of a suspension bridge structure in FIG. 47. The pillar log (4900) is designed to provide a vertical support and may be used to connect to logs via the slot (107) in the standard fashion. It can be used for similar purpose to the log (3801) in FIG. 38, hut connecting via a slot (107).

The dual connector log (4800) provides for the ability to connect logs end-to-end. The dual connector log (4800) is sized and shaped so that the length (C) of the center portion (109) is generally double the length (E) of the end portion (155) (E.g., (C)=2*(E)). Generally, it will be preferred that all basic logs (100) (and in fact all logs) have an end portion with generally the same length (E). Thus, the dual connector log (4800) allows for any two logs (100) to be interconnected end to end. This includes two dual connector logs (4800A) and (48008) as shown in FIG. 47. Further, other logs can be arranged so as to have similar end dimensions (E) on one or both sides of their notches (107) or (117) so as to allow them to be placed next to each other using a dual connector log (4800). Specifically, as shown in FIG. 47, the pillar log (4900) can have the pillar support (4901) on both sides of the notch (107) have a length (E). The arch log (4700) can similarly have an overhang (4701) on its first connection end (4720) of length (E). The structure of the dual connector log, and having a common end length (E) allows for extensions of logs to be made connecting logs end-to-end.

FIG. 47 also shows an arch log (4700). The arch log (4700) is in many respects similar to a rafter (4300). However, it has a curved upper edge (4703) as opposed to a linear one. The curve allows for the arch log (4700) to be used to form domed roofs if desired and may include a fascia slot (4307) in its first connecting end (4720). Similar to the rafter (4300), the slot (4707) may have a depth of generally one-quarter or generally one-half the height of a basic log (100) so as to interface with the same types and positions of other logs. However, the arch log (4700), as shown in FIG. 47, may also be used to provide for arched supports. FIG. 47 shows the first connecting end of the arch log (4700) and the arcuate center portion which extends beyond the page to the right of FIG. 47. Above the arch log (4700), there is arranged a basic log (100) which is extending from the structure formed of dual connector logs (4800) and pillar logs (4900). This basic log (100) can also be a floor log (1500) to provide a road surface to the bridge.

To the right (as viewed) of FIG. 47 the arch log will have a second connection end (4730) as contemplated in either FIG. 48 or FIG. 49. FIG. 48 shows a dual slot connector (4708) while FIG. 49 shows a single slot connector (4709). The dual slot connector (4708) will generally be used if the arch log (4700) is to be connected to another opposing arch log (4700) or to a truss (3900) while the single slot connector (4709) will generally only be used for interconnection to an opposing arch log (4700) or against a surface such as a floor log (1500).

As can be seen in FIG. 28, the dual slot connector (4708) allows for the first slot (107A) to be interconnected with the basic log (100) that came from FIG. 47. The slot (107) in the single slot connector (4709) will generally allow the same connection as shown in FIG. 29. However, in FIG. 28, another log may be placed on the second slot (107B). In FIG. 28, this is a dual connector log (4800). This can provide improved aesthetics and strength to an interconnection. Either connector (4708) or (4709) will generally also include a slot (4791) which can be used to hold a connector board (4319) (or similarly sized structure) in the same way as is discussed above for roof rafters (4300) and (4310) in conjunction with FIG. 43 and other related slots of similar size and shape.

FIGS. 47 and 49 contemplate the construction of a suspension bridge structure, a structure which previously has been unknown in wooden log building sets. The suspension bridge structure will generally have base design as shown in FIG. 47 with a mirror the components of FIG. 47 placed on the right side. The tower formed of pillar logs (4900) and dual connector logs (4800) will generally extend higher than the top of the page of FIG. 47 and will terminate in roof rafters (4300) or (4310). The slots (4791) of the arch logs (4700) may be filled using a connector board (4319) longer than necessary or through use of a special log (300). Regardless, there will generally be an overhang coming out of the page of FIG. 48 at the slot (4791). If a special log (300) is used, this will be the end portion of length (E) and this embodiment will be used for ease of discussion.

To add suspension, a rope may be strong through the fascia slots (4307) in the roof rafters (4300) or (4310) which can then extend under the overhanging end portion of length (E) of the special log (300) of both the arch logs (4700) which are arranged in opposing directions and interconnected by the special log (300). The special log (300) may include a slot specifically for this purpose in an embodiment. The rope will then go back up to the rafter (4300) or (4310) on the next tower (the mirror image construction placed to the right side of FIG. 47) to create suspension. As should be apparent from this discussion and examination of FIGS. 47 and 48 a unique facet of this bridge structure is that the rope actually supports the bridge structure in conjunction with the arch log (4700) in a manner similar to the support of an actual suspension bridge.

Figure 53:
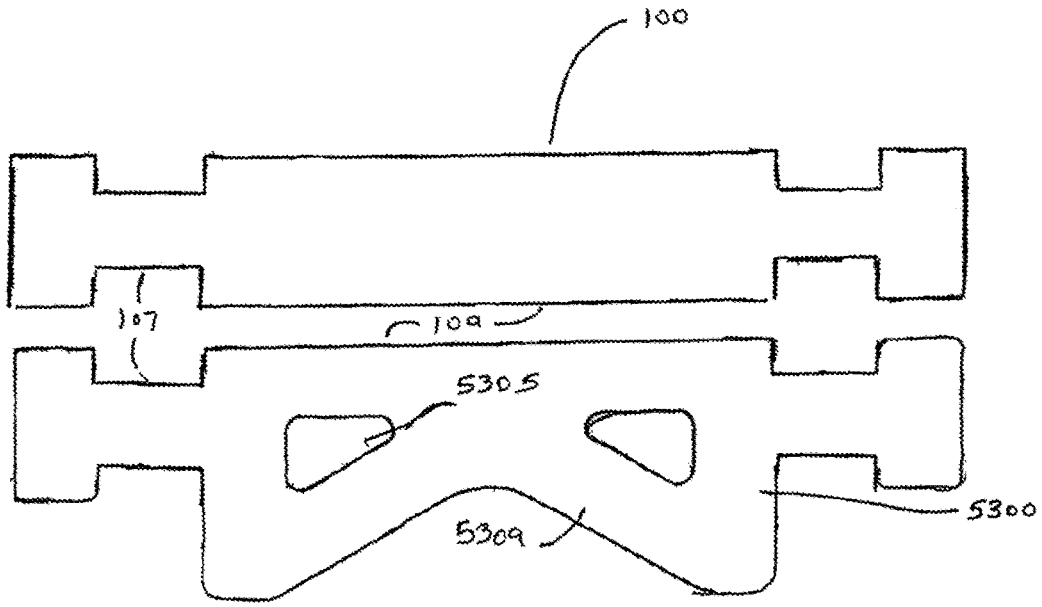
FIG. 53 shows an embodiment of tower header, with two triangular shaped holes in the center portion of the tower header.

Additional figures can provide further clarity as to the type and variety of bridges that can be built using the building toy, though it should not be understood that the bridges and structures discusses herein are an exhaustive list of what can be created using the building toy. FIG. 53 shows a tower header (5300), which can be used to provide structural support in the creation of certain types of bridges or truss like structures, particularly in conjunction with the tower connector (5400). The tower header (5300) is depicted alongside a basic log (100) to show illustrate that the tower header (5300) and certain embodiments of the basic log (100) will have the same overall length, the same relative placement and size of notches (107) and the same overall length of the central portion (109). However, as depicted, the central portion of the tower header (5309) is elongated downward to allow for one or more holes (5305). These holes can be decorative, or can be used as a means to providing support in certain embodiments of suspension bridges.

Figure 54:
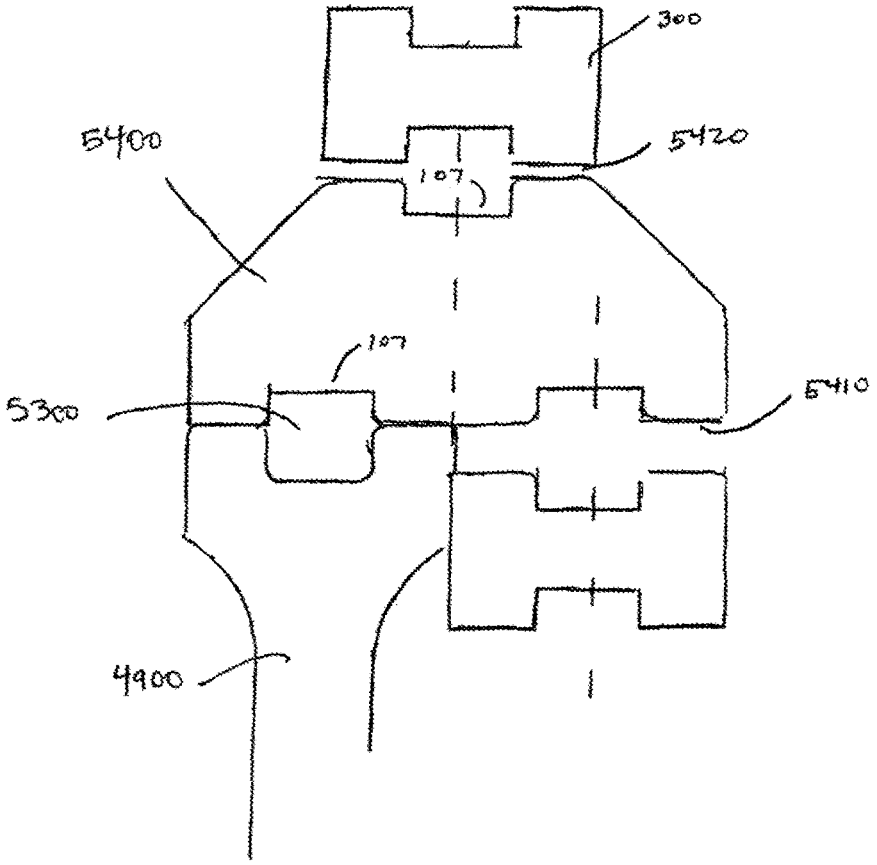
FIG. 54 shows an embodiment of a tower connector.

FIG. 54 depicts a tower connector (5400) in cross section, which in conjunction with the tower header (5300) provides structural support in the creation of certain types of bridges or truss like structures. As depicted in FIG. 54, the bottom surface (5410) of the tower connector (5400) is twice the width as certain other logs, including a pillar log (4900) or a special log (300). Two notches (107) are placed in the bottom surface (5410) of the tower connector (5400) to mirror those notches (107) found in other logs of similar half width. This space allows for logs like the tower header (5300) or a spacer log (300) to be placed in the gap formed by the notches (107) of the bottom surface (5410) of the tower connector (5400) and a pillar log (4900). Likewise, the top surface (5420) is the same width as certain other logs, including a pillar log (4900) or a special log (300), and a single notch (107) is placed in the center of the top surface in a manner that mirrors those notches (107) in other logs of similar width. This space allows for logs like the tower header (5300) or a spacer log (300) to be placed in the gap formed by the notch (107) of the top surface (5420) the tower connector (5400). This arrangement creates a means of structural support similar to that seen in FIG. 47 using dual connector logs (4800).

Figure 55:
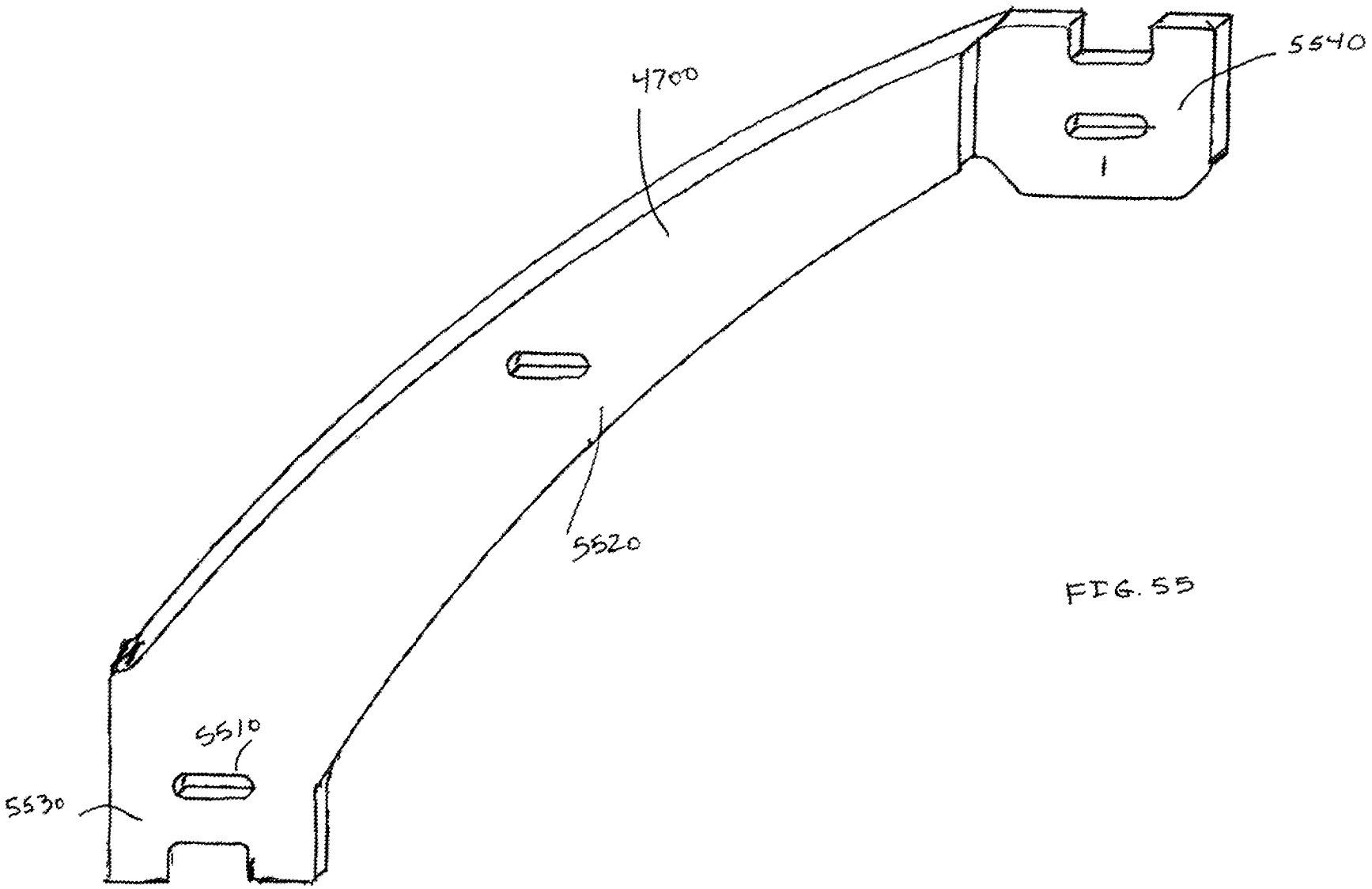
FIG. 55 shows another embodiment of an arch log, including a single hole in each of the arcuate center portion of the arch log, the first connecting end of the arch log, and the second connecting end of the arch log.

FIG. 55 shows an alternate embodiment of the arch log (4700) shown in FIG. 47. In this embodiment, one or more holes (5510) may be placed within the arcuate central portion (5520), the first connecting end (5530), or the second connecting end (5540). The number, size, and shape of the holes is not important to the embodiment of the arch log (4700) except insofar as it may allow a narrow diameter rope or fiber line of sufficient tensile strength to be provide suspension.

Figure 56:
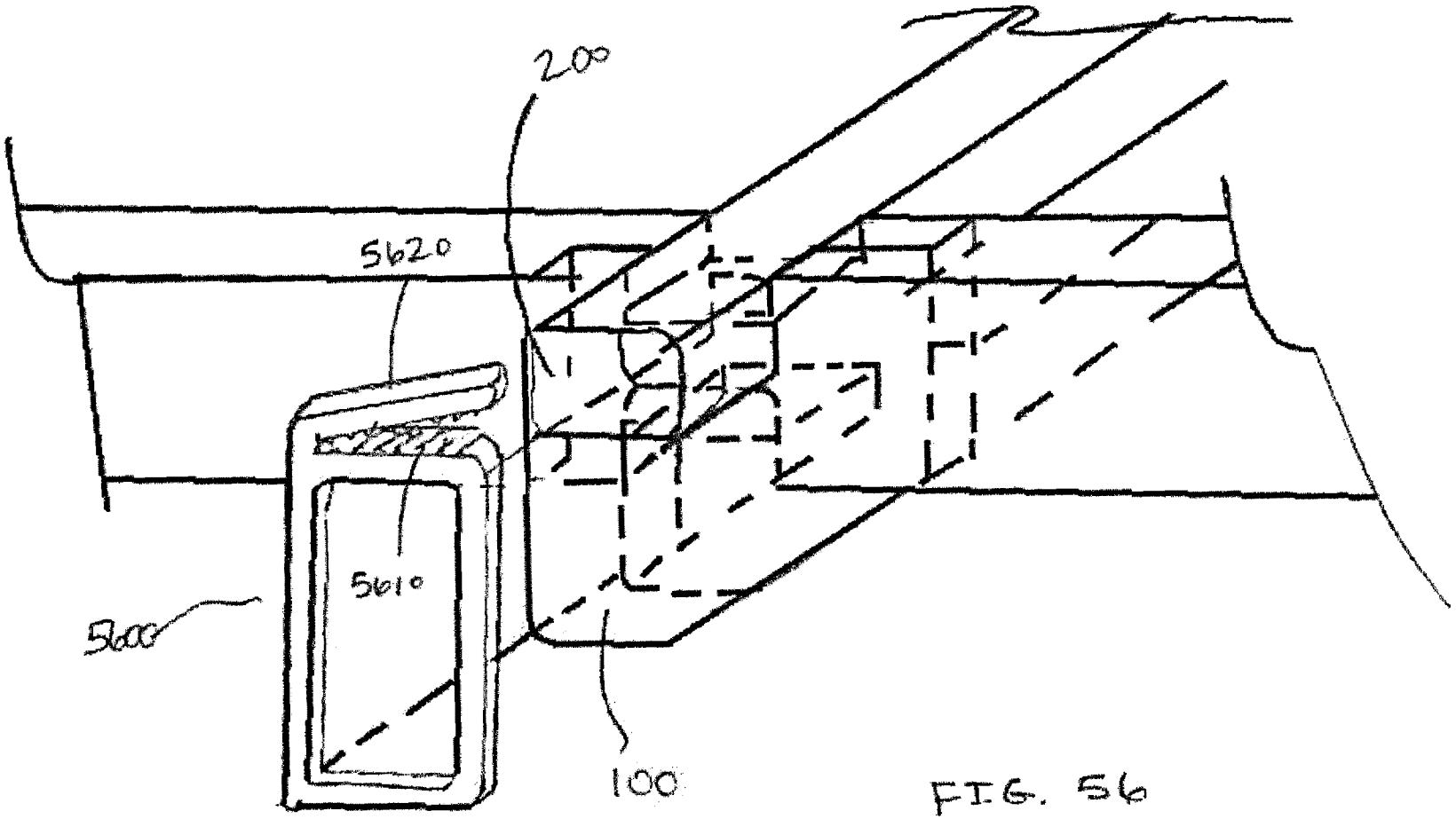
FIG. 56 shows a first embodiment of a beam clip.
Figure 57:
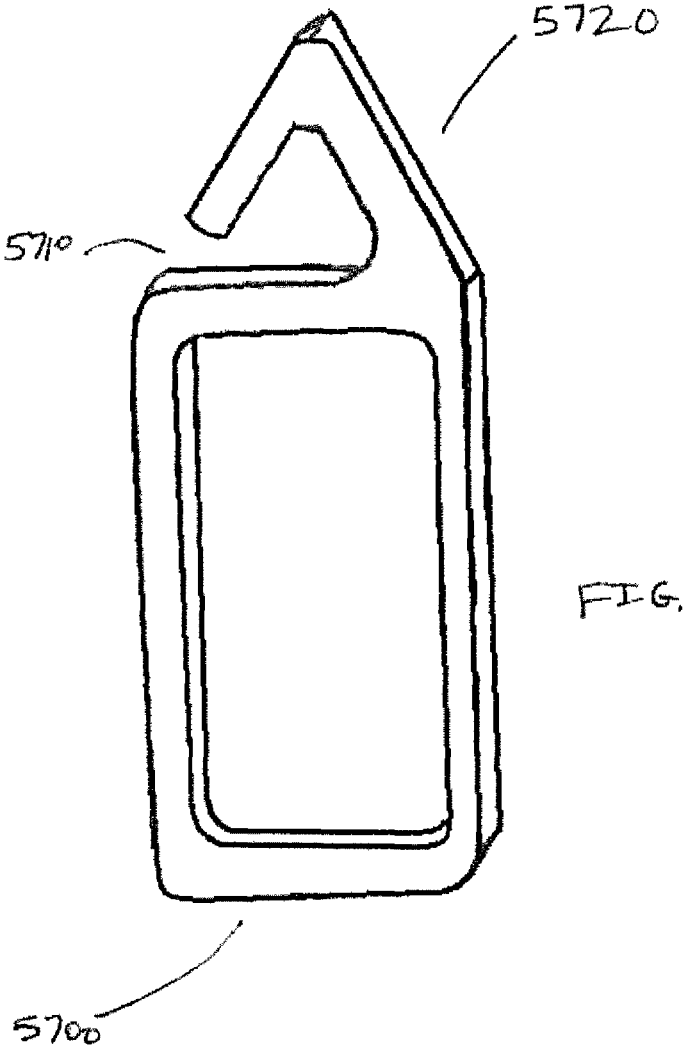
FIG. 57 shows a second embodiment of a beam clip.

FIGS. 56 and 57 show separate embodiments of a beam clip (5600, 5700). In each case, the bean clip (5600, 5700) is sized to fit over the ends of basic log (100) and half log (200), or other logs of similar relative height and width in order to hold them together. In the first embodiment of the beam clip (5600), the inside surfaces of the b clip contain teeth (5610) which, as the upper portion (5620) of the beam clip (5600) narrows, would allow a narrow diameter rope or fiber line of sufficient tensile strength to be held for the purpose of providing suspension. FIG. 57 shows a second embodiment of the beam clip (5700), in which a narrow diameter rope or fiber line of sufficient tensile strength to be held for the purpose of providing suspension would pass between the beam clip gap (5710) and be held by the beam clip hook (5720).

Figure 58:
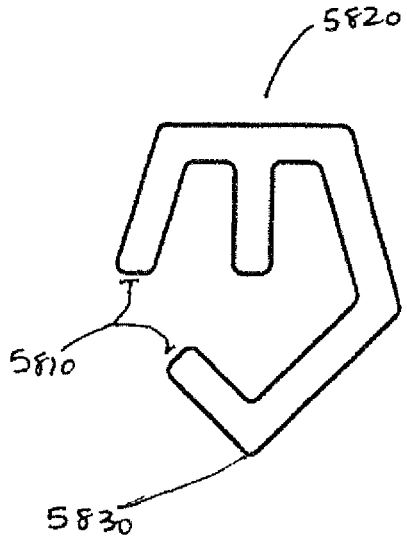
FIG. 58 shows, an embodiment of a bridge clip.

FIG. 58 depicts a bridge clip (5800). In suspension bridges, main cables run between towers, suspension cables, under tension, run between main cable and the road deck. Bridge clips (5800) provide the same purpose for the building toy. A marrow diameter rope or fiber of sufficient tensile strength can slide between the bridge clip gap (5810), resting against the upper surface (5820) of the bridge clip (5800) such that the rope or fiber line is prevented from sliding, while the lower portion (5830) of the bridge clip allows for securing suspension cables to the base of the bridge deck.

Figure 59:
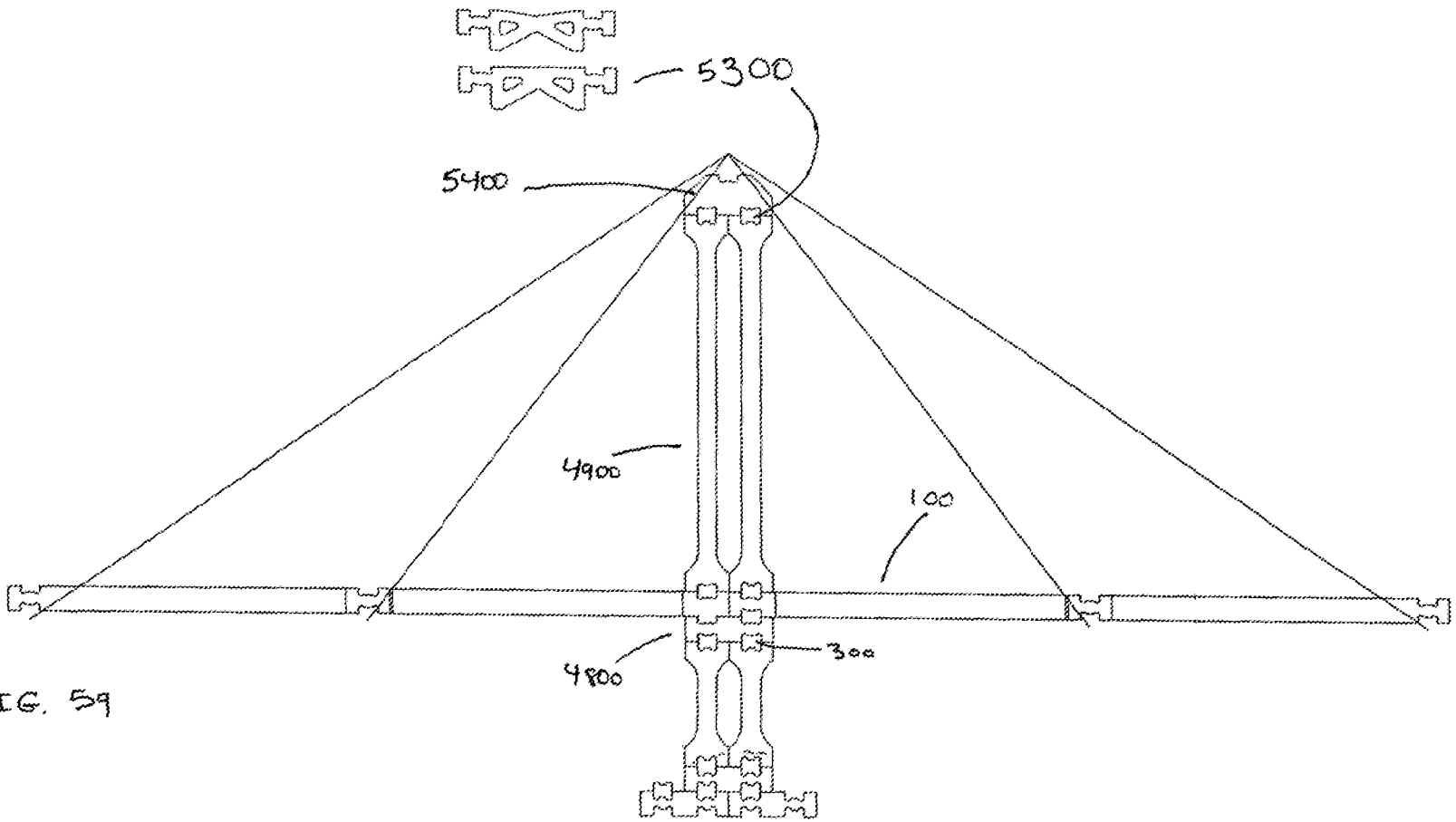
FIG. 59 shows an embodiment of tower headers, tower connectors, pillar logs, special logs, dual connector logs, and basic logs, as well as rope to form a cable-stay type suspension bridge.
Figure 60:
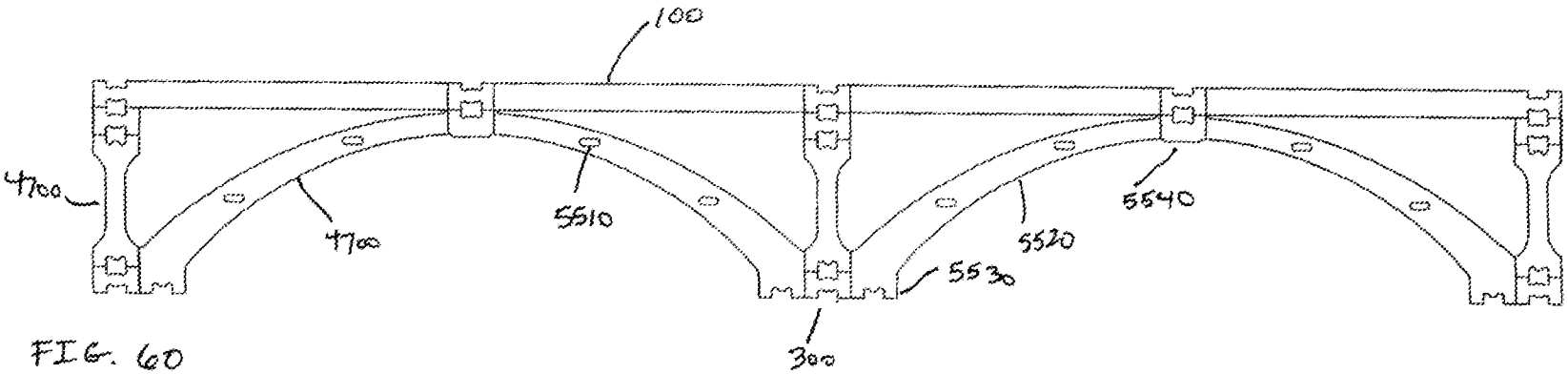
FIG. 60 shows an alternative embodiment of FIG. 47, depicting embodiments of special logs, dual connector logs, pillar logs, basic logs, and arch logs (illustrating an embodiment with two holes in the arcuate central portion) to form an arch type bridge.
Figure 61:
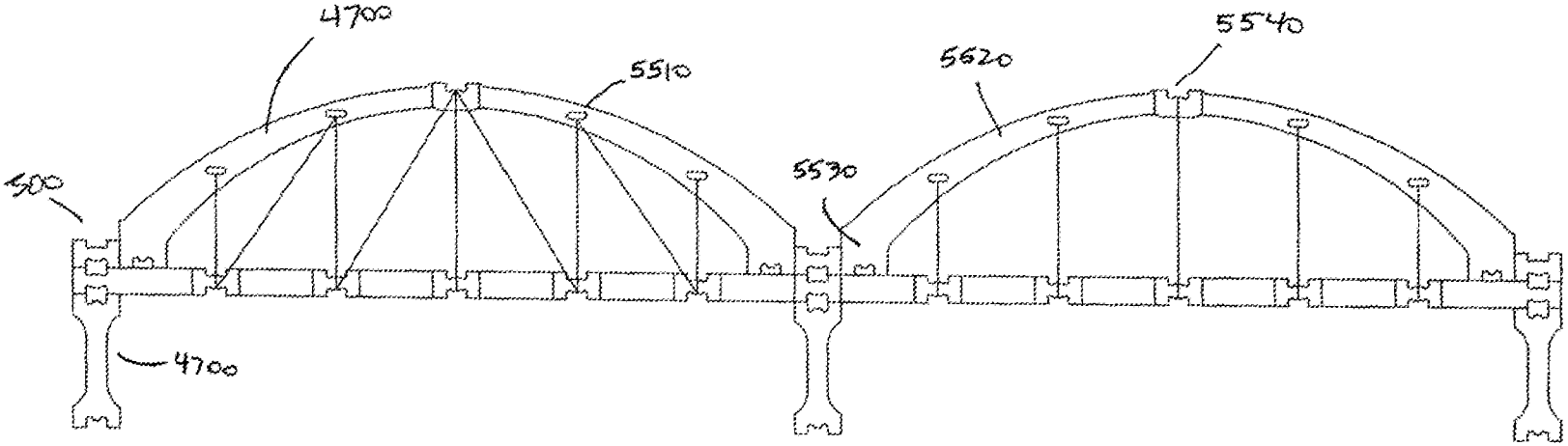
FIG. 61 shows two embodiments of dual connector logs, special logs, pillar logs, basic logs, and arch logs (illustrating an embodiment with two holes in the arcuate central portion) and rope to form an arch type suspension bridge.

FIGS. 59, 60, and 61 depict various types of suspension bridges that are possible using the building toy, though as noted above, the combinations depicted should not be considered to be an exhaustive list. FIG. 59 depicts a cable-stay type suspension bridge. Support is given through the use of dual connector logs (4800), pillar logs (4900), tower headers (5300, depicted in cross section, as well as going into the paper), tower connectors (5400), special logs (300), basic logs (100) or road surface logs (1500) and rope to provide support. Additional support can be provided through the use of beam clips (5600, 5700) and bridge clips (5800), where appropriate.

FIG. 60 depicts an arch type bridge, similar to portions depicted in FIGS. 47, 48, and 49. Support is given through the use of arch logs (4700), dual connector logs (4800), pillar logs (4900), tower headers (5300, depicted in cross section, as well as going into the paper), tower connectors (5400), special logs (300), and basic logs (100) or road surface logs (1500). In this figure the embodiment of the arch logs (4700) contains two holes (5510) in the arcuate central portion (5520), and no holes in either the first connecting end (5530), or the second connecting end (5540).

FIG. 61 depicts two types of arch type suspension bridges. Support is given through the use of arch logs (4700), dual connector logs (4800), pillar logs (4900), tower headers (5300, depicted in cross section, as well as going into the paper), tower connectors (5400), special logs (300), and basic logs (100) or road surface logs (1500), and rope to provide support. Additional support can be provided through the use of beam clips (5600, 5700) and bridge clips (5800), where appropriate.

Figure 62:
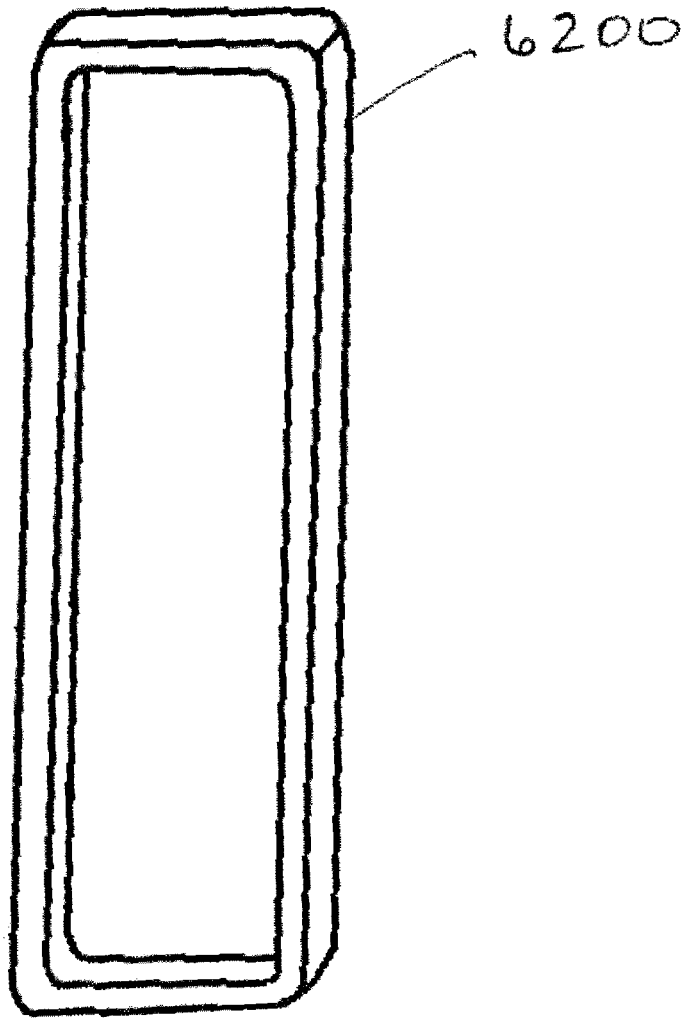
FIG. 62 shows an expanding arch bracket.
Figure 63:
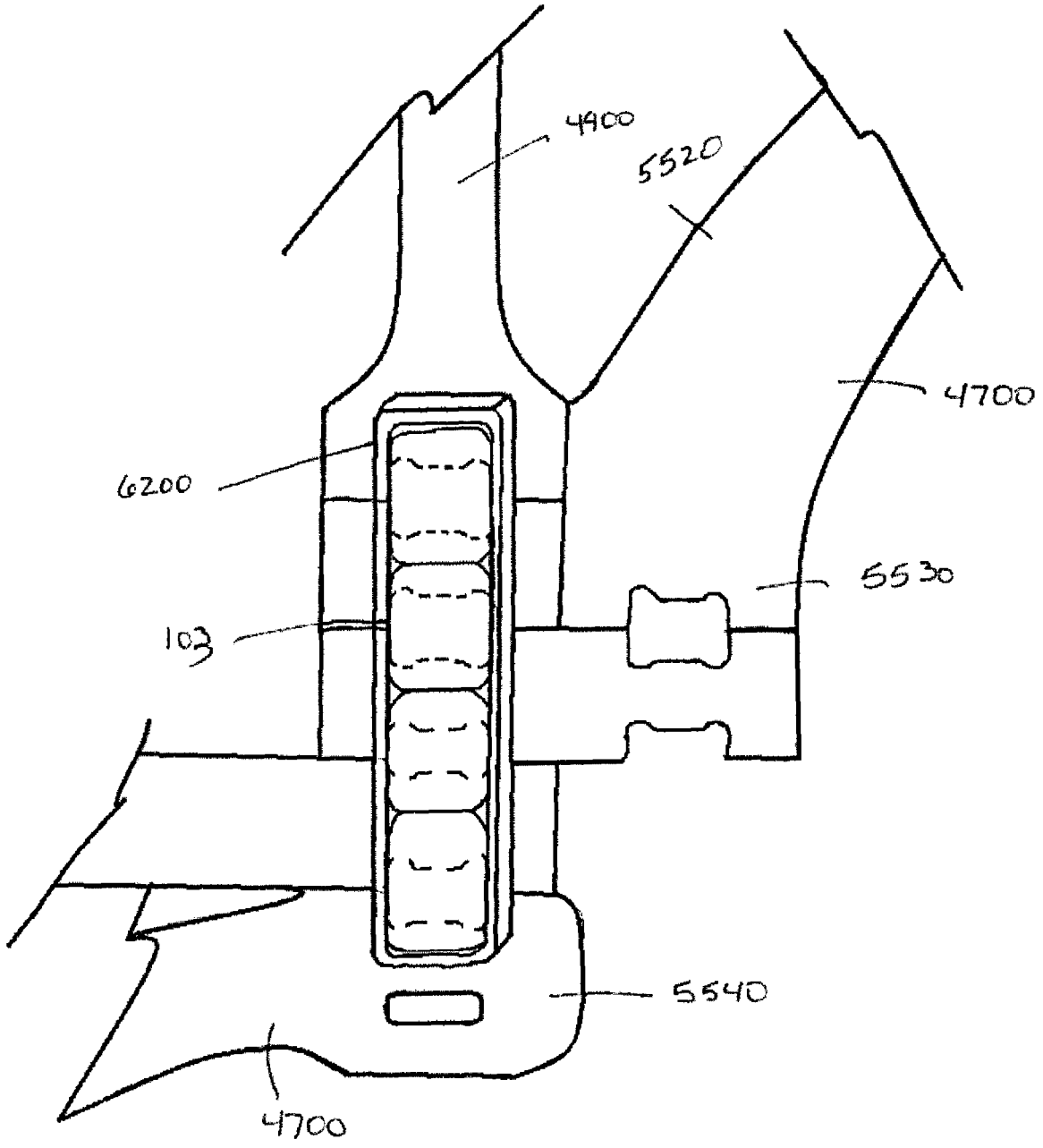
FIG. 63 shows a second view of an expanding arch bracket, in use with other building toy components.

FIGS. 62 and 63 depict an expanding arch bracket (6200). The expanding arch bracket (6200) can be made in a variety of sizes, but will typically have a width slightly wider than that of an end portion (103) of a basic log (100) or other standard sized log. The expanding arch bracket (6200) will have a height sufficient to be placed around a whole number of end portions (103) of a basic log or other standard sized log. In this manner, the expanding arch bracket (6200) can act as a spacer, securing individual building toy logs together, similar to the beam clip (5600, 5700) in FIGS. 56 and 57, and allowing for wider and more expansive arches than could be accomplished otherwise.

FIG. 63 shows the expanding arch bracket (6200) in use. At the base of the figure is depicted the second connecting end (5540) of an arch log (4700) (the remainder of the arch log extending off the page), with a second arch log (6700) depicted on the right hand side of the figure and extending off the page, including the first connecting end (5530) and the arcuate central portion (5520). In the middle, the expanding arch bracket (6200) is shown around the end portions (103) of several standard sized logs. The figure also shows a dual connector log (4800) and a pillar log (4900) in use, the latter extending off the page. As depicted, the expanding arch bracket (6200) allows for a taller and wider arch than would otherwise be possible. Absent the expanding arch bracket (6200), the highest part of the arch in the structure would be the second connecting end (5540) of the lower arch log (4700) shown in the figure. With the expanding arch bracket (6200) the second arch log (4700) can extend the arch higher, with the limits of the height and width of an arch simply a function of structural support for the weight of the arch logs (4700) and other logs.

Figure 64:
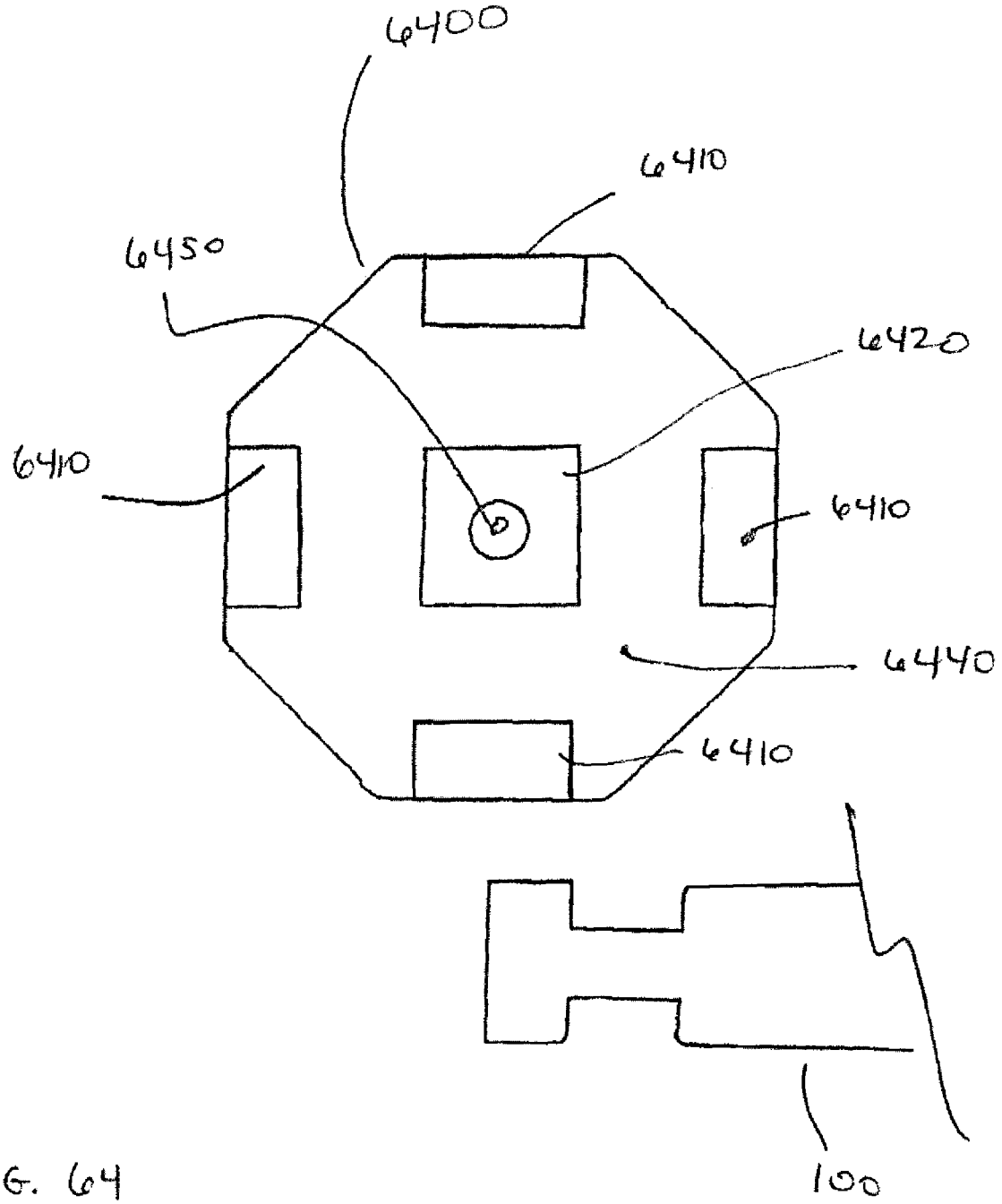
FIG. 64 shows a rotatable octagon.

FIG. 64 depicts a rotatable octagon (6400). One issue with building toys is that, once built, they cannot be rotated. The rotatable octagon (6400) has four side upper surfaces (6410) and a central upper surface (6420), as well as a lower surface (6430). The lower surface is defined by four surface notches (6440), arranged in pairs, with each pairs cut so that the axial direction of the length (the longest dimension) of each notch is parallel to one set of opposing faces of the rotatable octagon, with the second pair of notches perpendicular to the first pair of notches (forming a shape roughly similar to a "Tic-Tac-Toe" shape), each notch of the pair of notches separated by a distance equal to twice the width of the end portion of a basic log (100), each notch having a width of a basic log (100), and each notch having a depth of one-third to one-quarter of the height of a basic log (100). A cutaway of a basic log (100) is shown for scale. Cut into the center of the central upper surface (6420) is a hole (6450), passing through the entirety of the rotatable octagon (6400), and of sufficient diameter to permit a dowel to pass through the hole (6450), allowing the rotatable octagon (6400) to turn on the axis defined by the dowel.

Figure 65:
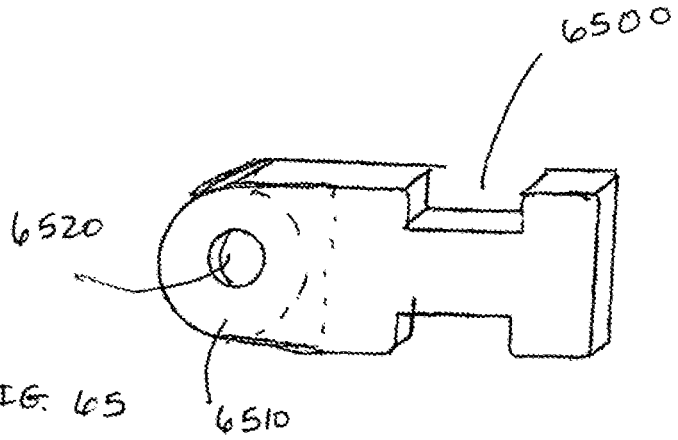
FIG. 65 shows an embodiment of a vertical hinge.

FIG. 65 shows a vertical hinge (6500). Like other specialty pieces, the vertical hinge is essentially a special log (300) attached to an elongated semi-spheroid prism (6510) of the same thickness as the special log (300). The elongated semi-spheroid prism (6510) contains a hole (6520) which passes through the thickness of the elongated semi-spheroid prism (6510). A dowel of sufficient size could be passed through the hole (6520) and into a hole (6520) of a similar vertical hinge (6500) or other piece with a corresponding hole. This could allow for ramps or drawbridges.

Figure 66:
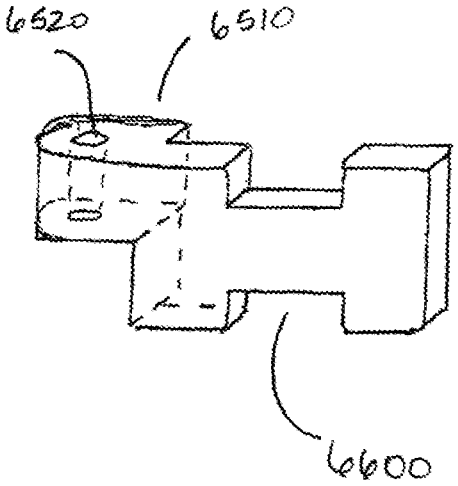
FIG. 66 shows an embodiment of a horizontal hinge.

FIG. 66 shows a horizontal hinge (6600). Like other specialty pieces, the vertical hinge is essentially a special log (300) attached to an elongated semi-spheroid prism (6310) of the same thickness as the special log (300), though unlike the vertical hinge (6300), the elongated semi-spheroid prism (6310) is attached to at right angles to the special log (300). The elongated semi-spheroid prism (6310) contains a hole (6320) which passes through the thickness of the elongated semi-spheroid prism (6310). A dowel of sufficient size could be passed through the hole (6320) and into a hole (6320) of a similar horizontal hinge (6600) or other piece with a corresponding hole. This would allow for doors or similar items.

Figure 67:
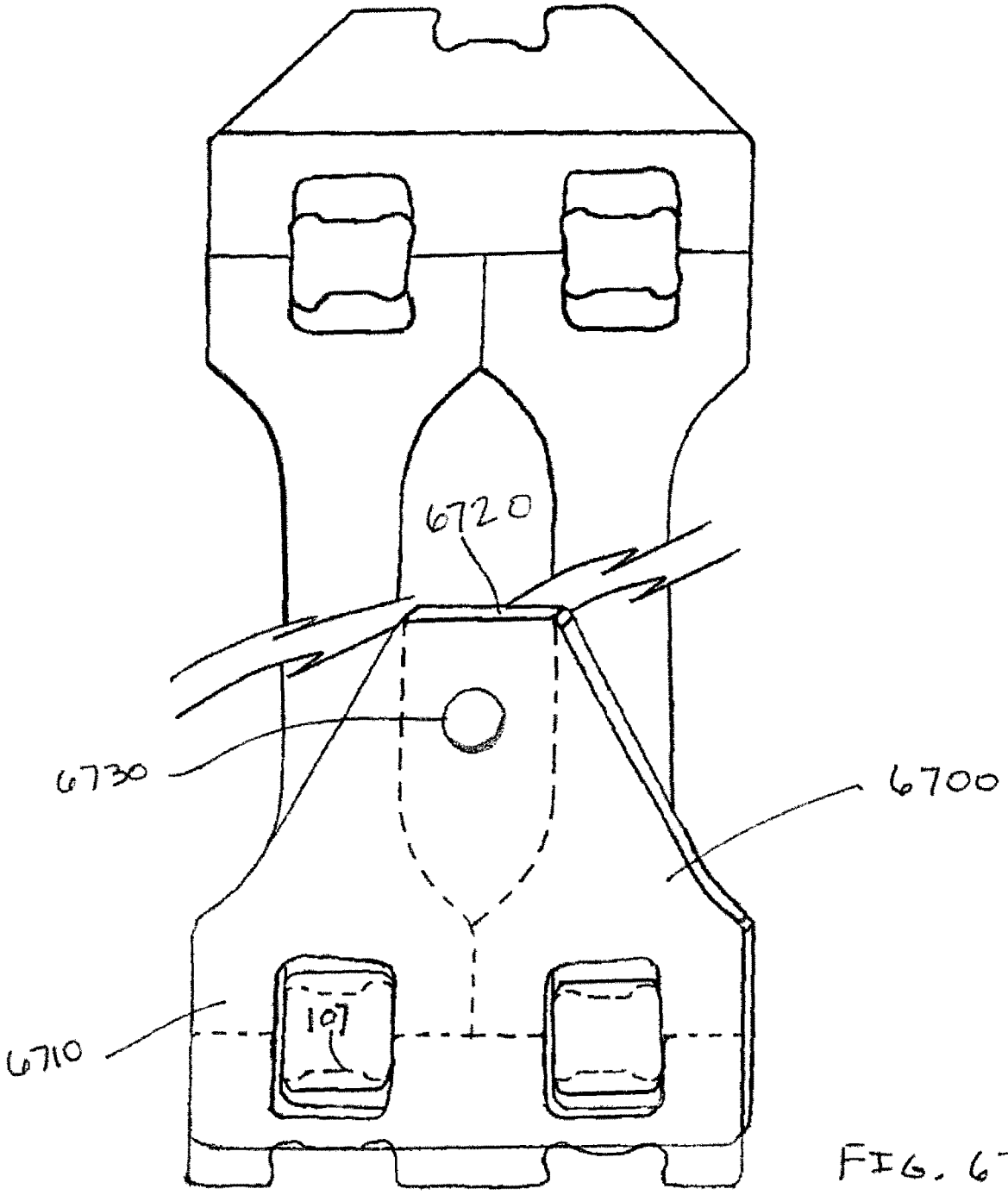
FIG. 67 shows an embodiment of a drawbridge system.

FIG. 67 shows a drawbridge system (6700). As previously discussed, the use of a vertical hinge (6500) can allow for drawbridges. While the vertical hinge (6500) can provide a lower pivot point, this does nothing to actually raise a bridge or other structure from the horizontal. The drawbridge system (6700) can be placed at the bottom or top structure, connecting to other building toy pieces in the same manner using notches (107) in the base (6710) of the drawbridge system (6700) spaced in a manner that allows for interlocking structure. On the side opposite the notches spaced below the topmost edge (6720) of the drawbridge system is a hole (6730) which passes through the thickness of the drawbridge system (6700). A dowel of sufficient size could be passed through the hole (6730) and into a hole of a similar drawbridge system (6700) on the opposing side. A narrow diameter rope or fiber line of sufficient tensile strength can be attached to the dowel using standard methods, with the other end attached to a portion of the building toy connected to a vertical hinge (6500) or other similar pivot point. By rotating the rope around the dowel, the pivoting portion of the building toy can be raised or lowered as necessary.

As should be apparent from the description above, the building toy discussed herein provides for a much greater variety of structures to be built with the inclusion of only a relatively small number of specialty parts. This provides for a log-style building toy with much more flexibility than has previously been available.

The qualifier "generally," as used in the present case, would be understood by one of ordinary skill in the art to accommodate recognizable attempts to conform a device to the qualified term, which may nevertheless fall short of doing so. This is because terms such as "circular" and "are" are purely geometric constructs and mathematical concepts such as multipliers and equality do not actually exist, as no real-world component is a true "circle" or "arc" in the geometric sense and equality to an infinite number of decimal places is impossible outside of pure mathematics. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and geometric and mathematical relationships contemplated herein regardless of the inclusion of such qualifiers to include a ranges of variations from the literal geometric or mathematical meaning of the term in view of these and other considerations.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A log-style building toy comprising:

at least two basic logs, each of said bask lens being generally in the form of an elongated parallelepiped with two opposing ends and four sides giving it a width, height, and length; the basic log including at least four notches arranged therein, said four notches being arranged as two pairs of notches with each of said pairs of notches arranged toward said opposing ends, each of the notches in each pair of notches being arranged on opposing sides of said basic log and defining a center portion of each of said basic logs between said two pairs of notches and two end portions, each of said end portions being on the opposing side of one of said two pairs of notches, said end portion having an end length defined by the extension from said associated pair of notches; and said center portion having a center length defined by the distance between said two pairs of notches, wherein the center length of said basic log is greater than twice the end length of said basic log;

a dual connector log, said dual connector log being generally in the form of an elongated parallelepiped with two opposing ends and four sides giving it a width, height, and length; the dual connector log including at least four notches arranged therein, said four notches being arranged as two pairs of notches with each of said pairs of notches arranged toward said opposing ends, each of the notches in each pair of notches being arranged on opposing sides of said basic log and defining a center portion of each of said basic logs between said two pairs of notches and two end portions, each of said end portions being on the opposing side of one of said two pairs of notches, said end portion having a distance it extends from said associated pair of notches and said center portion having a center length defined by the distance between said two pairs of notches, wherein the center length of said dual connector log is generally equal to twice the end length of said basic log and said end length of the dual connector log is generally equal to said end length of said basic logs; and a rotatable octagon, said rotatable octagon being generally in the form of an octahedral prism, said rotatable octagon having a bottom surface and a top surface, said bottom surface and said top surface defining a maximum height, each of the eight sides of said rotatable octagon having a side length; with the distance between opposing sides of the rotatable octagon having a length defined by geometry;

wherein four octagon notches are cut into the top surface of the rotatable octagon, said four octagon notches being arranged as two pairs of octagon notches, such that the first pair of octagon notches is oriented such that the axial direction of longest dimension of each notch is parallel to a first set of opposing sides of said rotatable octagon, and the second pair of octagon notches is likewise oriented such that the axial direction of the longest dimension of each said octagon notch is parallel to a second set of opposing faces and perpendicular to said first pair of octagon notches, said each octagon notch of said first pair of octagon notches separated by a distance equal to twice the width of said basic log, said each octagon notch of said second pair of octagon notches separated by a distance equal to twice the width of said basic log, said each octagon notch having a width of said basic log, and said each octagon notch having a depth of one-third to one-quarter of the height of said basic log;

wherein said two pairs of notches create four raised side surfaces and a raised central surface;

wherein said raised central surface of said rotatable octagon includes a hole that passes through the entire thickness of said rotatable octagon;

wherein, all of said notches in said basic logs and said dual connector logs are configured to extend a depth of generally one quarter of the height of the basic log into the log in which they are formed; and wherein, all said notches in said basic logs and said dual connector logs are designed to interlock with each other when said notches are aligned and said logs with said aligned notches are placed generally perpendicular to each other.

2. The building toy of claim 1 further comprising an arch log having an arcuate center portion and a first connecting end including a notch therein, wherein said notch is configured to extend a depth of generally one quarter of the height of said basic log into said arch log.

3. The building toy of claim 2 wherein said arch log has a second connecting end on an opposing end of said arcuate center portion, said second connecting end including at least one notch therein, wherein said notch is configured to extend a depth of generally one quarter of the height of said basic log into said arch log.

4. The building toy of claim 3, wherein said at least one notch comprises two notches.

5. The building toy of claim 3 wherein said second connecting end further includes a notch having a depth generally equal to said width of said basic log and a width generally equal to one quarter of the height of said basic log.

6. The building toy of claim 1 further comprising an arch log having an arcuate center portion and a first connecting end including a notch therein, wherein said notch is configured to extend a depth of one half of the height of said basic log into said arch log.

7. The building toy of claim 6 wherein said arch log has a Second connecting end on an opposing end of said arcuate center portion, said second connecting end including at least one notch therein, wherein said notch is configured to extend a depth of generally one quarter of the height of said basic log into said arch log.

8. The building toy of claim 7 wherein said at least one notch comprises two notches.

9. The building toy of claim 7 wherein said second connecting end further includes a notch having a depth generally equal to said width of said basic log and a width generally equal to one quarter of the height of said basic log.

10. The building toy of claim 7 wherein one or more of said arcuate center portion, said first connecting end, or said second connecting end of said arch log has at least one hole which penetrates the thickness of said arch log.

* * * * *